US007393078B2

(12) United States Patent
Yazawa et al.

(10) Patent No.: US 7,393,078 B2
(45) Date of Patent: Jul. 1, 2008

(54) INK JET PRINTING APPARATUS AND PRINTING METHOD

(75) Inventors: Takeshi Yazawa, Yokohama (JP); Hiroshi Tajika, Yokohama (JP); Yuji Konno, Kawasaki (JP); Hitoshi Nishikori, Inagi (JP); Yoshito Mizoguchi, Kawasaki (JP); Daisaku Ide, Tokyo (JP); Satoshi Seki, Kawasaki (JP); Hirokazu Yoshikawa, Kawasaki (JP); Hideaki Takamiya, Kawasaki (JP); Fumiko Yano, Tokyo (JP); Kosuke Yamamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 142 days.

(21) Appl. No.: 11/515,755

(22) Filed: Sep. 6, 2006

(65) Prior Publication Data

US 2007/0057996 A1 Mar. 15, 2007

(30) Foreign Application Priority Data

Sep. 9, 2005 (JP) ..... 2005-262367
Dec. 15, 2005 (JP) ..... 2005-362419

(51) Int. Cl.
*B41J 29/393* (2006.01)

(52) U.S. Cl. ..... 347/19; 347/14; 347/15; 347/105

(58) Field of Classification Search ..... 347/14, 347/15, 19, 105, 16, 41, 104
See application file for complete search history.

(56) References Cited

U.S. PATENT DOCUMENTS

| | | | | | |
|---|---|---|---|---|---|
| 4,999,646 | A | * | 3/1991 | Trask | 347/41 |
| 5,132,702 | A | * | 7/1992 | Shiozaki et al. | 347/12 |
| 5,384,587 | A | * | 1/1995 | Takagi et al. | 347/41 |
| 6,164,756 | A | * | 12/2000 | Takahashi et al. | 347/43 |
| 2004/0257398 | A1 | | 12/2004 | Otsuki | |
| 2006/0044333 | A1 | | 3/2006 | Nishikori et al. | |

FOREIGN PATENT DOCUMENTS

| | | | |
|---|---|---|---|
| JP | 6-330616 | A | 11/1994 |
| JP | 2000-177150 | A | 6/2000 |
| JP | 2002-103584 | A | 4/2002 |
| JP | 2002-144552 | A | 5/2002 |

* cited by examiner

*Primary Examiner*—Lamson D. Nguyen
(74) *Attorney, Agent, or Firm*—Fitzpatrick, Cella, Harper & Scinto

(57) ABSTRACT

High image quality is maintained even on front and rear ends of a printing medium where deterioration in the image quality is more likely to occur due to reduction in conveyance accuracy of the printing medium. In printing on the front and rear ends, the printing medium being not supported by both conveying means respectively placed upstream and downstream of a printing point in a printing medium conveying direction, a print swath of a printing head and the amount of conveying a printing medium are reduced. Moreover, the reducing print swath and the reducing conveyance amount are designed to be decreased in the cases of selecting a printing medium for high-quality printing as well as a monochrome print mode where image distortion caused by deviation of ink-landing positions is more noticeable due to a small number of colors of ink to be used and low coverage thereof.

14 Claims, 43 Drawing Sheets

| MASK PATTERN | (a) | (b) | (c) | (d) | (e) |
|---|---|---|---|---|---|
| END PORTION DUTY RATIO | 0.6 | 0.5 | 0.4 | 0.3 | 0.2 |
| END PORTION DUTY | 15% | 12.5% | 10% | 7.5% | 5% |
| CENTRAL PORTION DUTY | 35% | 37.5% | 40% | 42.5% | 45% |

FIG.36

INK JET PRINTING APPARATUS AND PRINTING METHOD

BACKGROUND OF THE INVENTION

1. Field of the Invention

The present invention relates to an ink jet printing apparatus and a printing method of applying ink as a printing agent to a printing medium to form an image.

2. Description of the Related Art

In these days, OA (Office Automation) equipment such as personal computers and word processors have come into wide use and various printing apparatuses have been provided to print information outputted from this equipment on different types of printing media. In particular, ink jet printing apparatuses have various advantageous points such as low noise, low running cost, small structure, relatively easy realization of color printing and the like, and thereby, such printing apparatuses have been used by a wide range of users. Particularly, in recent years, there has been a growing demand for outputting an image taken by a digital camera with the quality equivalent to that of silver-salt photographs. In response to such demand, printing methods to which various devices are applied have been put into practice. In addition, for instance, there have been commercialized and widespread apparatuses capable of printing without margins (hereinafter referred to as a marginless print) on edge portions, such as front and a rear end portions, of the printing medium. However, regarding the front and rear end portions of the printing medium, conveyance accuracy of the printing medium tends to be deteriorated due to the structures of the printing apparatuses. In order to solve such a problem, there have been already provided ink jet printing apparatuses in which a special printing method is adopted for printing on the front and rear end portions of the printing medium. A specific structure of "printing on the front and rear end portions" will be briefly described, below.

(Regarding Printing on Front and Rear End Portions)

Generally, there is a tendency that an image is distorted when the image is printed on the front or the rear end portion of the printing medium. This problem is caused mainly by a state in which the printing medium is separated from a part of plural rollers conveying the printing medium with supporting front and rear portions the printing medium. The following will specifically explain the aforementioned state by using the drawings.

FIG. 41 is a view schematically showing a printing head, a printing medium, and a conveyance mechanism which conveys the printing medium when the central portion of the printing medium is printed. In FIG. 41, a conveying roller M3060 is positioned upstream in a conveying direction, and two paper discharging rollers M3100 and M3110 are positioned downstream. The conveying roller M3060 and the paper discharging rollers M3100 and M3110 work respectively in cooperation with a pinch roller M3070 and two spurs M3120 and M3120. In other words, three nip portions are formed, and a printing medium P is held in the nip portions to be conveyed.

Reference numeral H1000 indicates a printing head cartridge including a printing head in which a plurality of printing elements for ejecting ink are arranged at a predetermined pitch in the direction parallel to the conveying direction shown in FIG. 41.

The printing head cartridge H1000 ejects ink from each of the printing elements while the printing head cartridge H1000 is moving for scan in the direction perpendicular to the figure. Thereby, an image is formed on a region of the printing medium P positioned between the conveying roller M3060 and the paper discharging rollers M3100. The print scan by the printing head cartridge H1000 and the conveyance operation of the printing medium P by three pairs of rollers are alternatively repeated, so that an image is sequentially formed on the printing medium P.

FIG. 42 is a view illustrating a state in which a print operation goes forward from the state shown in FIG. 41 and a print is made on a portion in the vicinity of the rear end portion of the printing medium P. The printing medium P is already separated from the conveying roller M3060 and is conveyed by rotation of only the paper discharging rollers M3100 and M3110.

Generally, in many cases, there are slight differences in a roller diameter and conveyance accuracy between the conveying roller M3060 and the paper discharging rollers M3100 and M3110, because of differences in main functions between these rollers. The main function of the conveying roller M3060 is to position the printing medium at an appropriate position relative to the printing head for every print scan. Accordingly, the conveying roller M3060 has a roller having a diameter large enough to perform the conveyance operation with desired accuracy. In contrast to this, the main function of the paper discharging rollers M3100 and M3110 is to discharge, without failure, the printing medium on which the print has been made. Accordingly, in many cases, their roller diameters are smaller than that of the conveying roller M3060 and their conveyance accuracy of the printing media is inferior to that of the conveying roller M3060. Therefore, the state in which the conveyance accuracy is deteriorated occurs in a region printed between the time when the rear end portion of the printing medium P moves from the conveying roller M3060 and the time when the print on the rearmost end thereof is finished, as compared with the previously printed region. Under this state, if the conveyance amount is insufficient, a so-called "black line" sometimes appears by overlapping, with each other, adjacent image forming portions printed by two successive print scans. Conversely, if the conveyance amount is too large, a so-called "white line" appears by making a distance between the adjacent image forming portions printed by the two successive print scans. Depending on an image to be printed, this causes a non-negligible adverse effect upon the image.

Moreover, an adverse effect is also caused on the image when both end portions of the printing medium are not held. When the rear end portion of the printing medium P moves from the conveying roller M3060, the distance between the printing head and the printing medium (hereinafter referred to as head-to-paper distance) is varied to no small extent, and thereafter becomes unstable. The printing head cartridge H1000 performs the print scans while ejecting ink at timing corresponding to a predetermined head-to-paper distance which is maintained by the front and rear rollers. Then, ink ejected at appropriate timing forms dots on the printing medium and the dots are arranged at a suitable pitch to thereby form an image. Accordingly, if the head-to-paper distance varies during printing, or if a variation in the head-to-paper distance within a print swath is large, positions of the dots on the printing medium become unstable. For this reason, the adverse effect such as generation of the white line, the black line, or a granular impression on an image occurs on the image.

The aforementioned problem of the head-to-paper distance occurs when the print is made on the front end portion of the printing medium as in the case of making the print on the rear end portion thereof.

FIG. 43 is a view illustrating a state in which a print is made on a portion in the vicinity of the front end portion of the printing medium P. Under this state, the printing medium P is held only by the conveying roller M3060 and pinch roller M3070, which are positioned upstream, and thus conveyed. In other words, in the case where the print is made on the front end portion, the paper discharging rollers M3100 and M3110 are not involved in the conveyance of printing medium P. It can be said that the printing medium is conveyed with higher accuracy as compared with the state in which the print is made on the portion in the vicinity of the rear end portion illustrated in FIG. 42. However, the problem of the head-to-paper distance caused by the state in which the front end portion of the printing medium P is not held occurs as in the state shown in FIG. 42. Namely, the position accuracy of dots on the printing medium becomes unstable as compared with that of the print on the central portion of the printing medium (state in FIG. 41), whereby causing deterioration in image quality such as generation of the white line, the black line or the granular impression.

The following measures are taken against the aforementioned adverse effects on the image, which occur at the time of printing on the front and rear end portions of a printing medium, particularly in a serial-type printing apparatus designed in placing importance on the image quality (for example, Japanese Patent Application Laid-Open No. 2002-103584). Specifically, this is a method in which a print swath (that is, a range of the printing elements assigned to be involved for printing in an array of the printing elements actually ejecting the ink) of a printing head is reduced and in which the amount of conveying a printing medium is reduced in conjunction with the reduction in the print swath, when the print is made on the front and rear end portions. The print swath of the printing head is reduced, thereby making it possible to suppress variations in the head-to-paper distance within the print swath. In this case, particularly, execution of multi-pass print to be described later exerts an effect to suppress generation of the granular impression. Even when the conveyance accuracy is deteriorated, conveyance errors can be reduced by decreasing the amount of conveying the printing medium. Moreover, in combination with reduction in the pitch between portions where adjacent image forming portions printed by two successive print scans are connected, the method also exerts an effect to make the white line and the black line less noticeable. In addition, if the multi-pass print is combined, the effect can be more enhanced and the effect to suppress the generation of the granular impression can be also expected. This is because, in the multi-pass print, an image is formed by performing the print scans of multiple times on the same area of the printing medium.

Furthermore, the similar measures are taken in an ink jet printing apparatus which adopts an interlace printing method. In the interlace printing method, by using a printing head in a form having lower density of arrays of printing elements than density of printing, printing an image is completed by performing print scans of multiple times to interpolate the density of printing in the vertical scan direction. That is, the number of printing elements which actually eject ink is reduced only in printing on the front and rear end portions, and in conjunction with this reduction, the amount of conveying the printing medium is adjusted.

However, the inventors of the present invention recognized that it is difficult to suppress both the reduction of image quality and the reduction of printing speed where a reduction ratio of the print swath is uniformly set for printing on the front and rear end portions of the printing medium, regardless of conditions selected for printing. Concrete examples thereof will be described below.

Here, the conditions selected for printing include a condition related to an image print mode and a condition related to a printing medium to be used.

In recent years, with a widespread use of digital cameras, there is also a need for printing with the image quality comparable to that of silver-salt photographs by means of an ink jet printing apparatus capable of outputting a shot image onto a printing medium, such as paper or the like, easily in home-use environment. To that end, recently, there is a case in which a print is made by using six colors of ink including low color density ink such as light cyan ink and light magenta ink in addition to the ink of conventionally used four colors of cyan, magenta, yellow, and black, in order to attempt enhancement of the image quality in print results of images of color toned photographs.

Recently, digital cameras of single-lens reflex type digital cameras are marketed at relatively low prices, and ink jet printing apparatuses are therefore used for printing images of monochrome toned photographs as well as the images of color toned photographs. In the print of an image of the monochrome toned photograph, cyan ink (or magenta ink) and yellow ink are used for correcting color tone, in addition to black ink that serves as a basic tone of the monochrome image. Moreover, in order to lessen a granular impression in halftone, it is put into practice to add gray tone thereto by using light cyan and yellow inks. Namely, in the case of printing the image of the monochrome toned photograph, enhancement of the image quality thereof is attempted by making multi-color printing with a plurality of chromatic colors in addition to black as an achromatic color.

An attempt has been also made to improve the image quality by mounting, on the apparatus, a plurality of inks of achromatic colors (gray ink or the like) with different densities, instead of these multiple chromatic colors, and by making a print using the plurality of inks of achromatic colors with different densities (see Japanese Patent Application Laid-Open No. 2000-177150. Moreover, products are known in which such a print can be made (Photosmart 7960 manufactured by Hewlett Packard, and PM-4000PX manufactured by Seiko Epson).

By contrast, in some cases, all gradations covering from a highlight portion to a maximum print density portion are printed by using ink only of a single color (for example, black ink in a monochrome photo tone image) which can output the maximum print density of the color of a basic tone. In such cases, particularly in a halftone portion, the deviation in dot-landing positions is noticeable. For example, contrast in a monochrome image print is higher than that in a color image print, since, in the monochrome image print, dots of black ink are printed on a white print medium. A portion where dots are locally concentrated due to the deviation of the dot-landing positions tends to become noticeable due to appearance of the black line or the like.

The deviation in the landing positions of dots is caused by variations in nozzle configurations generated in manufacturing processing of ink jet print heads and noise components such as vibration of the apparatus during printing.

As symbolized by the case where an image is printed by using ink of a single color, the deviation of dot-landing positions tends to be more noticeable in the halftone portion as the number of colors of ink used becomes less. The reason will be described as follows.

In general, there is a tendency that the larger number of colors of ink is used, the larger amount of the ink in total is applied to a predetermined area on the printing medium. This results in an increase in ink coverage on the surface of the printing medium. Conversely, there is a tendency that the smaller number of colors of ink is used, the less amount of the ink in total is applied to the predetermined area on the printing medium. This results in a decrease in ink coverage thereon. The deviation of dot-landing positions in higher ink coverage does not affect so much the image quality. If the deviation of dot-landing positions occurs in low ink coverage, however, the image quality is appreciably affected. This is because of the following reason. Specifically, in the case of the low ink coverage, the color of the printing medium itself is more likely to be seen in a larger portion, as compared with the case of the high ink coverage. Accordingly, the deviation of dot-landing positions cyclically varies appearance of the color of the printing medium itself.

Moreover, in the case of the monochrome images, the deviation in dot landing positions becomes even more noticeable because of a higher contrast between the color of black ink and the color of the print medium, in addition to the originally low ink coverage caused by printing with only the black ink. In addition, the conveyance accuracy of the printing medium is deteriorated in printing on the front and rear end portions of the printing medium, as mentioned above. As a result, the adverse effects such as generation of the white line, the black line, or granular impression on the image are outstandingly noticeable. This problem cannot be solved by uniformly reducing the print swath of the printing head for printing on the front and rear end portions.

Furthermore, in actual, properties of the printing media have an influence on the degree of the conveyance accuracy and that of variations in the head-to-paper distance when the printing medium is supported and conveyed only by a roller positioned either upstream or downstream in the conveying direction. Depending on the properties, each of the printing media have differences, from another printing medium, in thickness of the printing media, stiffness thereof, roughness thereof, presence or absence of an ink absorbing layer, the properties of the ink absorbing layer and the like. Accordingly, depending on the type of the printing medium, a coefficient of friction between the printing medium and the roller as well as degrees of curvature caused in the front and rear end portions of the printing medium are different from those of another printing medium.

For this reason, in the case where the print swath and the amount of conveying the printing medium are uniformly set for printing on the front and rear end portions of the printing medium, the following phenomena may occur. In some case, deterioration in the image quality, which may occur in printing on printing the front and rear end portions of a certain type of printing medium, can be effectively suppressed by use of the above-mentioned method. In another case, however, this method may not be effective for another type of printing medium.

Furthermore, when the print swath of the printing head is narrowed to reduce the amount of conveying the printing medium, a time required for making a print on one printing medium is increased accordingly. In the conventional controlling method, since the print swath and the amount of conveying the printing medium are uniformly set for printing the front and rear end portions of the printing medium, a user request cannot be satisfied in some cases. For example, there may be a case in which the user desires to make a print with priority placed on printing quality even if some amount of time is required, while there may be a case in which the user desires to make a print with priority placed on printing speed.

As described in the foregoing, where a reduction ratio of the print swath is uniformly set for printing on the front and rear end portions of the printing medium, regardless of conditions selected for printing, it is difficult to suppress both the reduction of image quality and the reduction of printing speed. Moreover, there is a case in which a user request cannot be satisfied.

SUMMARY OF THE INVENTION

In view of the foregoing problems, an object of the present invention is to achieve a printing on front/rear end portion so as to be adapted to conditions selected for printing.

In a first aspect of the present invention, there is provided an ink jet printing apparatus for printing an image by performing a print scan which makes a print while causing a printing head, which includes an array of printing elements for ejecting ink, to scan on a printing medium in a direction different from a direction of the array, and by conveying the printing medium in a direction intersecting with the direction of the print scan, the apparatus comprising:

controller which reduces a range in the array of the printing elements to be used for printing on at least one of front and rear end portions of the printing medium so that the range can be smaller than a range in the array of the printing elements to be used for printing on a central portion of the printing medium, and thus, which performs the print scan, wherein the controller changes the size of the reducing range depending on at least one of a print mode selected from a plurality of print modes, each having the different number of colors of ink usable for printing the image, and a type of selected printing medium.

In a second aspect of the present invention, there is provided an ink jet printing apparatus for printing an image by performing a print scan which makes a print while causing a printing head, which includes an array of printing elements for ejecting ink, to scan on a printing medium in a direction different from a direction of the array, and by conveying the printing medium in a direction intersecting with the direction of the print scan, the apparatus comprising:

controller which reduces a range in the array of the printing elements to be used for printing on at least one of front and rear end portions of the printing medium so that the range can be smaller than a range in the array of the printing elements to be used for printing on a central portion of the printing medium, and thus, which performs the print scan, wherein the controller changes the size of the reducing range depending on a print mode selected from a plurality of print modes, each having the different number of colors of ink usable for printing the image.

In a third aspect of the present invention, there is provided an ink jet printing apparatus for printing an image by performing a print scan which makes a print while causing a printing head, which includes an array of printing elements for ejecting ink, to scan on a printing medium in a direction different from a direction of the array, and by conveying the printing medium in a direction intersecting with the direction of the print scan, the apparatus comprising:

controller which reduces a range in the array of the printing elements to be used for printing on at least one of front and rear end portions of the printing medium so that the range can be smaller than a range in the array of the printing elements to be used for printing on a central portion of the printing medium, and thus, which performs the print scan, wherein the controller changes the size of the reducing range depending on a type of selected printing medium.

In a fourth aspect of the present invention, there is provided an ink jet printing apparatus for printing an image by performing a print scan which makes a print while causing a printing head, which includes an array of printing elements for ejecting ink, to scan on a printing medium in a direction different from a direction of the array, and by conveying the printing medium in a direction intersecting with the direction of the print scan, the apparatus comprising:

conveyance controller which reduces the amount of conveying the printing medium in making the print on at least one of front and rear end portions of the printing medium as compared with the amount of conveying the printing medium in making the print on a central portion of the printing medium, wherein the controller changes the reducing conveyance amount depending on at least one of a print mode selected from a plurality of print modes, each having the different number of colors of ink usable for printing the image, and a type of selected printing medium.

In a fifth aspect of the present invention, there is provided an ink jet printing method of printing an image by performing a print scan which makes a print while causing a printing head, which includes an array of printing elements for ejecting ink, to scan on a printing medium in a direction different from a direction of the array, and by conveying the printing medium in a direction intersecting with the direction of the print scan, the method comprising the step of:

reducing a range in the array of the printing elements to be used for printing on at least one of front and rear end portions of the printing medium so that the range can be smaller than a range in the array of the printing elements to be used for printing on a central portion of the printing medium, and performing the print scan using the printing elements of the reduced range, wherein in the reducing step, the size of the reducing range is changed depending on at least one of a print mode selected from a plurality of print modes, each having the different number of colors of ink usable for printing the image, and a type of selected printing medium.

In a sixth aspect of the present invention, there is provided an ink jet printing method of printing an image by performing a print scan which makes a print while causing a printing head, which includes an array of printing elements for ejecting ink, to scan on a printing medium in a direction different from a direction of the array, and by conveying the printing medium in a direction intersecting with the direction of the print scan, the method comprising the step of:

reducing the amount of conveying the printing medium in making the print on at least one of front and rear end portions of the printing medium as compared with the amount of conveying the printing medium in making the print on a central portion of the printing medium, wherein in the reducing step, the reducing conveyance amount is changed depending on at least one of a print mode selected from a plurality of print modes, each having the different number of colors of ink usable for printing an image, and a type of selected printing medium.

The present invention permits to print on front/rear end portion so as to be adapted to conditions selected for printing. As a result, it is possible to suppress both the reduction of image quality and the reduction of printing speed.

Further features of the present invention will become apparent from the following description of exemplary embodiments (with reference to the attached drawings).

BRIEF DESCRIPTION OF THE DRAWINGS

FIG. 32A shows a state in which printing is moved from a portion in the vicinity of the front end portion of the printing medium to the central portion thereof. FIG. 32B shows a state in which printing is moved from the central portion of the printing medium to a portion in the vicinity of the rear end portion thereof.

FIG. 33A shows a state in which printing is moved from a portion in the vicinity of the front end portion of the printing medium to the central portion thereof. FIG. 33B shows a state in which printing is moved from the central portion of the printing medium to a portion in the vicinity of the rear end portion thereof.

FIG. 36 is an explanatory diagram showing a central portion duty, an end portion duty and an end portion duty ratio of each of the mask patterns of FIG. 35.

DESCRIPTION OF THE EMBODIMENTS

Figure 1:
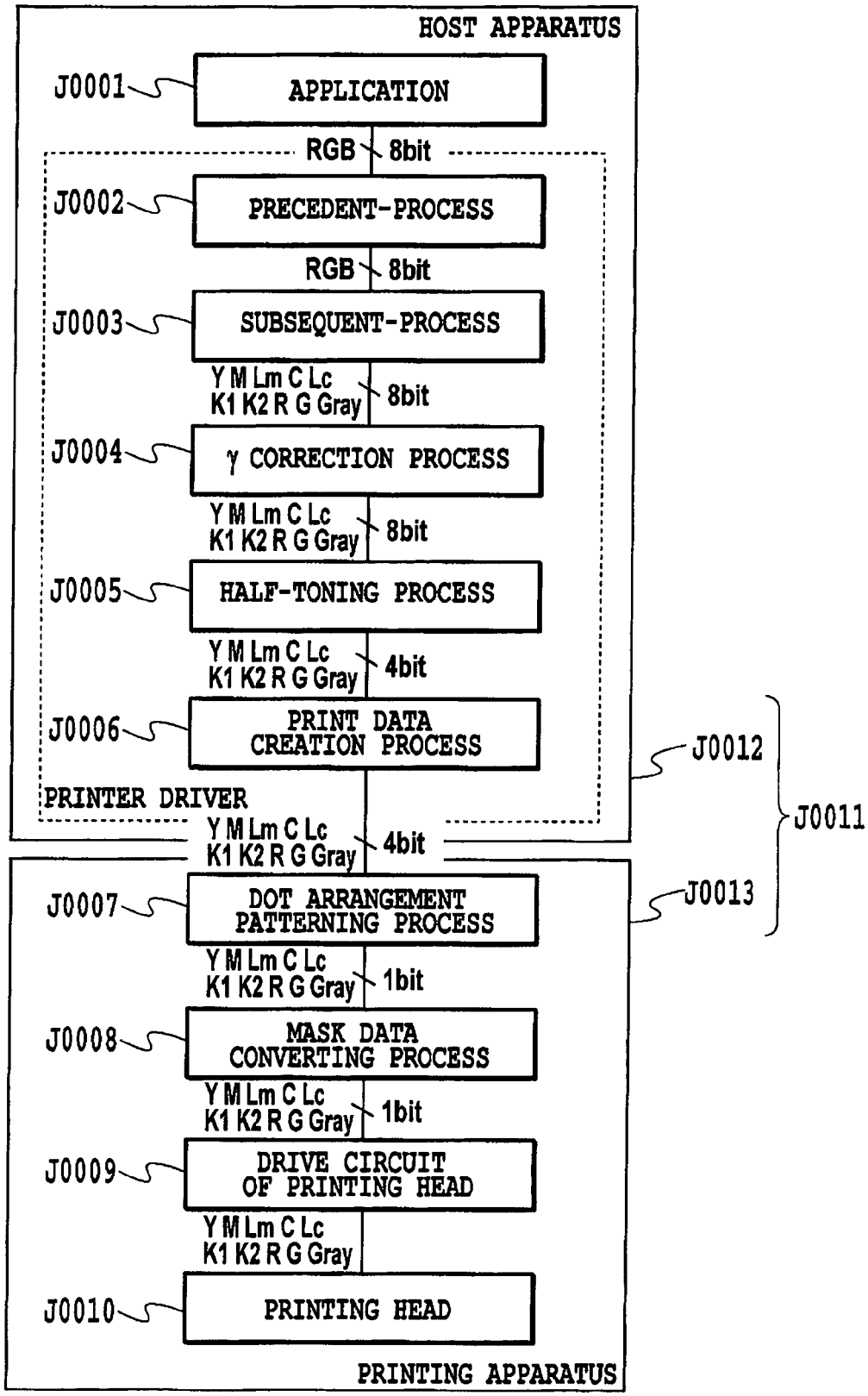
FIG. 1 is a diagram for explaining a flow in which image data are processed in a printing system to which an embodiment of the present invention is applied.

Descriptions will be provided below for embodiments of the present invention by referring to the drawings.

1. Basic Configuration

1.1 Outline of Printing System

FIG. 1 is a diagram for explaining a flow in which image data are processed in a printing system to which an embodiment of the present invention is applied. This printing system J0011 includes a host apparatus J0012 which generates image data indicating an image to be printed, and which sets up a user interface (UI) for generating the data and so on. In addition, the printing system J0011 includes a printing apparatus J0013 which prints an image on a printing medium on the basis of the image data generated by the host apparatus J0012. The printing apparatus J0013 performs a printing operation by use of 10 color inks of cyan (C), light cyan (Lc), magenta (M), light magenta (Lm), yellow (Y), red (R), green (G), black 1 (K1), black 2 (K2) and gray (Gray). To this end, a printing head H1001 for ejecting these 10 color inks is used for the printing apparatus J0013. These 10 color inks are pigmented inks respectively including ten color pigments as the color materials thereof.

Programs operated with an operating system of the host apparatus J0012 include an application and a printer driver. An application J0001 executes a process of generating image data with which the printing apparatus makes a print. Personal computers (PC) are capable of receiving these image data or pre-edited data which is yet to process by use of various media. By means of a CF card, the host apparatus according to this embodiment is capable of populating, for example, JPEG-formatted image data associated with a photo taken with a digital camera. In addition, the host apparatus according to this embodiment is capable of populating, for example, TIFF-formatted image data read with a scanner and image data stored in a CD-ROM. Moreover, the host apparatus according to this embodiment is capable of capturing data from the Web through the Internet. These captured data are displayed on a monitor of the host apparatus. Thus, an edit, a process or the like is applied to these captured data by means of the application J0001. Thereby, image data R, G and B are generated, for example, in accordance with the sRGB specification. A user sets up a type of printing medium to be used for making a print, a printing quality and the like through a UI screen displayed on the monitor of the host apparatus. The user also issues a print instruction through the UI screen. Depending on this print instruction, the image data R, G and B are transferred to the printer driver.

The printer driver includes a precedent process J0002, a subsequent process J0003, a γ correction process J0004, a half-toning process J0005 and a print data creation process J0006 as processes performed by itself. Brief descriptions will be provided below for these processes J0002 to J0006.

(A) Precedent Process

The precedent process J0002 performs mapping of a gamut. In this embodiment, data are converted for the purpose of mapping the gamut reproduced by image data R, G and B in accordance with the sRGB specification onto a gamut to be produced by the printing apparatus. Specifically, a respective one of image data R, G and B deal with 256 gradations of the respective one of colors which are represented by 8 bits. These image data R, G and B are respectively converted to 8-bit data R, G and B in the gamut of the printing apparatus J0013 by use of a three-dimensional LUT.

(B) Subsequent Process

On the basis of the 8-bit data R, G and B obtained by mapping the gamut, the subsequent process J0003 obtains 8-bit color separation data on each of the 10 colors. The 8-bit color separation data correspond to a combination of inks which are used for reproducing a color represented by the 8-bit data R, G and B. In other words, the subsequent process J0003 obtains color separation data on each of Y, M, Lm, C, Lc, K1, K2, R, G, and Gray. In this embodiment, like the precedent process, the subsequent process is carried out by using the three dimensional LUT, simultaneously using an interpolating operation.

(C) γ Correction Process

The γ correction J0004 converts the color separation data on each of the 10 colors which have been obtained by the subsequent process J0003 to a tone value (gradation value) representing the color. Specifically, a one-dimensional LUT corresponding to the gradation characteristic of each of the color inks in the printing apparatus J0013 is used, and thereby a conversion is carried so that the color separation data on the 10 colors can be linearly associated with the gradation characteristics of the printer.

(D) Half-Toning Process

The half-toning process J0005 quantizes the 8-bit color separation data on each of Y, M, Lm, C, Lc, K1, K2, R, G and Gray to which the γ correction process has been applied so as to convert the 8-bit separation data to 4-bit data. In this embodiment, the 8-bit data dealing with the 256 gradations of each of the 10 colors are converted to 4-bit data dealing with 9 gradations by use of the error diffusion method. The 4-bit data are data which serve as indices each for indicating a dot arrangement pattern in a dot arrangement patterning process in the printing apparatus.

(E) Print Data Creation Process

The last process performed by the printer driver is the print data creation process J0006. This process adds information on print control to data on an image to be printed whose contents are the 4-bit index data, and thus creates print data.

Figure 2:
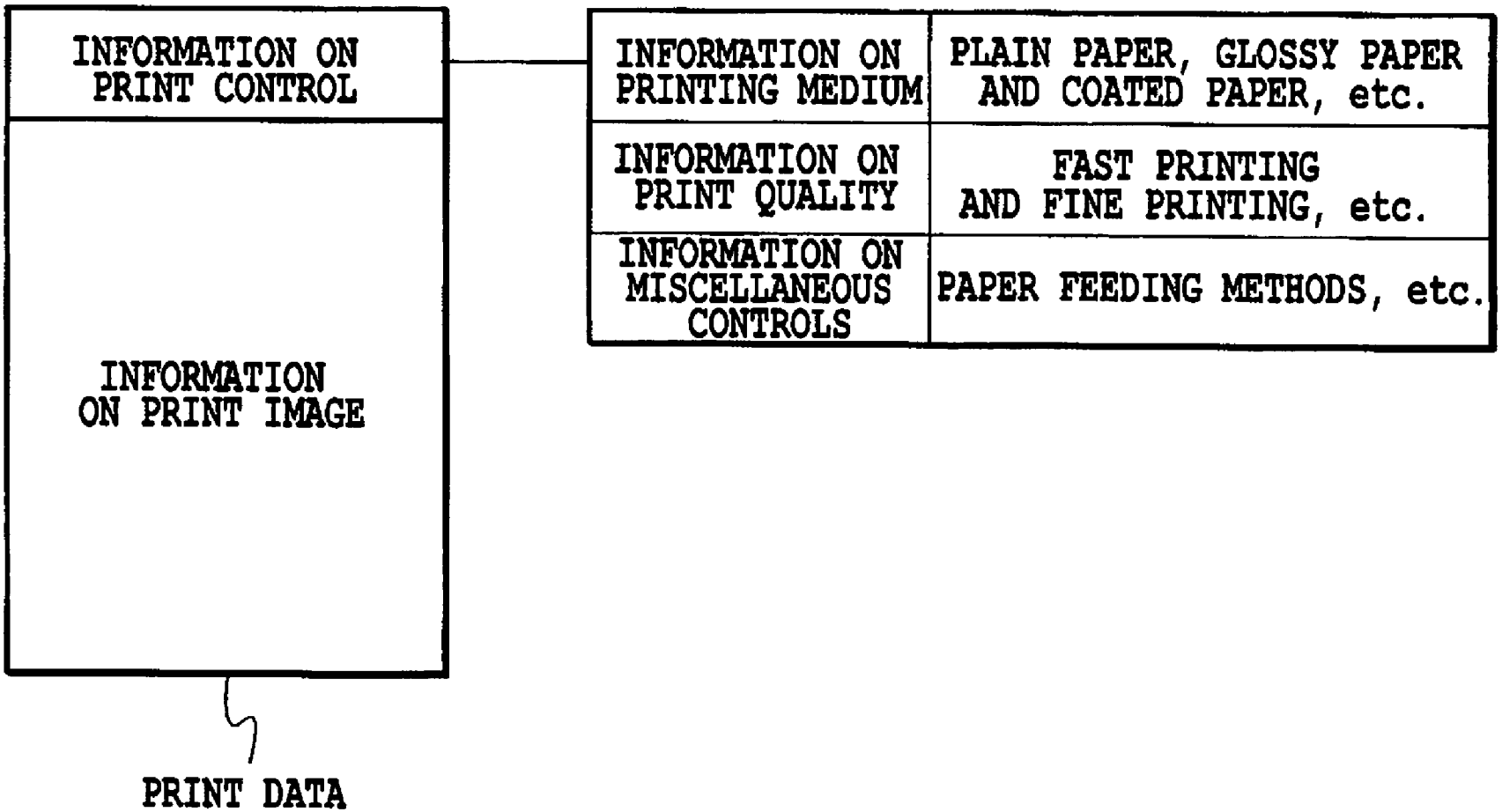
FIG. 2 is an explanatory diagram showing an example of a configuration of print data transferred from a printer driver of a host apparatus to a printing apparatus in the printing system shown in FIG. 1.

FIG. 2 is a diagram showing an example of a configuration of the print data. The print data are configured of the information on print control and the data on an image to be printed. The information on print control is in charge of controlling a printing operation. The data on an image to be printed indicates an image to be printed (the data are the foregoing 4-bit index data). The information on print control is configured of "information on printing medium," "information on print quality," and "information on miscellaneous controls" including information on paper feeding methods or the like. A type of printing media on which to make a print is described in the information on printing medium. One type of printing medium selected out of a group of plain paper, glossy paper, mat paper, a post card, a printable disc and the like is specified in the information on printing medium. Print quality to be sought are described in the information on print quality. One type of print quality selected out of a group of "fine (high-quality print)," "normal," "fast (high-speed print)" and the like is specified in the information on print quality. Note that these pieces of information on print control are formed on the basis of contents which a user designates through the UI screen in the monitor of the host apparatus J0012. In addition, image data originated in the half-toning process J0005 are described in the data on an image to be printed. The print data thus generated are supplied to the printing apparatus J0013.

The printing apparatus J0013 performs a dot arrangement patterning process J0007 and a mask data converting process J0008 on the print data which have been supplied from the host apparatus J0012. Descriptions will be provided next for the dot arrangement patterning process J0007 and the mask data converting process J0008.

(F) Dot Arrangement Patterning Process

In the above-described half-toning process J0005, the number of gradation levels is reduced from the 256 tone values dealt with by multi-valued tone information (8-bit data) to the 9 tone values dealt with by information (4-bit data). However, data with which the printing apparatus J0013 is actually capable of making a print are binary data (1-bit) data on whether or not an ink dot should be printed. Taken this into consideration, the dot arrangement patterning process J0007 assigns a dot arrangement pattern to each pixel represented by 4-bit data dealing with gradation levels 0 to 8 which are an outputted value from the half-toning process J0005. The dot arrangement pattern corresponds to the tone value (one of the levels 0 to 8) of the pixel. Thereby, whether or not an ink dot should be printed (whether a dot should be on or off) is defined for each of a plurality of areas in each pixel. Thus, 1-bit binary data indicating "1 (one)" or "0 (zero)" are assigned to each of the areas of the pixel. In this respect, "1 (one)" is binary data indicating that a dot should be printed. "0 (zero)" is binary data indicating that a dot should not be printed.

Figure 3:
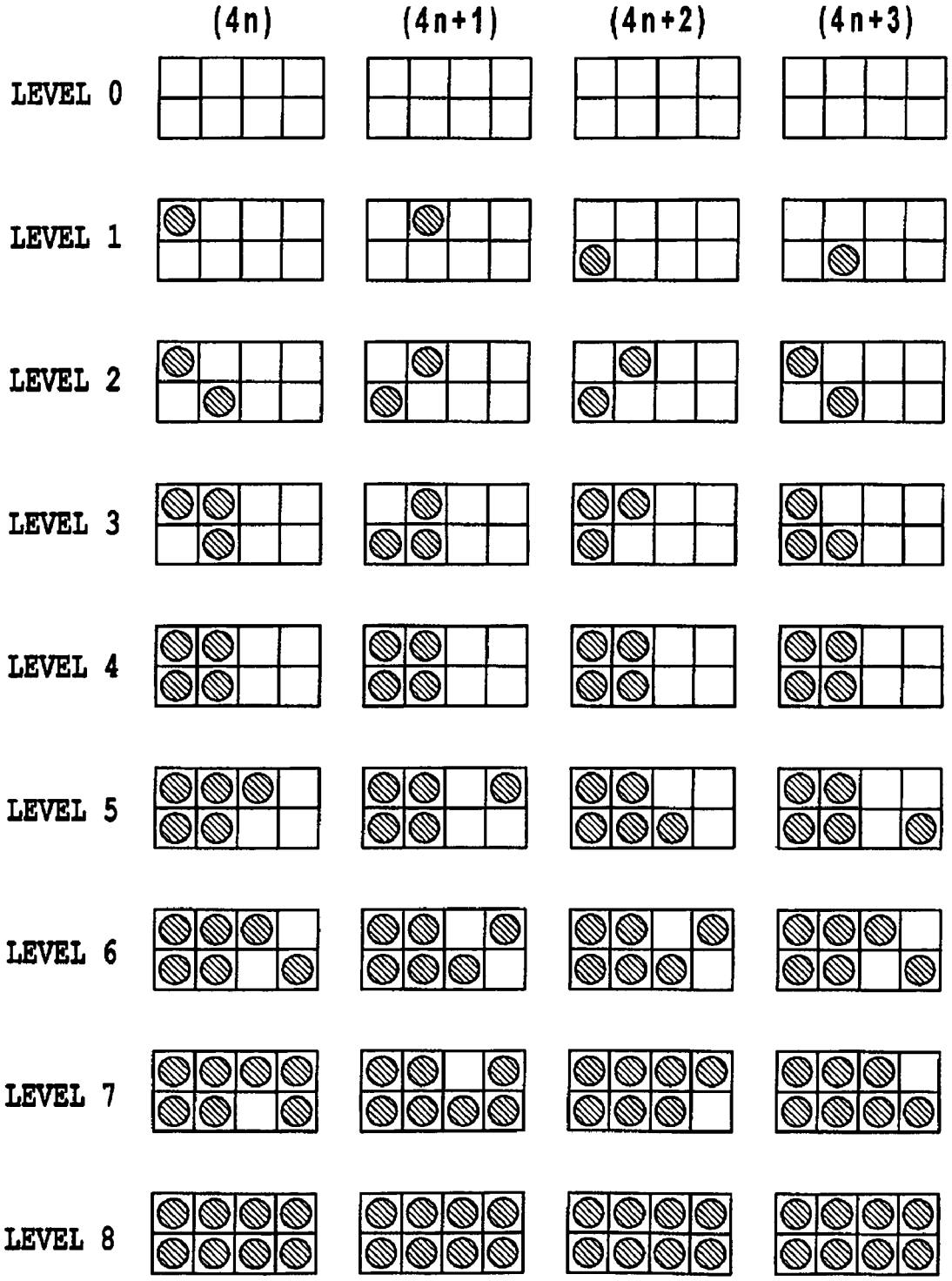
FIG. 3 is a diagram showing output patterns which correspond to input levels, and which are obtained by conversion in a dot arrangement patterning process in the printing apparatus used in the embodiment.

FIG. 3 shows output patterns corresponding to input levels 0 to 8. These output patterns are obtained through the conversion performed in the dot arrangement patterning process of the embodiment. Level numbers in the left column in the diagram correspond respectively to the levels 0 to 8 which are the outputted values from the half-toning process in the host apparatus. Regions each configured of 2 vertical areas ×4 horizontal areas are shown to the right of this column. Each of the regions corresponds to a region occupied by one pixel receiving an output from the half-toning process. In addition, each of the areas in one pixel corresponds to a minimum unit for which it is specified whether the dot thereof should be on or off. Note that, in this description, a "pixel" means a minimum unit which is capable of representing a gradation, and also means a minimum unit to which the image processes (the precedent process, the subsequent process, the γ correction process, the half-toning process and the like) are applied using multi-valued data represented by the plurality of bits.

In this figure, an area in which a circle is drawn denotes an area where a dot is printed. As the level number increases, the number of dots to be printed increases one-by-one. In this embodiment, information on density of an original image is finally reflected in this manner.

From the left to the right, (4 n) to (4 n+3) denotes horizontal positions of pixels, each of which receives data on an image to be printed. An integer not smaller than 1 (one) is substituted for n in the expression (4 n) to (4 n+3). The patterns listed under the expression indicate that a plurality of mutually-different patterns are available depending on a position where a pixel is located even though the pixel receives an input at the same level. In other words, the configuration is that, even in a case where a pixel receives an input at one level, the four types of dot arrangement patterns under the expression (4 n) to (4 n+3) at the same level are assigned to the pixel in an alternating manner.

In FIG. 3, the vertical direction is a direction in which the ejection openings of the printing head are arrayed, and the horizontal direction is a direction in which the printing head moves. The configuration enabling a print to be made using the plurality of different dot arrangement patterns for one level brings about the following two effects. First, the number of times that ejection is performed can be equalized between two nozzles in which one nozzle is in charge of the patterns located in the upper row of the dot arrangement patterns at one level, and the other nozzle is in charge of the patterns located in the lower row of the dot arrangement patterns at the same level. Secondly, various noises unique to the printing apparatus can be disgregated.

When the above-described dot arrangement patterning process is completed, the assignment of dot arrangement patterns to the entire printing medium is completed.

(G) Mask Data Converting Process

In the foregoing dot arrangement patterning process J0007, whether or not a dot should be printed is determined for each of the areas on the printing medium. As a result, if binary data indicating the dot arrangement are inputted to a drive circuit J0009 of the printing head H1001, a desired image can be printed. If the binary data derived from the dot arrangement patterning process J0007 is inputted to the drive circuit J0009 without intervention the mask data converting process J0008, what is termed as a one-pass print can be made. The one-pass print means that a print to be made for a single scan region on a printing medium is completed by the printing head H1001 moving once. On the contrary, if the binary data derived from the dot arrangement patterning process J0007 is inputted to the drive circuit J0009 through the mask data converting process J0008, what is termed as a multi-pass print can be made. The multi-pass print means that a print to be made for a single scan region on the printing medium is completed by the printing head moving a plurality of times. Here, descriptions will be provided for a mask data converting process, taking an example of the multi-pass print.

Figure 4:
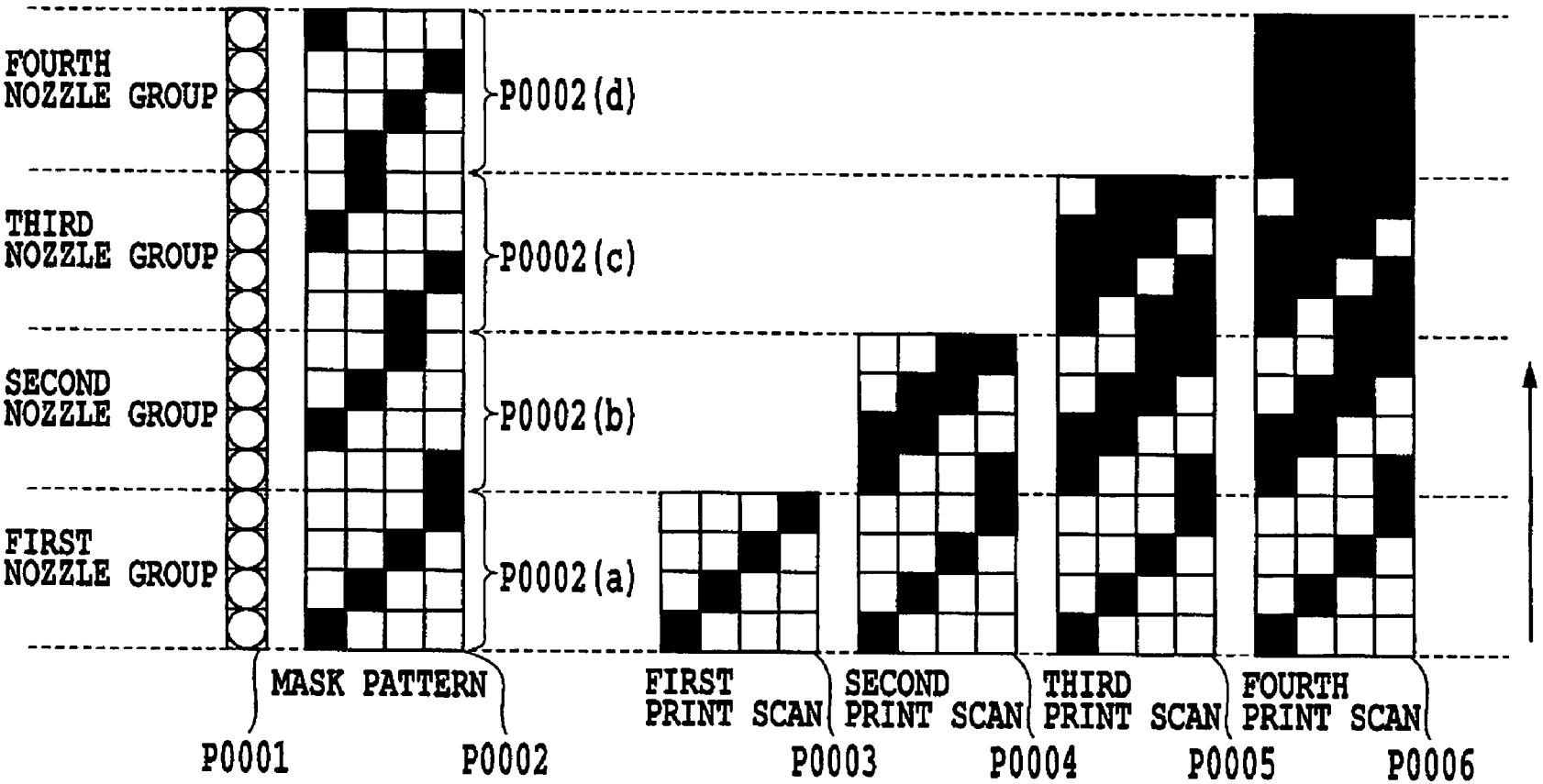
FIG. 4 is a schematic diagram for explaining a multi-pass printing method which is performed by the printing apparatus used in the embodiment.

FIG. 4 is a schematic diagram showing the printing head and print patterns for the purpose of describing the multi-pass printing method. The print head H1001 applied to this embodiment actually has 768 nozzles. For the sake of convenience, however, descriptions will be provided for the printing head and the print patterns, supposing that the printing head H1001 has 16 nozzles. The nozzles are divided into a first to a fourth nozzle groups. Each of the four nozzle groups includes four nozzles. Mask P0002 are configured of a first to a fourth mask patterns P0002(*a*) to P0002(*d*). The first to the fourth mask patterns P0002(*a*) to P0002(*d*) define the respective areas in which the first to the fourth nozzle groups are capable of making a print. Blackened areas in the mask patterns indicate printable areas, whereas whitened areas in the mask patterns indicate unprinted areas. The first to the fourth mask patterns are complementary to one another. The configuration is that, when these four mask patterns are superposed over one another, a print to be made in a region corresponding to a 4×4 area is completed.

Patterns denoted by reference numerals P0003 to P0006 show how an image is going to be completed by repeating a print scan. Each time a print scan is completed, the printing medium is transferred by a width of the nozzle group (a width of four nozzles in this figure) in a direction indicated by an arrow in the figure. In other words, the configuration is that an image in any same region (a region corresponding to the width of each nozzle region) on the printing medium is completed by repeating the print scan four times. Formation of an image in any same region on the printing medium by use of multiple nozzle groups by repeating the scan the plurality of times in the afore-mentioned manner makes it possible to bring about an effect of reducing variations characteristic of the nozzles, and an effect of reducing variations in accuracy in transferring the printing medium.

Figure 5:
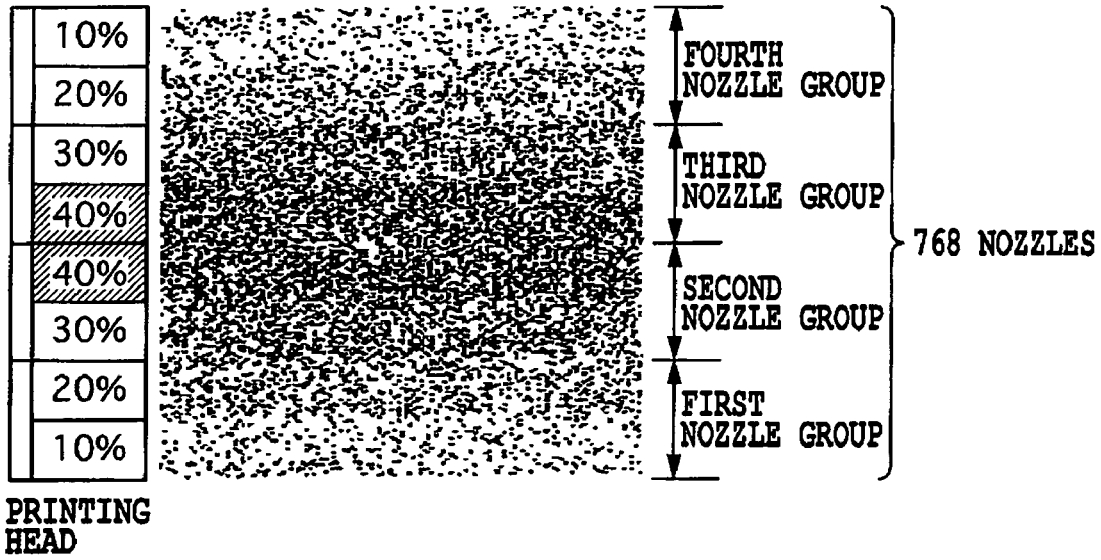
FIG. 5 is an explanatory diagram showing an example of mask patterns which are applied to the multi-pass printing method which is performed by the printing apparatus used in the embodiment.

FIG. 5 shows an example of mask which is capable of being actually applied to this embodiment. The printing head H1001 to which this embodiment is applied has 768 nozzles, and 192 nozzles belong to each of the four nozzle groups. As for the size of the mask, the mask has 768 areas in the vertical direction, and this number is equal to the number of nozzles. The mask has 256 areas in the horizontal direction. The mask has a configuration that the four mask patterns respectively corresponding to the four nozzle groups maintain a complementary relationship among themselves.

In the case of the ink jet printing head applied to this embodiment, which ejects a large number of fine ink droplets by means of a high frequency, it has been known that an air flow occurs in a neighborhood of the printing part during printing operation. In addition, it has been proven that this air flow particularly affects a direction in which ink droplets are ejected from nozzles located in the end portions of the printing head. For this reason, in the case of the mask patterns of this embodiment, a distribution of printable ratios is biased depending on which nozzle group a region belongs to, and on where a region is located in each of the nozzle groups, as seen from FIG. 5. As shown in FIG. 5, by employing the mask patterns having a configuration which makes the printable ratios of the nozzles in the end portions of the printing head smaller than those of nozzles in a central portion thereof, it is possible to make inconspicuous an adverse effect stemming from variations in positions where ink droplets ejected from the nozzles in the end portions of the printing head are landed.

Incidentally, in the present embodiment, it is not indispensable that the mask pattern having the biased distribution of printable ratios is employed. In the present embodiment, a mask pattern with an even distribution of printable ratios can be employed.

Note that a printable ratio specified by a mask pattern is as follows. A printable ratio of a mask pattern is a percentage denomination of a ratio of the number of printable areas constituting the mask pattern (blackened areas in the mask pattern P0002(*a*) to P0002(*d*) of FIG. 4) to the sum of the number of printable areas and the number of unprintable areas constituting the mask pattern (the whitened areas in the mask patterns P0002(*a*) to P0002(*d*) of FIG. 4). In other words, a printable ratio (%) of a mask pattern is expressed by $$M \div (M+N) \times 100$$

where M denotes the number of printable areas constituting the mask pattern and N denotes the number of unprintable areas constituting the mask pattern.

In this embodiment, data for the mask as shown in FIG. 5 are stored in memory in the main body of the printing apparatus. The mask data converting process J0008 performs the AND process on the mask data with the binary data obtained in the foregoing dot arrangement patterning process. Thereby, binary data to be a print object in each print scan are determined. Subsequently, the binary data are transferred to the driving circuit J0009. Thus, the printing head H1001 is driven, and hence inks are ejected in accordance with the binary data.

FIG. 1 shows that the host apparatus J0012 is configured to perform the precedent process J0002, the subsequent process J0003, the γ correction process J0004, the half-toning process J0005 and the print data creation process J0006. In addition, FIG. 1 shows that the printing apparatus J0013 is designed to perform the dot arrangement patterning process J0007 and the mask data converting process J0008. However, the present invention is not limited to this embodiment. For example, the present invention may be carried out as an embodiment in which parts of the processes J0002 to J0005 are designed to be performed by the printing apparatus J0013 instead of by the host apparatus J0012. Otherwise, the present invention may be carried out as an embodiment in which all of these processes are designed to be performed by the host apparatus J0012. Alternately, the present invention may be carried out as an embodiment in which the processes J0002 to J0008 are designed to be performed by the printing apparatus J0013.

1.2 Configuration of Mechanisms

Descriptions will be provided for a configuration of the mechanisms in the printing apparatus to which this embodiment is applied. The main body of the printing apparatus of this embodiment is divided into a paper feeding section, a paper conveying section, a paper discharging section, a carriage section, a flat-pass printing section and a cleaning section from a viewpoint of functions performed by the mechanisms. These mechanisms are contained in an outer case.

Figure 6:
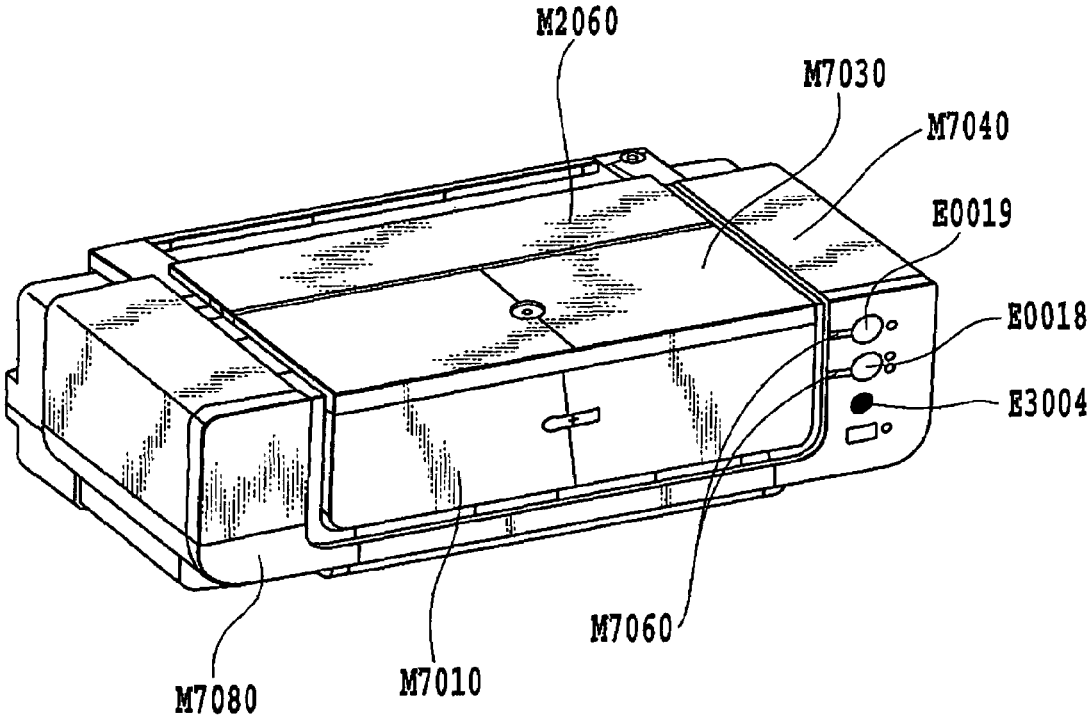
FIG. 6 is a perspective view of the printing apparatus used in the embodiment, and shows the printing apparatus in an unused condition when viewed from the front.
Figure 7:
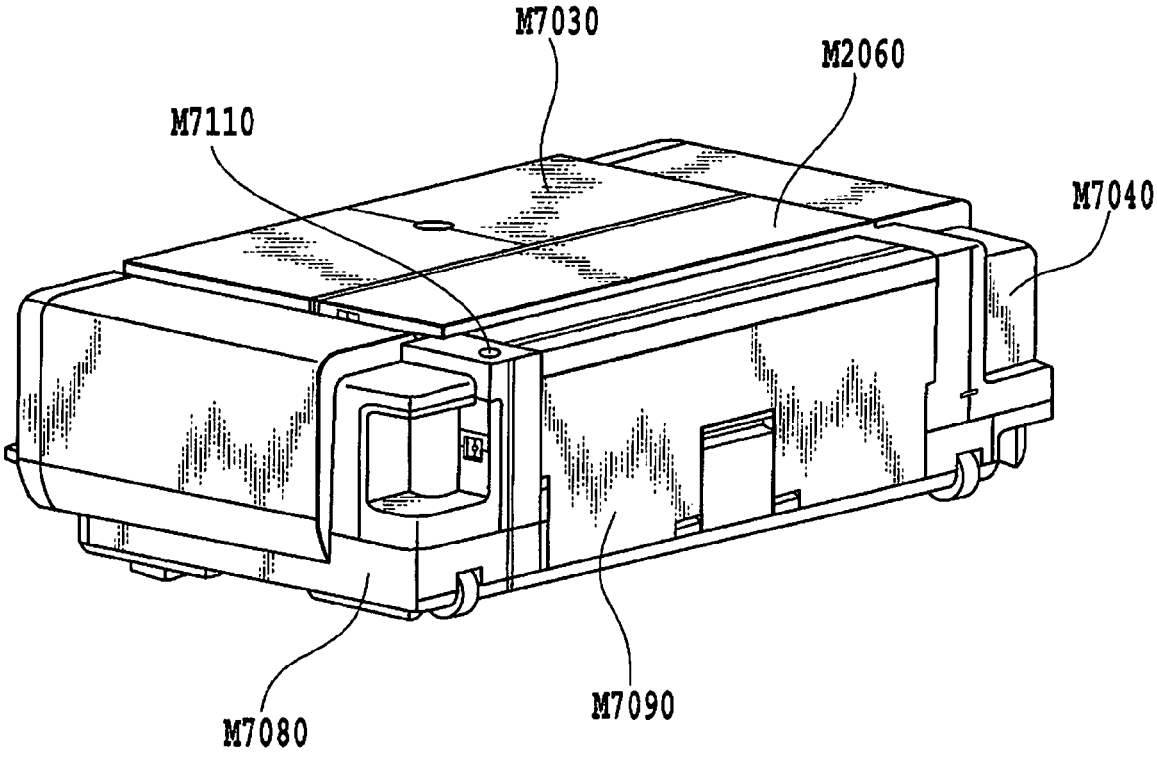
FIG. 7 is another perspective view of the printing apparatus used in the embodiment, and shows the printing apparatus in the unused condition when viewed from the back.
Figure 8:
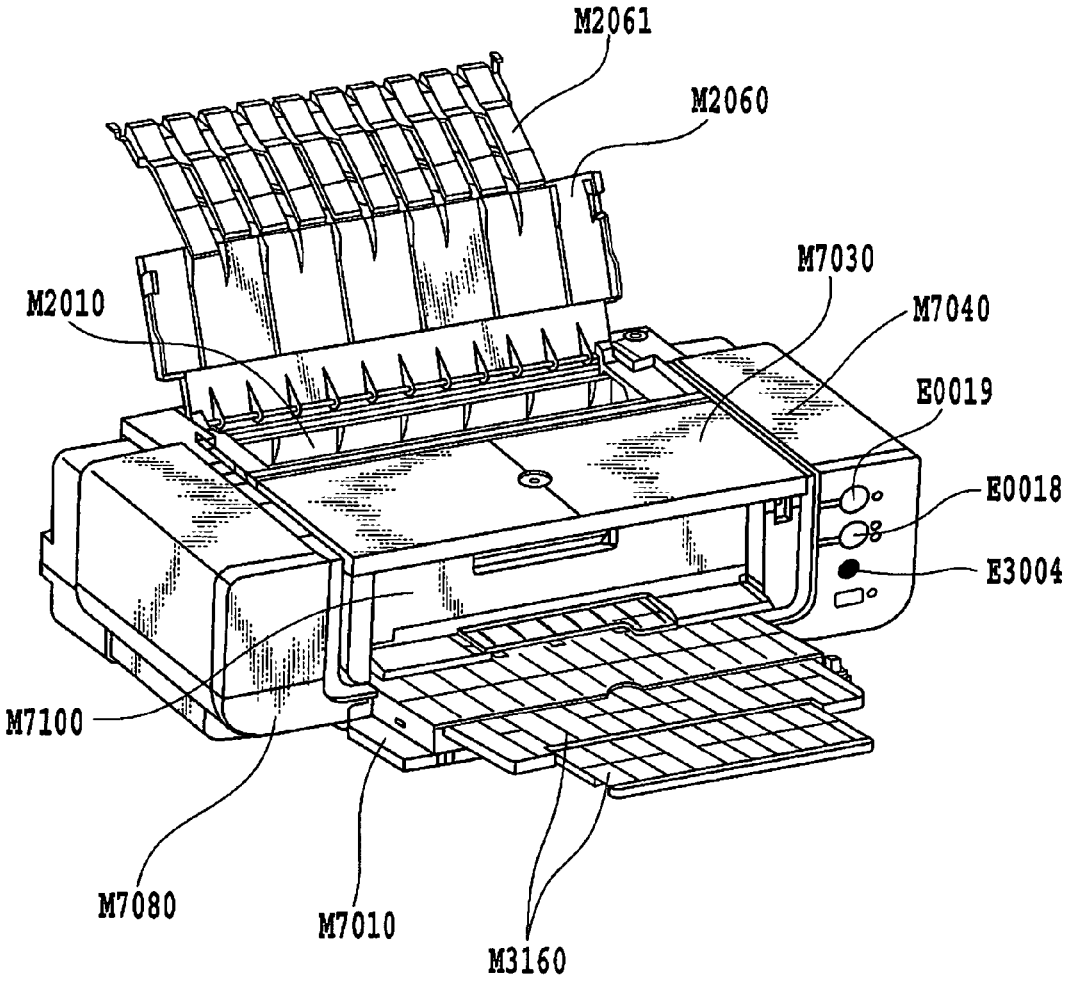
FIG. 8 is yet another perspective view of the printing apparatus used in the embodiment, and shows the printing apparatus in a used condition when viewed from the front.
Figure 9:
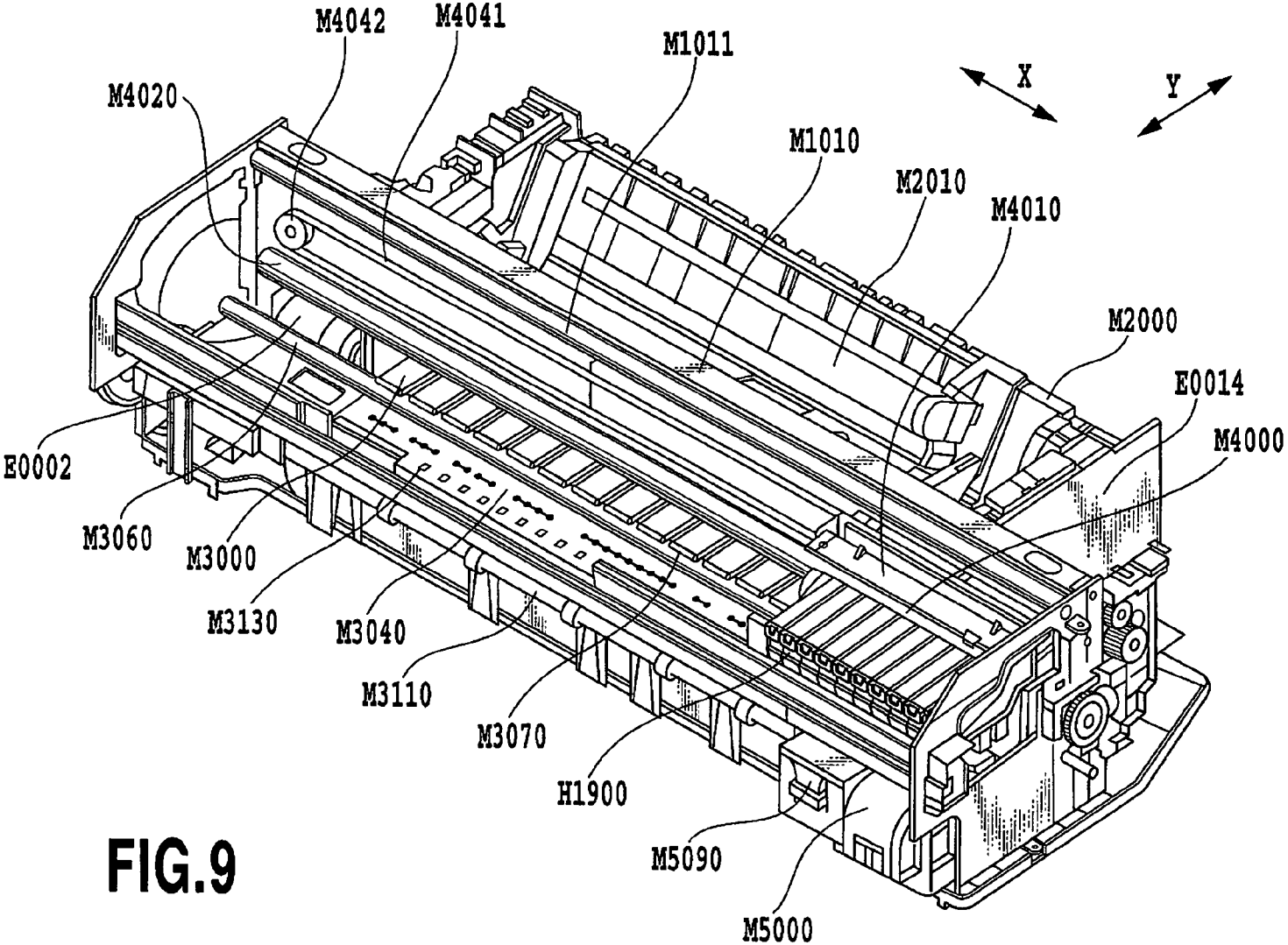
FIG. 9 is a diagram for explaining an internal mechanism of the main body of the printing apparatus used in the embodiment, and is a perspective view showing the printing apparatus when viewed from the right above.
Figure 10:
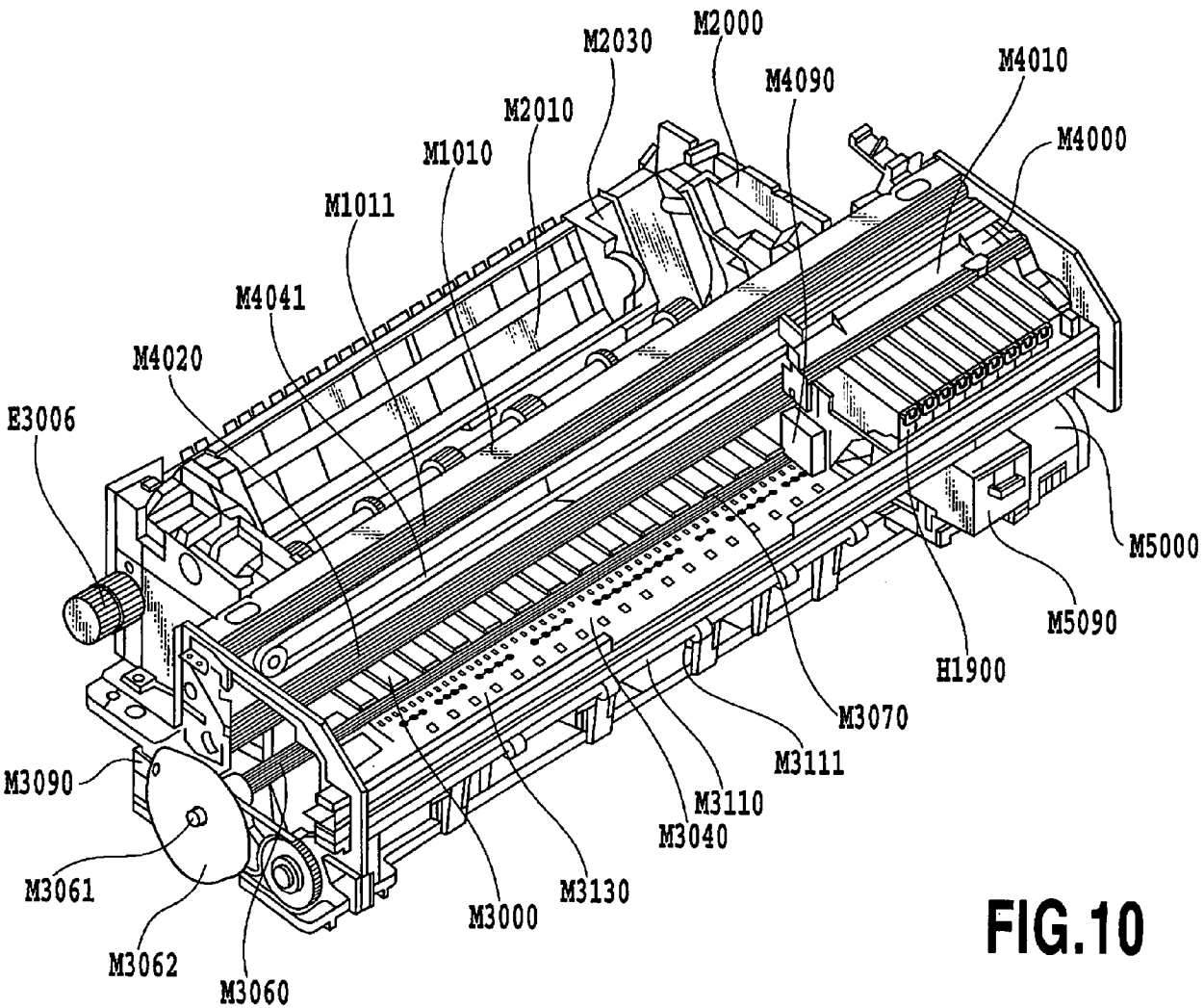
FIG. 10 is another diagram for explaining the internal mechanism of the main body of the printing apparatus used in the embodiment, and is another perspective view showing the printing apparatus when viewed from the left above.
Figure 11:
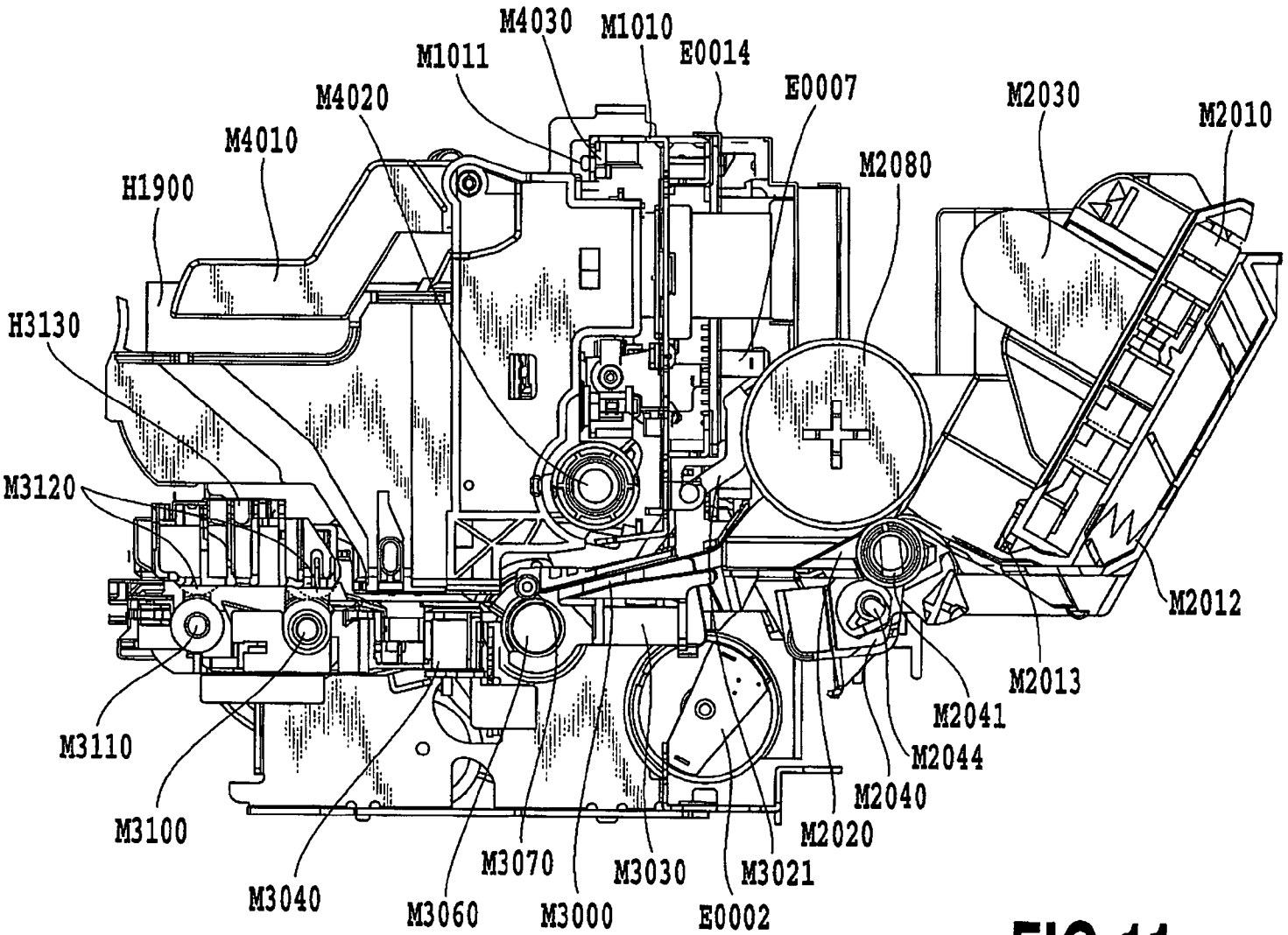
FIG. 11 is a side, cross-sectional view of the main body of the printing apparatus used in the embodiment for the purpose of explaining the internal mechanism of the main body of the printing apparatus.
Figure 12:
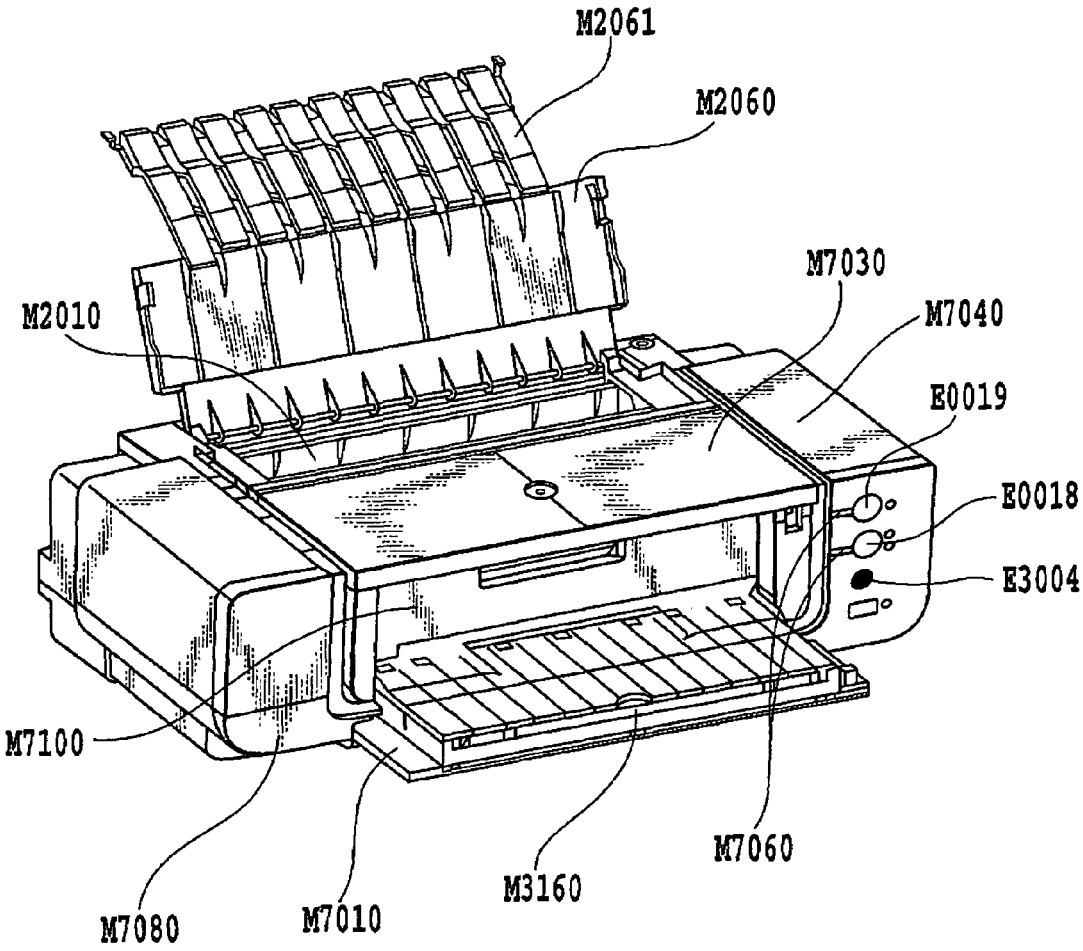
FIG. 12 is yet another perspective view of the printing apparatus used in the embodiment, and shows the printing apparatus in the process of performing a flat-pass printing operation when viewed from the front.
Figure 13:
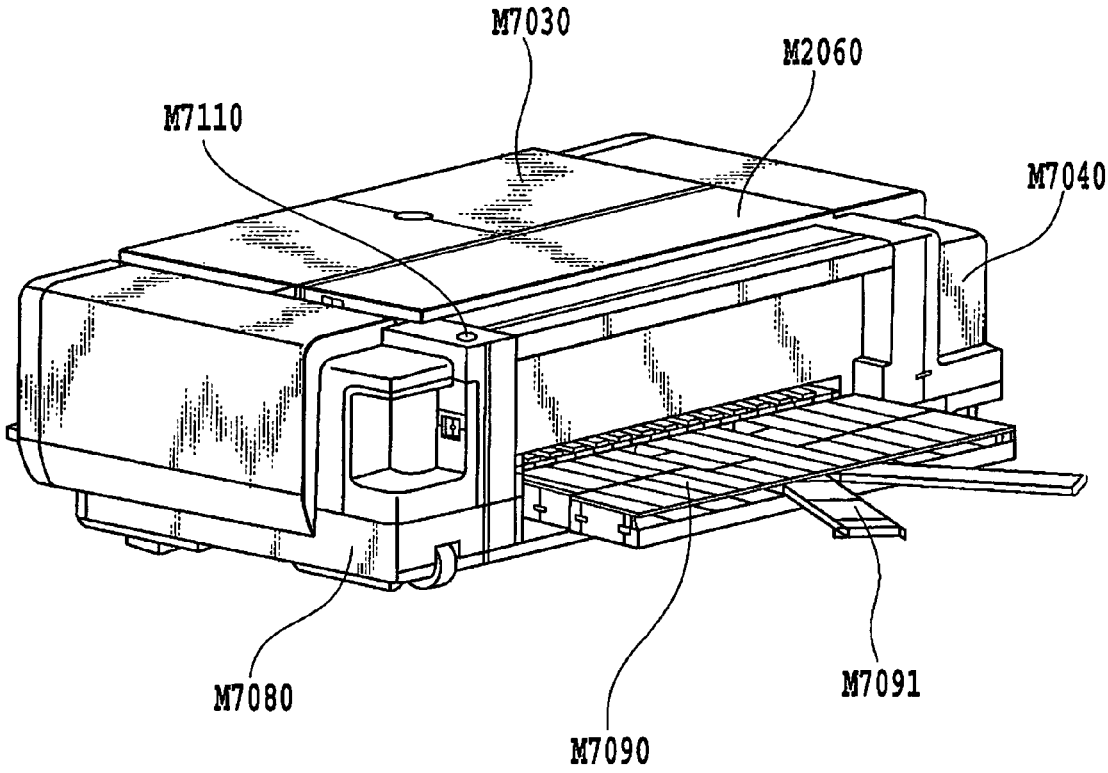
FIG. 13 is still another perspective view of the printing apparatus used in the embodiment, and shows the printing apparatus in the process of performing the flat-pass printing operation when viewed from the back.
Figure 14:
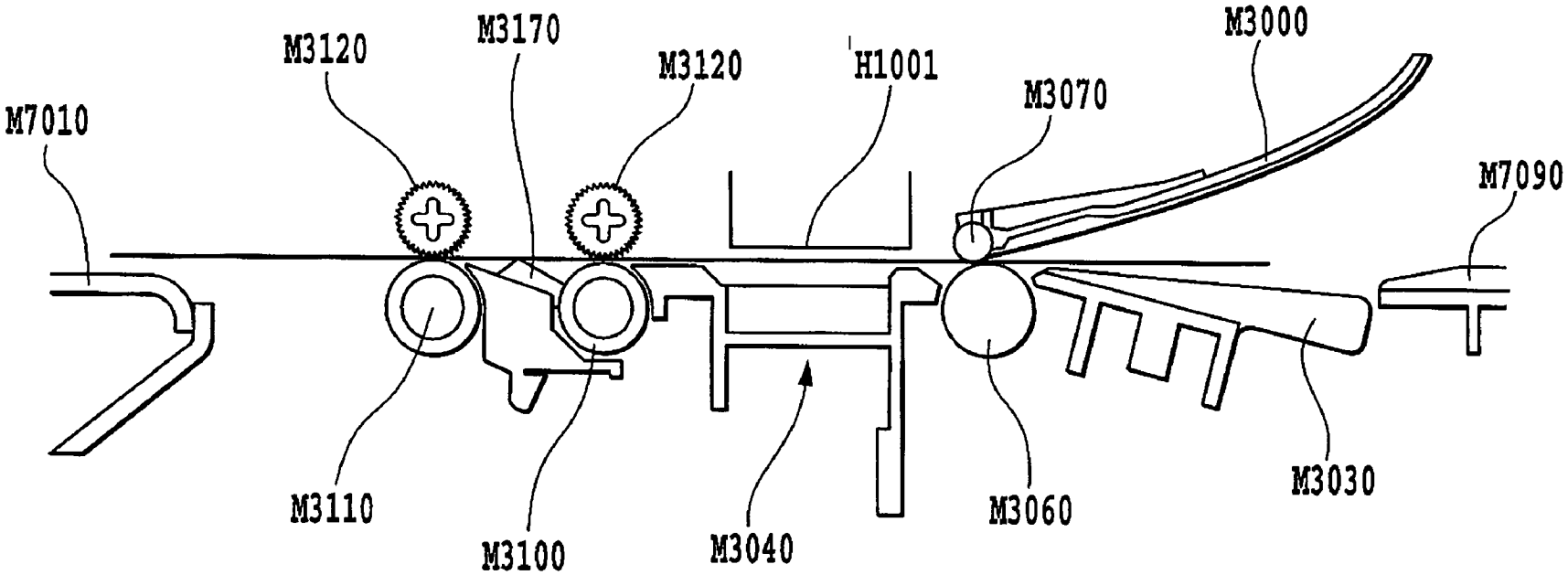
FIG. 14 is a schematic, side, cross-sectional view of the internal mechanism for explaining the flat-pass printing operation performed in the embodiment.
Figure 15:
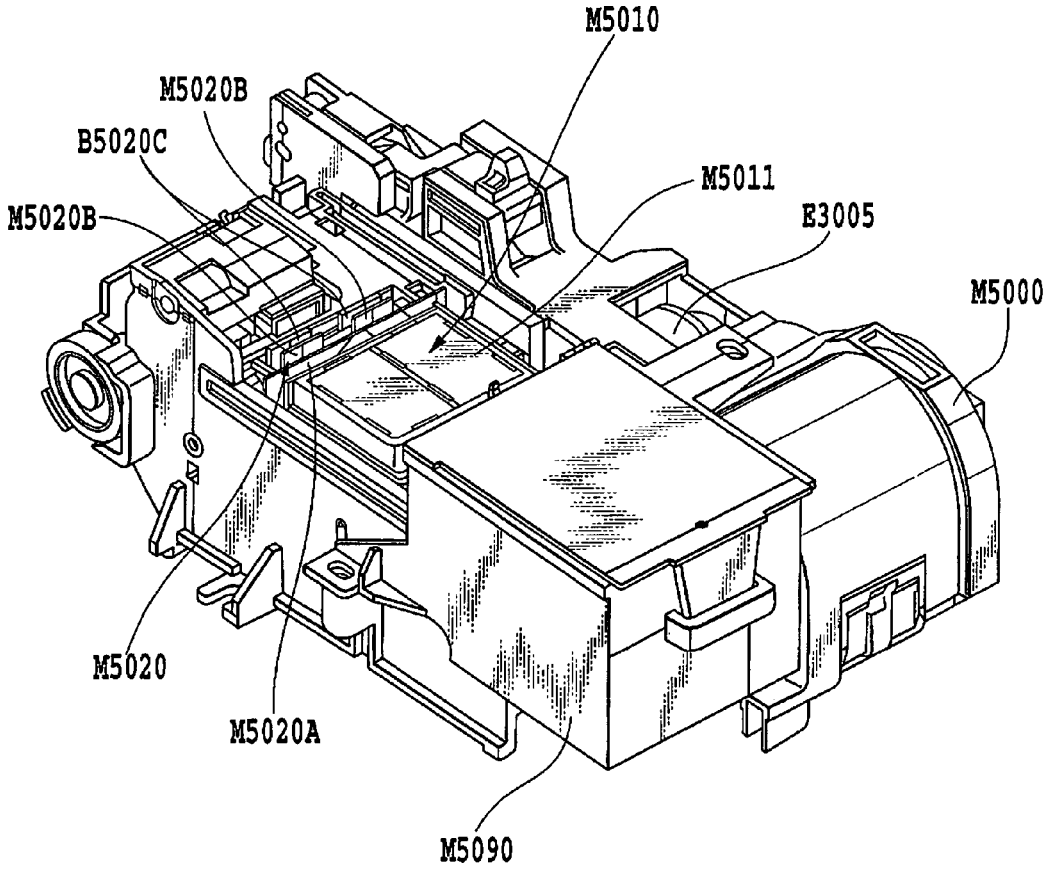
FIG. 15 is a perspective view showing a cleaning section in the main body of the printing apparatus used in the embodiment.
Figure 16:
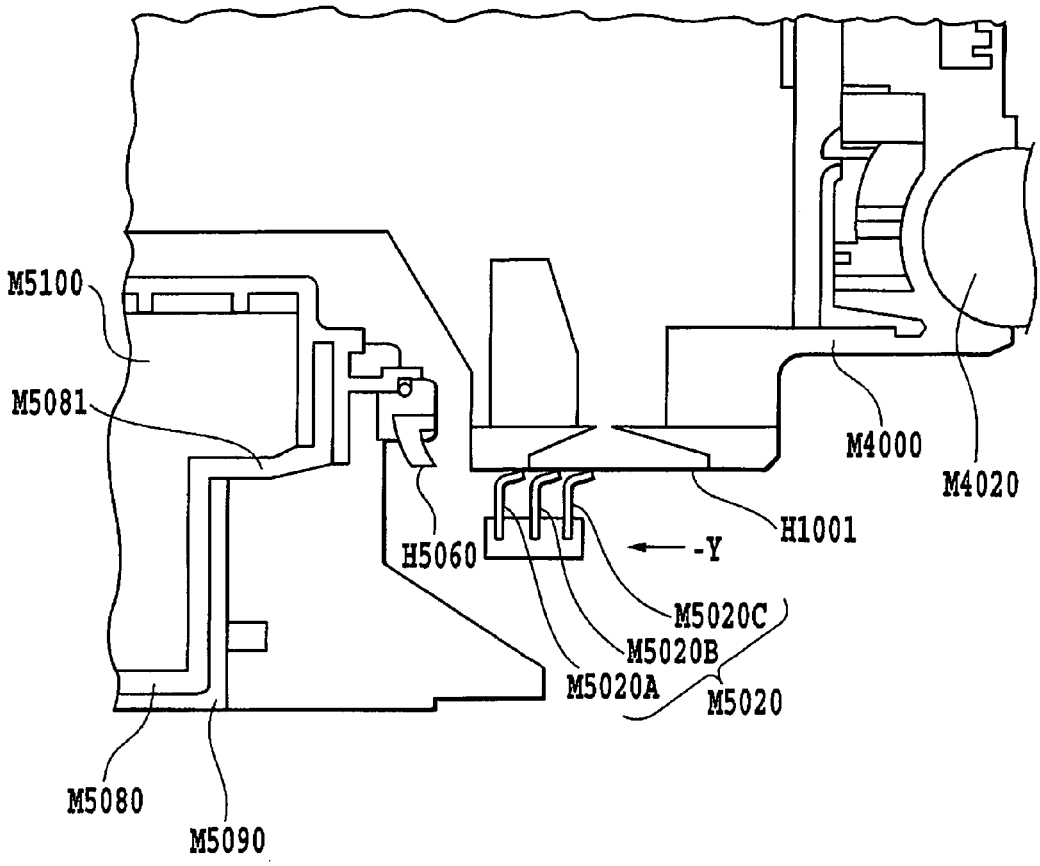
FIG. 16 is a cross-sectional view of a wiper portion in the cleaning section shown in FIG. 15 for explaining a configuration and an operation of the wiper portion.
Figure 17:
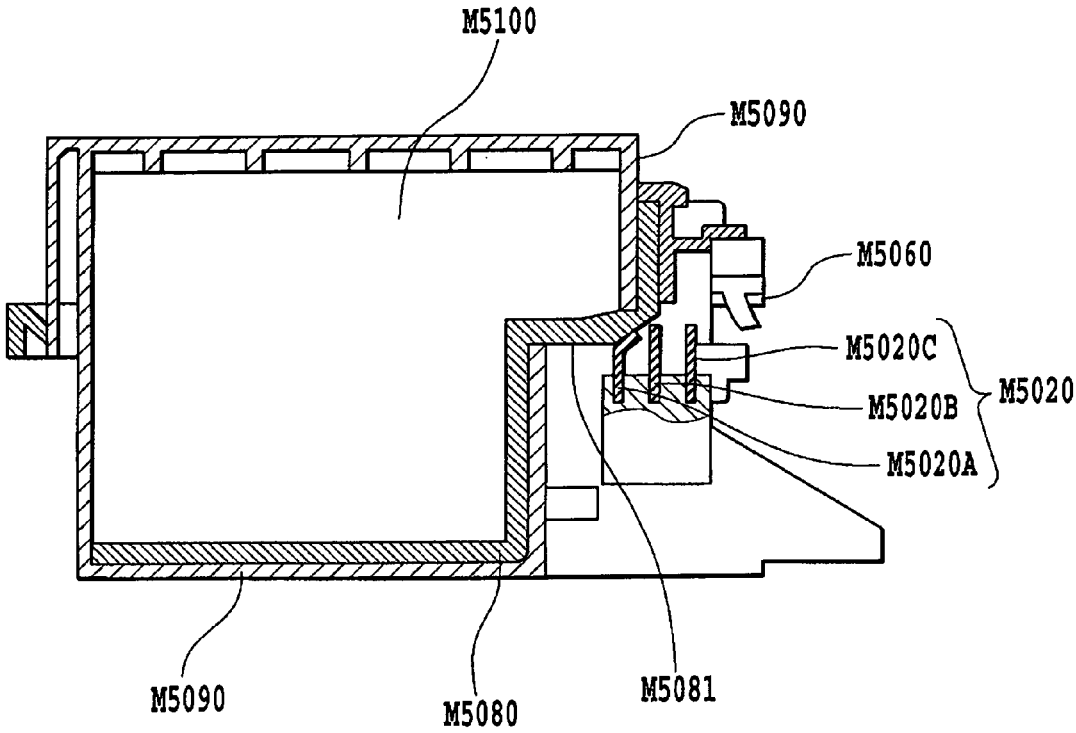
FIG. 17 is a cross-sectional view of a wetting liquid transferring unit in the cleaning section for explaining a configuration and an operation of the wetting liquid transferring unit.

FIGS. 6, 7, 8, 12 and 13 are perspective views respectively showing appearances of the printing apparatus to which this embodiment is applied. FIG. 6 shows the printing apparatus in an unused condition when viewed from the front. FIG. 7 shows the printing apparatus in an unused condition when viewed from the back. FIG. 8 shows the printing apparatus in a used condition when viewed from the front. FIG. 12 shows the printing apparatus during flat-pass printing when viewed from the front. FIG. 13 shows the printing apparatus during flat-pass printing when viewed from the back. In addition, FIGS. 9 to 11 and 14 to 16 are diagrams for describing internal mechanisms in the main body of the printing apparatus. In this respect, FIG. 9 is a perspective view showing the printing apparatus when viewed from the right above. FIG. 10 is a perspective view showing the printing apparatus when viewed from the left above. FIG. 11 is a side, cross-sectional view of the main body of the printing apparatus. FIG. 14 is a cross-sectional view of the printing apparatus during flat-pass printing. FIG. 15 is a perspective view of the cleaning section. FIG. 16 is a cross-sectional view for describing a configuration and an operation of a wiping mechanism in the cleaning section. FIG. 17 is a cross-sectional view of a wetting liquid transferring unit in the cleaning section.

Descriptions will be provided for each of the sections by referring to these figures whenever deemed necessary.

(A) Outer Case (Refer to FIGS. 6 and 7)

The outer case is attached to the main body of the printing apparatus in order to cover the paper feeding section, the paper conveying section, the paper discharging section, the carriage section, the cleaning section, the flat-pass section and the wetting liquid transferring unit. The outer case is configured chiefly of a lower case M7080, an upper case M7040, an access cover M7030, a connector cover, and a front cover M7010.

Paper discharging tray rails (not illustrated) are provided under the lower case M7080, and thus the lower case M7080 has a configuration in which a divided paper discharging tray M3160 is capable of being contained therein. In addition, the front cover M7010 is configured to close the paper discharging port while the printing apparatus is not used.

An access cover M7030 is attached to the upper case M7040, and is configured to be turnable. A part of the top surface of the upper case has an opening portion. The printing apparatus has a configuration in which each of ink tanks H1900 or the printing head H1001 (refer to FIG. 21) is replaced with a new one in this position. Incidentally, in the printing apparatus of this embodiment, the printing head H1001 has a configuration in which a plurality of ejecting portions are formed integrally into one unit. The plurality of ejecting portions corresponding respectively to a plurality of mutually different colors, and each of the plurality of ejecting portions is capable of ejecting an ink of one color. In addition, the printing head is configured as a printing head cartridge H1000 which the ink tanks H1900 are capable of being attached to, and detached from, independently of one another depending on the respective colors. The upper case M7040 is provided with a door switch lever (not illustrated), LED guides M7060, a power supply key E0018, a resume key E0019, a flat-pass key E3004 and the like. The door switch lever detects whether the access cover M7030 is opened or closed. Each of the LED guides M7060 transmits, and displays, light from the respective LEDs. Furthermore, a multi-stage paper feeding tray M2060 is turnably attached to the upper case M7040. While the paper feeding section is not used, the paper feeding tray M2060 is contained within the upper case M7040. Thus, the upper case M7040 is configured to function as a cover for the paper feeding section.

The upper case M7040 and the lower case M7040 are attached to each other by elastic fitting claws. A part provided with a connector portion therebetween is covered with a connector cover (not illustrated).

(B) Paper Feeding Section (Refer to FIGS. 8 and 11)

As shown in FIGS. 8 and 11, the paper feeding section is configured as follows. A pressure plate M2010, a paper feeding roller M2080, a separation roller M2041, a return lever M2020 and the like are attached to a base M2000. The pressure plate M2010 is that on which printing media are stacked. The paper feeding roller M2080 feeds the printing media sheet by sheet. The separation roller M2041 separates a printing medium. The return lever M2020 is used for returning the printing medium to a stacking position.

(C) Paper Conveying Section (Refer to FIGS. 8 to 11)

A conveying roller M3060 for conveying a printing medium is rotatably attached to a chassis M1010 made of an upwardly bent plate. The conveying roller M3060 has a configuration in which the surface of a metal shaft is coated with ceramic fine particles. The conveying roller M3060 is attached to the chassis M1010 in a state in which metallic parts respectively of the two ends of the shaft are received by bearings (not illustrated). The conveying roller M3060 is provided with a roller tension spring (not illustrated). The roller tension spring pushes the conveying roller M3060, and thereby applies an appropriate amount of load to the conveying roller M3060 while the conveying roller M3060 is rotating. Accordingly, the conveying roller M3060 is capable of conveying printing medium stably.

The conveying roller M3060 is provided with a plurality of pinch rollers M3070 in a way that the plurality of pinch rollers M3070 abut on the conveying roller M3060. The plurality of pinch rollers M3070 are driven by the conveying roller M3060. The pinch rollers M3070 are held by a pinch roller holder M3000. The pinch rollers M3070 are pushed respectively by pinch roller springs (not illustrated), and thus are brought into contact with the conveying roller M3060 with the pressure. This generates a force for conveying printing medium. At this time, since the rotation shaft of the pinch roller holder M3000 is attached to the bearings of the chassis M1010, the rotation shaft rotates thereabout.

A paper guide flapper M3030 and a platen M3040 are disposed in an inlet to which a printing medium is conveyed. The paper guide flapper M3030 and the platen M3040 guide the printing medium. In addition, the pinch roller holder M3000 is provided with a PE sensor lever M3021. The PE sensor lever M3021 transmits a result of detecting the front end or the rear end of each of the printing medium to a paper end sensor (hereinafter referred to as a "PE sensor") E0007 fixed to the chassis M1010. The platen M3040 is attached to the chassis M1010, and is positioned thereto. The paper guide flapper M3030 is capable of rotating about a bearing unit (not illustrated), and is positioned to the chassis M1010 by abutting on the chassis M1010.

The printing head H1001 (refer to FIG. 21) is provided at a side downstream in a direction in which the conveying roller M3060 conveys the printing medium.

Descriptions will be provided for a process of conveying printing medium in the printing apparatus with the foregoing configuration. A printing medium sent to the paper conveying section is guided by the pinch roller holder M3000 and the paper guide flapper M3030, and thus is sent to a pair of rollers which are the conveying roller 3060 and the pinch roller M3070. At this time, the PE sensor lever M3021 detects an edge of the printing medium. Thereby, a position in which a print is made on the printing medium is obtained. The pair of rollers which are the conveying roller M3060 and the pinch roller M3070 are driven by an LF motor E0002, and are rotated. This rotation causes the printing medium to be conveyed over the platen M3040. A rib is formed in the platen M3040, and the rib serves as a conveyance datum surface. A gap between the printing head H1001 and the surface of the printing medium is controlled by this rib. Simultaneously, the rib also suppresses flapping of the printing medium in cooperation with the paper discharging section which will be described later.

A driving force with which the conveying roller M3060 rotates is obtained by transmitting a torque of the LF motor E0002 consisting, for example, of a DC motor to a pulley M3061 disposed on the shaft of the conveying roller M3060 through a timing belt (not illustrated). A code wheel M3062 for detecting an amount of conveyance performed by the conveying roller M3060 is provided on the shaft of the conveying roller M3060. In addition, an encode sensor M3090 for reading a marking formed in the code wheel M3062 is disposed in the chassis M1010 adjacent to the code wheel M3062. Incidentally, the marking formed in the code wheel M3062 is assumed to be formed at a pitch of 150 to 300 lpi (line/inch) (an example value).

(D) Paper Discharging Section (Refer to FIGS. 8 to 11)

The paper discharging section is configured of a first paper discharging roller M3100, a second paper discharging roller M3110, a plurality of spurs M3120 and a gear train.

The first paper discharging roller M3100 is configured of a plurality of rubber portions provided around the metal shaft thereof. The first paper discharging roller M3100 is driven by transmitting the driving force of the conveying roller M3060 to the first paper discharging roller M3100 through an idler gear.

The second paper discharging roller M3110 is configured of a plurality of elastic elements M3111, which are made of elastomer, attached to the resin-made shaft thereof. The second paper discharging roller M3110 is driven by transmitting the driving force of the first paper discharging roller M3100 to the second paper discharging roller M3110 through an idler gear.

Each of the spurs M3120 is formed by integrating a circular thin plate and a resin part into one unit. A plurality of convex portions are provided to the circumference of each of the spurs M3120. Each of the spurs M3120 is made, for example, of SUS. The plurality of spurs M3120 are attached to a spur holder M3130. This attachment is performed by use of a spur spring obtained by forming a coiled spring in the form of a stick. Simultaneously, a spring force of the spur spring causes the spurs M3120 to abut respectively on the paper discharging rollers M3100 and M3110 at predetermined pressures. This configuration enables the spurs 3120 to rotate to follow the two paper discharging rollers M3100 and M3110. Some of the spurs M3120 are provided at the same positions as corresponding ones of the rubber portions of the first paper discharging roller M3110 are disposed, or at the same positions as corresponding ones of the elastic elements M3111 are disposed. These spurs chiefly generates a force for conveying printing medium. In addition, others of the spurs M3120 are provided at positions where none of the rubber portions and the elastic elements M3111 is provided. These spurs M3120 chiefly suppresses lift of a printing medium while a print is being made on the printing medium.

Furthermore, the gear train transmits the driving force of the conveying roller M3060 to the paper discharging rollers M3100 and M3110.

With the foregoing configuration, a printing medium on which an image is formed is pinched with nips between the first paper discharging roller M3110 and the spurs M3120, and thus is conveyed. Accordingly, the printing medium is delivered to the paper discharging tray M3160. The paper discharging tray M3160 is divided into a plurality of parts, and has a configuration in which the paper discharging tray M3160 is capable of being contained under the lower case M7080 which will be described later. When used, the paper discharging tray M3160 is drawn out from under the lower case M7080. In addition, the paper discharging tray M3160 is designed to be elevated toward the front end thereof, and is also designed so that the two side ends thereof are held at a higher position. The design enhances the stackability of printing media, and prevents the printing surface of each of the printing media from being rubbed.

(E) Carriage Section (Refer to FIGS. 9 to 11)

The carriage section includes a carriage M4000 to which the printing head H1001 is attached. The carriage M4000 is supported with a guide shaft M4020 and a guide rail M1011. The guide shaft M4020 is attached to the chassis M1010, and guides and supports the carriage M4000 so as to cause the carriage M4000 to perform reciprocating scan in a direction perpendicular to a direction in which a printing medium is conveyed. The guide rail M1011 is formed in a way that the guide rail M1011 and the chassis M1010 are integrated into one unit. The guide rail M1011 holds the rear end of the carriage M4000, and thus maintains the space between the printing head H1001 and the printing medium. A slide sheet M4030 formed of a thin plate made of stainless steel or the like is stretched on a side of the guide rail M1011, on which side the carriage M4000 slides. This makes it possible to reduce sliding noises of the printing apparatus.

The carriage M4000 is driven by a carriage motor E0001 through a timing belt M4041. The carriage motor E0001 is attached to the chassis M1010. In addition, the timing belt M4041 is stretched and supported by an idle pulley M4042. Furthermore, the timing belt M4041 is connected to the carriage M4000 through a carriage damper made of rubber. Thus, image unevenness is reduced by damping the vibration of the carriage motor E0001 and the like.

An encoder scale E0005 for detecting the position of the carriage M4000 is provided in parallel with the timing belt M4041 (the encoder scale E0005 will be described later by referring to FIG. 18). Markings are formed on the encoder scale E0005 at pitches in a range of 150 lpi to 300 lpi. An encoder sensor E0004 for reading the markings is provided on a carriage board E0013 installed in the carriage M4000 (the encoder sensor E0004 and the carriage board E0013 will be described later by referring to FIG. 18). Ahead contact E0101 for electrically connecting the carriage board E0013 to the printing head H1001 is also provided to the carriage board E0013. Moreover, a flexible cable E0012 (not illustrated) is connected to the carriage M4000 (the flexible cable E0012 will be described later by referring to FIG. 18). The flexible cable E0012 is that through which a drive signal is transmitted from an electric substrate E0014 to the printing head H1001.

As for components for fixing the printing head H1001 to the carriage M4000, the following components are provided to the carriage M4000. An abutting part (not illustrated) and pressing means (not illustrated) are provided on the carriage M4000. The abutting part is with which the printing head H1001 positioned to the carriage M4000 while pushing the printing head H1001 against the carriage M4000. The pressing means is with which the printing head H1001 is fixed at a predetermined position. The pressing means is mounted on a headset lever M4010. The pressing means is configured to act on the printing head H1001 when the headset lever M4010 is turned about the rotation support thereof in a case where the printing head H1001 is intended to be set up.

Moreover, a position detection sensor M4090 including a reflection-type optical sensor is attached to the carriage M4000. The position detection sensor is used while a print is being made on a special medium such as a CD-R, or when a print result or the position of an edge of a sheet of paper is being detected. The position detection sensor M4090 is capable of detecting the current position of the carriage M4000 by causing a light emitting device to emit light and by thus receiving the emitted light after reflecting off the carriage M4000.

In a case where an image is formed on a printing medium in the printing apparatus, the set of the conveying roller M3060 and the pinch rollers M3070 transfers the printing medium, and thereby the printing medium is positioned in terms of a position in a column direction. In terms of a position in a row direction, by using the carriage motor E0001 to move the carriage M4000 in a direction perpendicular to the direction in which the printing medium is conveyed, the printing head H1001 is located at a target position where an image is formed. The printing head H1001 thus positioned ejects inks onto the printing medium in accordance with a signal transmitted from the electric substrate E0014. Descriptions will be provided later for details of the configuration of the printing head H1001 and a printing system. The printing apparatus of this embodiment alternately repeats a printing main scan and a sub-scan. During the printing main scan, the carriage M4000 scans in the row direction while the printing head H1001 is making a print. During the sub-scan, the printing medium is conveyed in the column direction by conveying roller M3060. Thereby, the printing apparatus is configured to form an image on the printing medium.

(F) Flat-Pass Printing Section (Refer to FIGS. 12 to 14)

A printing medium is fed from the paper feed section in a state where the printing medium is bent, because the passage through which the printing medium passes continues curving up to the pinch rollers as shown in FIG. 11. For this reason, if a thicker printing medium with a thickness of approximately 0.5 mm or more, for example, is attempted to be fed from the paper feeding section, a reaction force of the bent printing medium occurs, and thus resistance to the paper feeding increases. As a result, it is likely that the printing medium cannot be fed. Otherwise, even if the printing medium can be fed, the delivered printing medium remains bent, or is folded.

A flat-pass print is made on printing media, such as thicker printing media, which a user does not wish to fold, and on printing media, such as CD-Rs, which cannot be bent.

Types of flat-pass prints include a type of print made by manually supplying a printing medium from a slit-shaped opening portion (under a paper feeding unit) in the back of the main body of a printing apparatus, and by thus causing pinch rollers of the main body to nip the printing medium. However, the flat-pass print of this embodiment employs the following mode. A printing medium is fed from the paper discharging port located in the front side of the main body of the printing apparatus to a position where a print is going to be made, and the print is made on the printing medium by switching back the printing medium.

The front cover M7010 is usually located below the paper discharging section, because the front cover M7010 is also used as a tray in which several tens of printing media on which prints have been made are stacked (refer to FIG. 8). When a flat-pass print is going to be made, the front tray M7010 is elevated up to a position where the paper discharging port is located (refer to FIG. 12) for the purpose of supplying a printing medium from the paper discharging port horizontally in a direction reverse to the direction in which a printing medium is usually conveyed. Hooks and the like (not illustrated) are provided to the front cover M7010. Thus, the front cover M7010 is capable of being fixed to a position where the printing medium is supplied for the purpose of the flat-pass print. It can be detected by a sensor whether or not the front cover M7010 is located at the position where the printing medium is supplied for the purpose of the flat-pass print. Depending on this detection, it can be determined whether the printing apparatus is in a flat-pass printing mode.

In the case of the flat-pass printing mode, first of all, a flat-pass key E3004 is operated for the purpose of placing a printing medium on the front tray M7010 and inserting the printing medium from the paper discharging port. Thereby, a mechanism (not illustrated) lifts the spur holder M3130 and the pinch roller holder M3000 respectively up to positions higher than a presumed thickness of the printing medium. In addition, in a case where the carriage M4000 exists in an area through which the printing medium is going to pass, a lifting mechanism (not illustrated) lifts the carriage M4000 up. This makes it easy to insert the printing medium therein. Moreover, by pressing a rear tray button M7110, a rear tray M7090 can be opened. Furthermore, a rear sub-tray M7091 can be opened in the form of the letter V (refer to FIG. 13). The rear tray M7090 and the rear sub-tray M7091 are trays with which a long printing medium is supported in the back of the main body of the printing apparatus. This is because, if the long printing medium is inserted from the front of the main body of the printing apparatus, the long printing medium juts out of the back of the main body of the printing apparatus. If a thicker printing medium is not kept flat while a print is being made on the thicker printing medium, the thicker printing medium may be rubbed against the head ejection face, or the conveyance load may change. This is likely to adversely affect the print quality. For this reason, the disposition of these trays is effective. However, if a printing medium is not long enough to jut out of the back of the main body of the printing apparatus, the rear tray M7090 and the like need not be opened.

In the foregoing manner, a printing medium can be inserted from the paper discharging port to the inside of the main body of the printing apparatus. A printing medium is positioned on the front tray M7010 by aligning the rear edge (an edge at the side located closest to a user) and the right edge of the printing medium to a position in the front tray M7010 where a marker is formed.

At this time, if the flat-pass key E3004 is operated once again, the spur holder M3130 comes down, and thus the paper discharging rollers M3100, M3110 and the spurs M3120 jointly nip the printing medium. Thereafter, the paper discharging rollers M3100 and M3110 draw the printing medium into the main body of the printing apparatus by a predetermined amount thereof (in a direction reverse to the direction in which the printing medium is conveyed during normal printing). Because the edge at the side closest to the user(the rear edge) of a printing medium is aligned to the marker when the printing medium is set up at the beginning, it is likely that the front edge (the edge located farthest from a user) of the printing medium may not reach the conveying roller M3060, if the printing medium is shorter. With this taken into consideration, the predetermined amount is defined as a distance between the rear edge of a printing medium with the presumably shortest length and the conveying roller M3060. Once a printing medium is transferred by the predetermined amount, the rear edge of the printing medium reaches the conveying roller M3060. Thus, the pinch roller holder M3000 is lowered at the position, and the conveying roller M3060 and the pinch rollers M3070 are caused to nip the printing medium. Subsequently, the printing medium is further transferred so that the rear edge of the printing medium is nipped by the conveying roller M3060 and the pinch rollers M3070. Thereby, the supplying of the printing medium for the purpose of the flat-pass print is completed (at a position where the printing medium waits for a print to be made thereon).

A nip force with which the paper discharging roller M3100 and M3110 as well as the spurs M3120 nip a printing medium is set relatively weak lest the force should adversely affect image formation while the printing medium is being delivered during a normal print. For this reason, in the case where a flat-pass print is going to be made, it is likely that the position of the printing medium shifts before the print starts. In this embodiment, however, a printing medium is nipped by the conveying roller M3060 and the pinch rollers M3070 which have a relatively stronger nip force. This secures a position where a printing medium should be set. In addition, while a printing medium is being conveyed into the inside of the main body by the predetermined amount, a flat-pass paper detection sensor lever (hereinafter referred to as an "FPPE sensor lever") M3170 blocks or forms a light path of an FPPE sensor E9001 which is an infrared-ray sensor, and which is not illustrated here. Thereby, the position of the rear edge (the position of the front edge during the print) of the printing medium can be detected. Incidentally, the FPPE sensor lever may be rotatably provided between the platen M3040 and the spur holder M3130.

Once a printing medium is set at the position where the printing medium waits for a print to be made thereon, a print command is executed. Specifically, the conveying roller M3060 conveys the printing medium to a position where the printing head H1001 is going to make a print on the printing medium. Thereafter, the print is made in the same manner as a normal printing operation is performed. After the print, the printing medium is discharged to the front tray M7010.

In a case where the flat-pass print is intended to be made successively, the printing medium on which the print has been made is removed from the front tray M7010, and the next printing medium is set thereon. After that, it is sufficient that the foregoing processes are repeated. Specifically, the subsequent print starts with the setting of a printing medium after the spur holder M3130 and the pinch roller holder M3000 are lifted up by pressing the flat-pass key E3004.

On the other hand, in a case where the flat-pass print is intended to be completed, the printing apparatus is returned to the normal printing mode by returning the front tray M7010 to the normal print position.

(G) Cleaning Section (Refer to FIGS. 15 and 16)

The cleaning section is a mechanism for cleaning the printing head H1001. The cleaning section is configured of a pump M5000, caps M5010, a wiper portion M5020 and the like. The caps M5010 are those which prevent the printing head H1001 from being dried out. The wiper portion M5020 is used for cleaning the surface of the printing head H1001 on which the ejection openings are formed.

Figure 18:
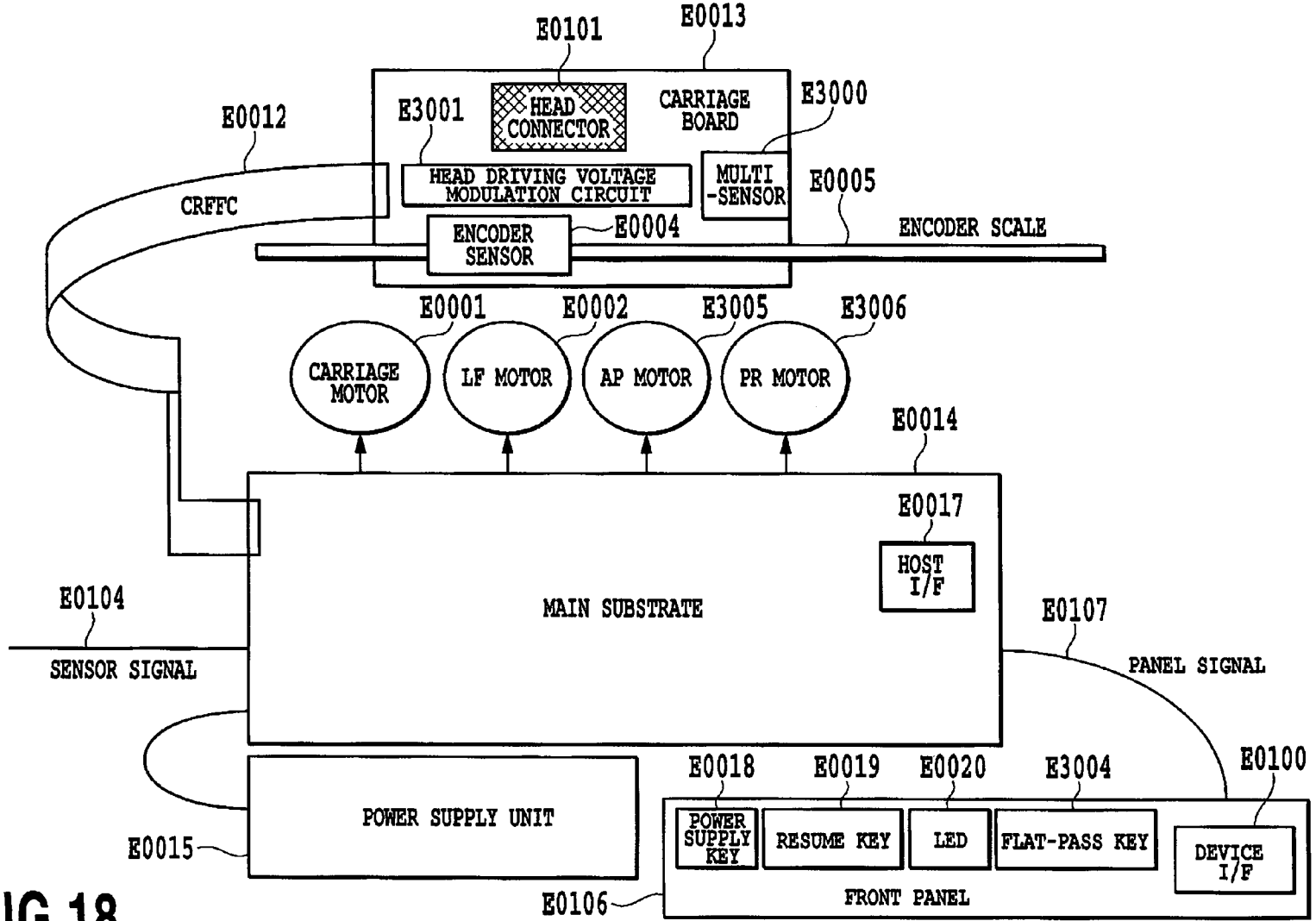
FIG. 18 is a block diagram schematically showing the entire configuration of an electrical circuit in the embodiment of the present invention.

In the case of this embodiment, a chief driving force of the cleaning section is transmitted from an AP motor E3005 (see FIG. 18). The pump M5000 is designed to be operated by rotation in one direction which is generated by means of a one-way clutch (not illustrated). The wiper portion M5020 and the caps M5010 are designed to ascend and descend by rotation in the other direction which is generated by the one-way clutch Incidentally, the AP motor E3005 is also used as a driving power supply for an operation of feeding printing medium, but a motor specialized for operating the cleaning section may be provided to the cleaning section instead.

The motor E0003 drives the caps M5010 so as for the caps M5010 to be capable of ascending and descending by means of an ascending/descending mechanism (not illustrated). When the caps M5010 go up to an ascending position, the caps M5010 cap each of the ejection faces of several ejecting portions provided to the printing head H1001. While no print operation is being performed, the caps M5010 can protect the printing head H1001. Otherwise, the caps M5010 can recover the printing head H1001 by suction. While a print operation is being performed, the caps M5010 can be placed in a descending position which prevents the caps M5010 from interfering with the printing head H1001. In addition, by opposing the caps M5010 to the ejection face, the caps M5010 are capable of receiving preliminary ejections. In a case where, for instance, the printing head H1001 is provided with ten ejecting portions, two caps M5010 are provided to the cleaning section in the illustrated example so that the ejection face corresponding to each five ejecting portions can be capped collectively by corresponding one of the two caps M5010.

A wiper portion M5020 made of an elastic member such as rubber is fixed to a wiper holder (not illustrated). The wiper holder is capable of moving in directions indicated by −Y and +Y in FIG. 16 (−Y and +Y are directions in which the ejection openings in the ejecting portions are arranged). When the printing head H1001 gets to the home position, the wiper holder moves in the direction indicated by an arrow −Y. Thereby, a surface of the printing head H1001 can be wiped. Once the wiping operation is completed, the carriage is caused to escape out of the range where the wiping operation is designed to be performed, and thus the wiper is returned to a position which prevents the wiper from interfering with the ejection face and the like. Incidentally, the wiper portion M5020 of this example is provided with a wiper blade M5020A for wiping the entire surface of the printing head H1001 including all of the ejection faces of the ejecting portions. In addition, the wiper portion M5020 is provided with the other two wiper blades M5020B and M5020C. The wiper blade M5020B wipes vicinities of nozzles for ejection faces of five of the ten ejecting portions, whereas the wiper blade M5020C wipes vicinities of nozzles for ejection faces of the other five of the ten ejecting portions.

After wiping, the wiper portion M5020 abuts on a blade cleaner M5060. Thereby, the wiper blades M5020A to M5020C are configured to be cleaned of inks and the like which have been adhered to themselves. In addition, the wiper portion M5020 has the following configuration (a wetting liquid transferring unit). A wetting liquid is transferred onto the wiper blades M5020A to M5020C before wiping. This enhances cleaning performance of the wiping operation. Descriptions will be provided later for a configuration of this wetting liquid transferring unit and the wiping operation.

The suction pump M5000 is capable of generating negative pressure in a state where an airtight space is formed inside the cap M5010 by connecting the cap M5010 to the ejection faces. Thereby, inks can be filled in the ejecting portions from the ink tanks H1900. In addition, dust, adhering matter, bubbles and the like which exist in the ejection openings and the internal ink passage leading to the ejection openings can be removed by suction.

What is used for the suction pump M5000 is, for example, a tube pump. This includes a member having a curved surface which is formed by squeezing and holding at least part of a flexible tube; a roller being capable of pressing the flexible tube towards the member; and a roller supporting part which supports the roller, and which is capable of rotating. Specifically, the roller supporting part is rotated in a predetermined direction, and thereby the roller is rolled on the member in which the curved surface has been formed, while pressing the flexible tube. In response to this, the negative pressure is generated in the airtight space formed by the cap M5010. This negative pressure sucks inks from the ejection openings, and subsequently sucks up the inks into the tube or the suction pump from the cap M5010. Thereafter, the sucked inks are further transferred to a suitable member (a waste ink absorbing member) provided inside the lower case M7080.

Note that an absorbing member M5011 is provided to the inside portion of the cap M5010 for the purpose of reducing the amount of inks remaining on the ejection faces of the printing head H1001 after the suction. In addition, consideration is made for sucking inks, which remain in the cap M5010 and the absorbing member M5011, in a state where the cap M5010 is opened, and for thus precluding the ink residue from coagulating and for accordingly preventing an adverse affect from occurring subsequently by sucking. It is desirable that no abrupt negative pressure should work on the ejection faces by providing an open-to-atmosphere valve (not illustrated) in a middle of the ink suction passage, and by thus beforehand opening the valve when the cap M5010 is intended to be detached from the ejection faces.

Furthermore, the suction pump M5000 can be operated not only for the purpose of the recovery by suction, but also for the purpose of discharging inks which have been received by the cap M5010 by the preliminary ejection operation performed in the state where the cap M5010 is opposite to the ejection faces. Specifically, when an amount of inks held in the cap M5010 after preliminary ejection reaches a predetermined amount, the inks held in the cap M5010 can be transferred to the waste ink absorbing member through the tube by operating the suction pump M5000.

The series of operations performed successively, such as the operations of the wiper portion M5020, the ascent/descent of the cap M5010 and the opening/closing of the valve, can be controlled by means of a main cam (not illustrated) provided on the output axle of the motor E0003, and a plurality of cams and arms and like which move so as to follow the main cam. Specifically, rotation of the main cam in response to a direction in which the motor E0003 rotates operates cams, arms and the like in each of the units and parts. Thereby, the predetermined operations can be performed. The position of the main cam can be detected with a position detection sensor such as a photo-interrupter.

(H) Wetting Liquid Transferring Unit (Refer to FIGS. 16 and 17)

Recently, inks containing pigment components as coloring agents (pigmented inks) are increasingly used for the purpose of enhancing the printing density, water resistance, light resistance of printed materials. Pigmented inks are produced through dispersing coloring agents themselves, which are originally solids, into water by adding dispersants thereto, or by introducing functional groups to pigment surfaces. Consequently, dried matter of pigmented inks resulting from drying the inks through evaporating moisture from the inks on the ejection faces damages the ejection faces more than dried coagulated matter of dyed inks in which the coloring agents are dissolved at molecular level. In addition, polymer compounds used for dispersing the pigments into the solvent are apt to be adsorbed to the ejection faces. This type of problem occurs in matter other than pigmented inks in a case where polymer compounds exist in the inks as a result of adding reactive liquids to the inks for the purpose of administering the viscosities of the inks, for the purpose of enhancing the light resistance of the inks, or for other purposes.

In this embodiment, a liquid is transferred onto, and adhered to, the blades of the wiper portion M5020, and thus the wiping operation is performed with the wetted blades M5020, in order to solve the foregoing problem. Thereby, the present embodiment attempts at preventing the ejection faces from deteriorating due to the pigmented inks, at reducing the abrasion of the wiper, and at removing the accumulated matter by dissolving the ink residue accumulated on the ejection faces. Such a liquid is termed as the wetting liquid from the viewpoint of its function in the description. The wiping by use of this liquid is termed as the wet wiping.

This embedment adopts a configuration in which the wetting liquid is stored inside the main body of the printing apparatus. Reference numeral M5090 denotes a wetting liquid tank. As the wetting liquid, a glycerin solution or the like is contained in the wetting liquid tank M5090. Reference numeral M5100 denotes a wetting liquid holding member, which is fibrous member or the like. The wetting liquid holding member M5100 has an adequate surface tension for the purpose of preventing the wetting liquid from leaking from the wetting liquid tank M5090. The wetting liquid holding member M5100 is impregnated with, and holds, the wetting liquid. Reference numeral M5080 denotes a wetting liquid transferring member, which is made, for example, of a porous material having an adequate capillary force. The wetting liquid transferring member M5080 includes a wetting liquid transferring part M5081 which is in contact with the wiper blade. The wetting liquid transferring member M5080 is also in contact with the wetting liquid holding member M5100 infiltrated with the wetting liquid. As a result, the wetting liquid transferring member M5080 is also infiltrated with the wetting liquid. The wetting liquid transferring member M5080 is made of the material having the capillary force which enables the wetting liquid to be supplied to the wetting liquid transferring part M5081 even if a smaller amount of wetting liquid remains Descriptions will be provided for operations of the wetting liquid transferring unit and the wiper portion.

First of all, the cap M5010 is set at the descending position, and thus is escaped to a position where the carriage M4000 does not contact the blades M5020A to M5020C, In this state, the wiper portion M5020 is moved in the −Y direction, and is caused to pass through the part of the blade cleaner M5060. Accordingly, the wiper portion M5020 is caused to abut on the wetting liquid transferring part M5081 (refer to FIG. 17). By keeping the wiper portion M5020 in contact with the wetting liquid transferring part M5081 for an adequate length of time, an adequate amount of wetting liquid is transferred onto the wiper portion M5020.

Subsequently, the wiper portion M5020 is moved in the +Y direction. The blade contacts the blade cleaner M5060 only in a part of the surface of the blade cleaner M5060, and no wetting liquid is adhered to the part. For this reason, the wetting liquid remains to be held on the blade.

The blade is returned to the position where the wiping operation has been started. Thereafter, the carriage M4000 is moved to the position where the wiping operation is designed to be performed. Subsequently, the wiper portion M5020 is moved in the −Y direction. Thereby, the ejection faces of the printing head H1001 can be wiped with the surface to which the wetting liquid is adhered.

1.3 Configuration of Electrical Circuit

Descriptions will be provided next for a configuration of an electrical circuit of this embodiment.

FIG. 18 is a block diagram for schematically describing the entire configuration of the electrical circuit in the printing apparatus J0013. The printing apparatus to which this embodiment is applied is configured chiefly of the carriage board E0013, the main substrate E0014, a power supply unit E0015, a front panel E0106 and the like.

The power supply unit E0015 is connected to the main substrate E0014, and thus supplies various types of drive power.

The carriage board E0013 is a printed circuit board unit mounted on the carriage M4000. The carriage board E0013 functions as an interface for transmitting signals to, and receiving signals from, the printing head H1001 and for supplying head driving power through the head connector E0101. The carriage board E0013 includes a head driving voltage modulation circuit E3001 with a plurality of channels to the respective ejecting portions of the printing head H1001. The plurality of ejecting portions corresponding respectively to the plurality of mutually different colors. In addition, the head driving voltage modulation circuit E3001 generates head driving power supply voltages in accordance with conditions specified by the main substrate E0014 through the flexible flat cable (CRFFC) E0012. In addition, change in a positional relationship between the encoder scale E0005 and the encoder sensor E0004 is detected on the basis of a pulse signal outputted from the encoder sensor E0004 in conjunction with the movement of the carriage M4000. Moreover, the outputted signal is supplied to the main substrate E0014 through the flexible flat cable (CRFFC) E0012.

Figure 20:
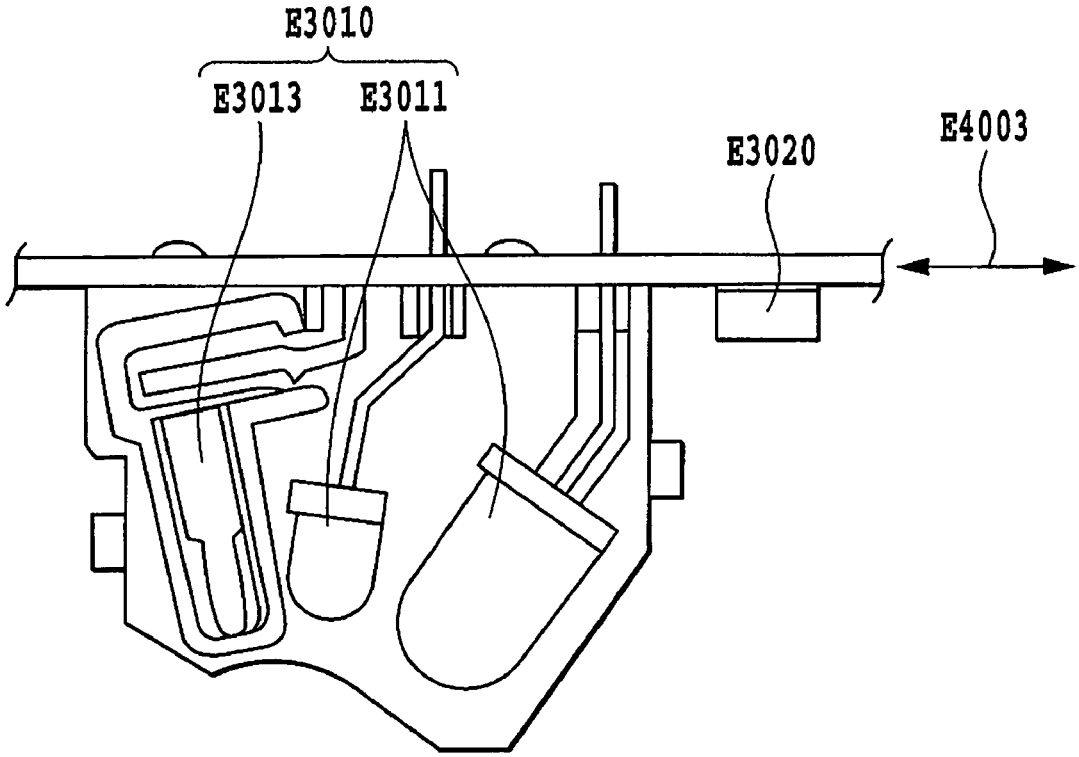
FIG. 20 is a diagram showing an example of a configuration of a multisensor system mounted on a carriage board shown in FIG. 18.

An optical sensor E3010 and a thermistor E3020 are connected to the carriage board E0013, as shown in FIG. 20. The optical sensor E3010 is configured of two light emitting devices (LEDs) E3011 and a light receiving element E3013. The thermistor E3020 is that with which an ambient temperature is detected. Hereinafter, these sensors are referred to as a multisensor system E3000. Information obtained by the multisensor system E3000 is outputted to the main substrate E00014 through the flexible flat cable (CRFFC) E0012.

The main substrate E0014 is a printed circuit board unit which drives and controls each of the sections of the ink jet printing apparatus of this embodiment. The main substrate E0014 includes a host interface (host I/F) E0017 thereon. The main substrate E0014 controls print operations on the basis of data received from the host apparatus J0012 (FIG. 1). The main substrate E0014 is connected to and controls various types of motors including the carriage motor E0001, the LF motor E0002, the AP motor E3005 and the PR motor E3006. The carriage motor E0001 is a motor serving as a driving power supply for causing the carriage M4000 to perform main scan. The LF motor E0002 is a motor serving as a driving power supply for conveying printing medium. The AP motor E3005 is a motor serving as a driving power supply for causing the printing head H1001 to perform recovery operations. The PR motor E3006 is a motor serving as a driving power supply for performing a flat-pass print operation; and the main substrate E0014 thus controls drive of each of the functions. Moreover, the main substrate E0014 is connected to sensor signals E0104 which are used for transmitting control signals to, and receiving detection signals from, the various sensors such as a PF sensor, a CR lift sensor, an LF encoder sensor, and a PG sensor for detecting operating conditions of each of the sections in the printer. The main substrate E0014 is connected to the CRFFC E0012 and the power supply unit E0015. Furthermore, the main substrate E0014 includes an interface for transmitting information to, and receiving information from a front panel E0106 through panel signals E0107.

The front panel E0106 is a unit provided to the front of the main body of the printing apparatus for the sake of convenience of user's operations. The front panel E0106 includes the resume key E0019, the LED guides M7060, the power supply key E0018, and the flat-pass key E3004 (refer to FIG. 6). The front panel E0106 further includes a device I/F E0100 which is used for connecting peripheral devices, such as a digital camera, to the printing apparatus.

Figure 19:
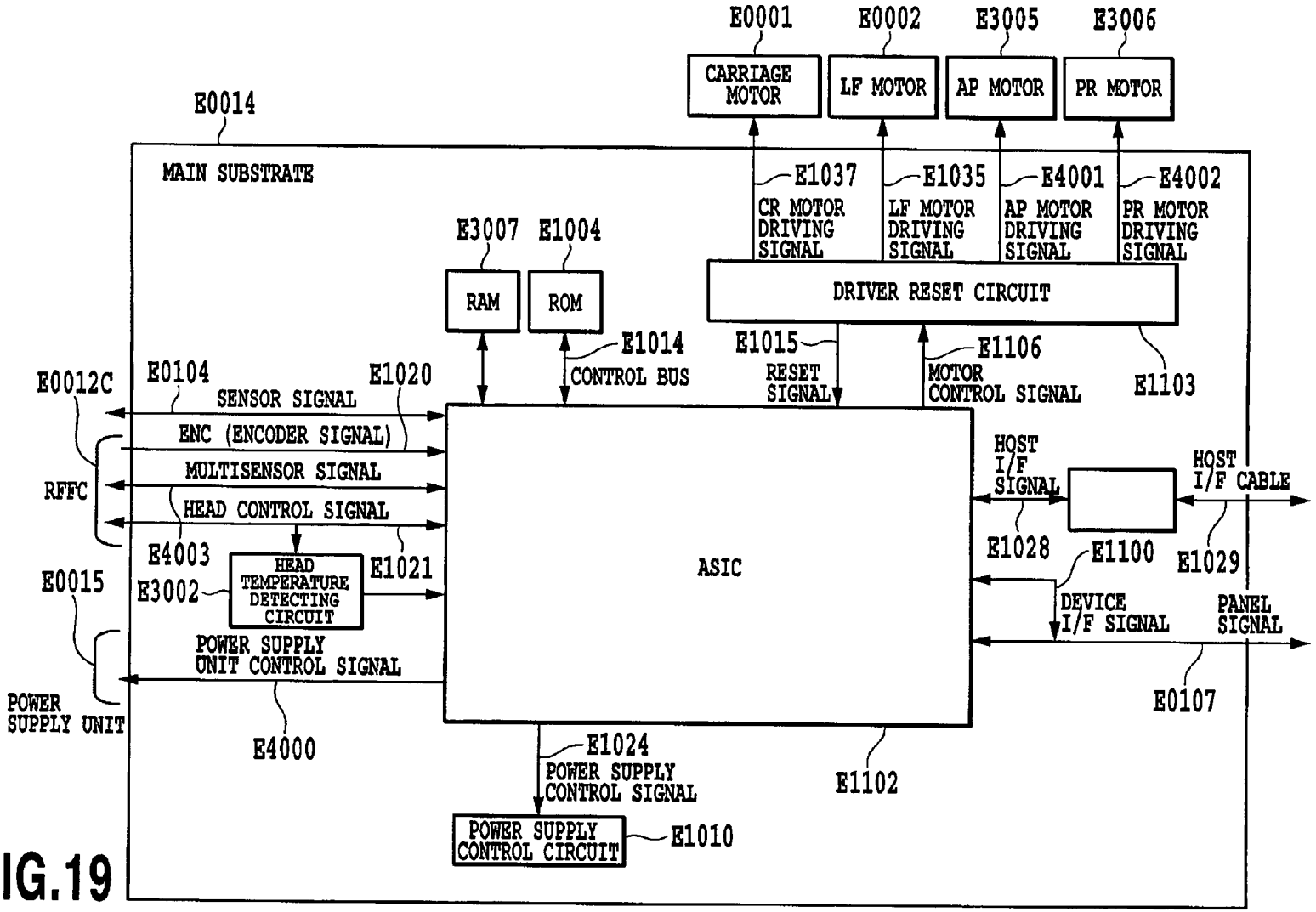
FIG. 19 is a block diagram showing an example of an internal configuration of a main substrate shown in FIG. 18.

FIG. 19 is a block diagram showing an internal configuration of the main substrate E1004.

In FIG. 19, reference numeral E1102 denotes an ASIC (Application Specific Integrated Circuit). The ASIC E1102 is connected to a ROM E1004 through a control bus E1014, and thus performs various controls in accordance with programs stored in the ROM E1004. For example, the ASIC E1102 transmits sensor signals E0104 concerning the various sensors and multisensor signals E4003 concerning the multisensor system E3000. In addition, the ASIC E1102 receives sensor signals E0104 concerning the various sensors and multisensor signals E4003 concerning the multisensor system. Furthermore, the ASIC E1102 detects encoder signals E1020 as well as conditions of outputs from the power supply key E0018, the resume key E0019 and the flat-pass key E3004 on the front panel E0106. In addition, the ASIC E1102 performs various logical operations, and makes decisions on the basis of conditions, depending on conditions in which the host I/F E0017 and the device I/F E0100 on the front panel are connected to the ASIC E1102, and on conditions in which data are inputted. Thus, the ASIC E1102 controls the various components, and accordingly drives and controls the ink jet printing apparatus.

Reference E1103 denotes a driver reset circuit. In accordance with motor controlling signals E1106 from the ASIC E1102, the driver reset circuit E1103 generates CR motor driving signals E1037, LF motor driving signals E1035, AP motor driving signals E4001 and PR motor driving signals 4002, and thus drives the motors. In addition, the driver reset circuit E1103 includes a power supply circuit, and thus supplies necessary power to each of the main substrate E0014, the carriage board E0013, the front panel E0106 and the like. Moreover, once the driver reset circuit E1103 detects drop of the power supply voltage, the driver reset circuit E1103 generates reset signals E1015, and thus performs initialization.

Reference numeral E1010 denotes a power supply control circuit. In accordance with power supply controlling signals E1024 outputted from the ASIC E1102, the power supply control circuit E1010 controls the supply of power to each of the sensors which include light emitting devices.

The host I/F E0017 transmits host I/F signals E1028, which are outputted from the ASIC E1102, to a host I/F cable E1029 connected to the outside. In addition, the host I/F E0017 transmits signals, which come in through this cable E1029, to the ASIC E1102.

Meanwhile, the power supply unit E0015 supplies power. The supplied power is supplied to each of the components inside and outside the main substrate E0014 after voltage conversion depending on the necessity. Furthermore, power supply unit controlling signals E4000 outputted from the ASIC E1102 are connected to the power supply unit E0015, and thus a lower power consumption mode or the like of the main body of the printing apparatus is controlled.

The ASIC E1102 is a single-chip semiconductor integrated circuit incorporating an arithmetic processing unit. The ASIC E1102 outputs the motor controlling signals E1106, the power supply controlling signals E1024, the power supply unit controlling signals E4000 and the like. In addition, the ASIC E1102 transmits signals to, and receives signals from, the host I/F E0017. Furthermore, the ASIC E1102 transmits signals to, and receives signals from, the device I/F E0100 on the front panel by use of the panel signals E0107. As well, the ASIC E1102 detects conditions by means of the sensors such as the PE sensor and an ASF sensor with the sensor signals E0104. Moreover, the ASIC E1102 controls the multisensor system E3000 with the multisensor signals E4003, and thus detects conditions. In addition, the ASIC E1102 detects conditions of the panels signals E0107, and thus controls the drive of the panel signals E0107. Accordingly, the ASIC E1102 turns on/off the LEDs E0020 on the front panel.

The ASIC E1102 detects conditions of the encoder signals (ENC) E1020, and thus generates timing signals. The ASIC E1102 interfaces with the printing head H1001 with head controlling signals E1021, and thus controls print operations. In this respect, the encoder signals (ENC) E1020 are signals which are receives from the CRFFC E0012, and which have been outputted from the encoder sensor E0004. In addition, the head controlling signals E1021 are connected to the carriage board E0013 through the flexible flat cable E0012. Subsequently, the head controlling signals E1021 are supplied to the printing head H1001 through the head driving voltage modulation circuit E3001 and the head connector E0101. Various types of information from the printing head H1001 are transmitted to the ASIC E1102. Signals representing information on head temperature of each of the ejecting portions among the types of information are amplified by a head temperature detecting circuit E3002 on the main substrate, and thereafter the signals are inputted into the ASIC E1102. Thus, the signals are used for various decisions on controls.

In the figure, reference numeral E3007 denotes a DRAM. The DRAM E3007 is used as a data buffer for a print, a buffer for data received from the host computer, and the like. In addition, the DRAM is used as work areas needed for various control operations.

1.4 Configuration of Printing Head

Descriptions will be provided below for a configuration of the head cartridge H1000 to which this embodiment is applied.

The head cartridge H1000 in this embodiment includes the printing head H1001, means for mounting the ink tanks H1900 on the printing head H1001, and means for supplying inks from the respective ink tanks H1900 to the printing head H1001. The head cartridge H1000 is detachably mounted on the carriage M4000.

Figure 21:
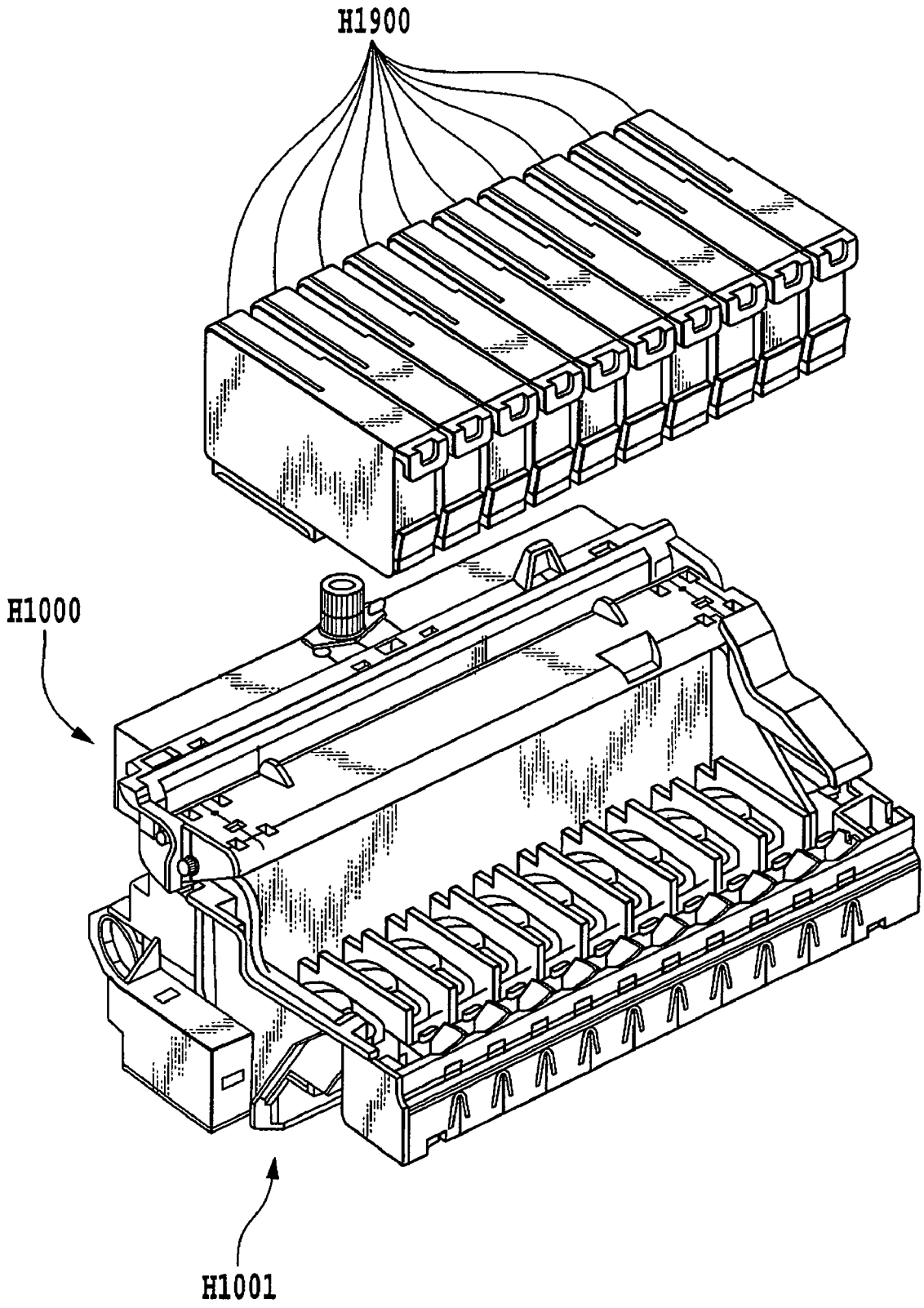
FIG. 21 is a perspective view of a head cartridge and ink tanks applied in the embodiment, which shows how the ink tanks are attached to the head cartridge.

FIG. 21 is a diagram showing how the ink tanks H1900 are attached to the head cartridge H1000 to which this embodiment is applied. The printing apparatus of this embodiment forms an image by use of the pigmented inks corresponding respectively to the ten colors. The ten colors are cyan (C), light cyan (Lc), magenta (M), light magenta (Lm), yellow (Y), black 1 (K1), black 2 (K2), red (R), green (G) and gray (Gray). For this reason, the ink tanks H1900 are prepared respectively for the ten colors. As shown in FIG. 21, each of the ink tanks can be attached to, and detached from, the head cartridge H1000. Incidentally, the ink tanks H1900 are designed to be attached to, and detached from, the head cartridge H1000 in a state where the head cartridge H1000 is mounted on the carriage M4000.

1.5 Configuration of Inks

Descriptions will be provided below for the ten color inks used in the present invention.

The ten colors used in the present invention are cyan (C), light cyan (Lc), magenta (M), light magenta (Lm), yellow (Y), black 1 (K1), black 2 (K2), gray (Gray), red (R) and green (G). It is desirable that all of the coloring agents used respectively for the ten colors should be pigments. In this respect, for the purpose of dispersing the pigments, publicly known dispersants may be used. Otherwise, for the purpose, it is sufficient that pigments surfaces are modified by use of a publicly known method, and that self-dispersants are added thereto. In addition, coloring agents used for at least some of the colors may be dyes as long as the use agrees with the spirit and scope of the present invention. Furthermore, coloring agents used for at least some of the colors may be what are obtained by harmonizing pigments and dyes in color, and a plurality of kinds of pigments may be included therein. Moreover, as for the ten colors of the present invention at least one kind of substance selected from the group consisting of an aqueous organic solvent, an additive, a surfactant, a binder and an antiseptic may be included in therein as long as the inclusion is within the spirit and the scope of the present invention.

2. First Example of Characterizing Structure

The following will explain a print control as a first example of the print control for printing on the front a nd rear ends of the printing medium depending on a condition selected to make a print. Specifically, descriptions will be provided of the print control for obtaining satisfactory image quality regardless of the number of colors of ink usable in the selected print mode. Namely, this example is intended to enable to output a print with high image quality without making deviation of dot-landing positions noticeable even in the case of the small number of colors of ink usable for printing.

2.1 A relationship Between the Number of Colors of Ink and Deterioration in the Image Quality The following will specifically explain a relationship between the number of colors of ink to be used and deterioration in the image quality.

Figure 22A:
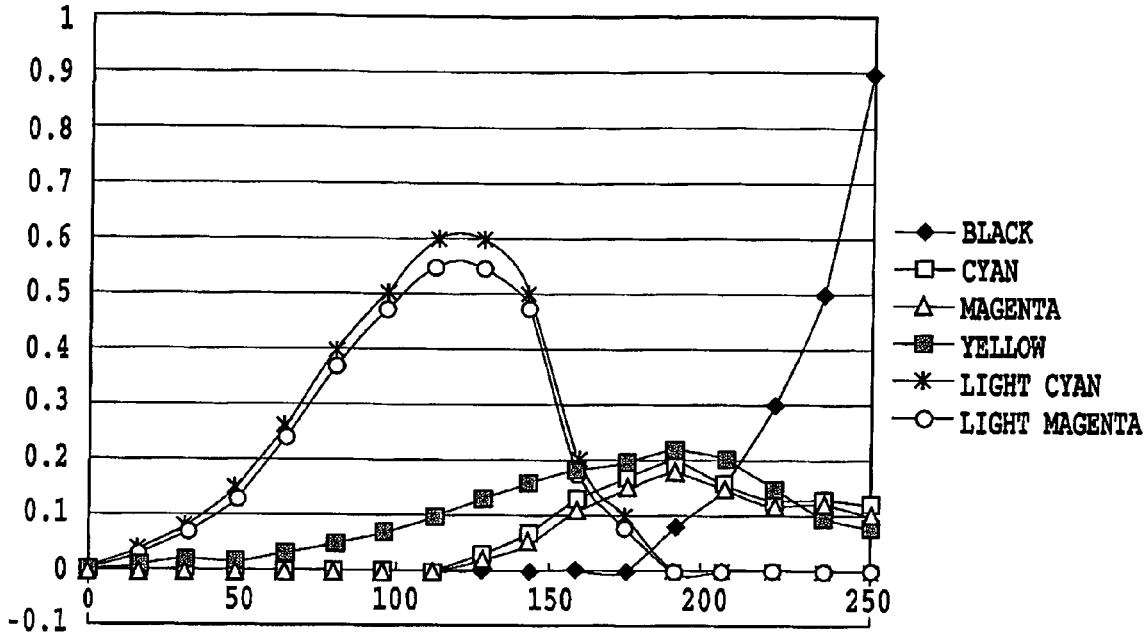
FIG. 22A is a view illustrating a relationship between gradations and an ink usage rate in a normal color print mode.
Figure 22B:
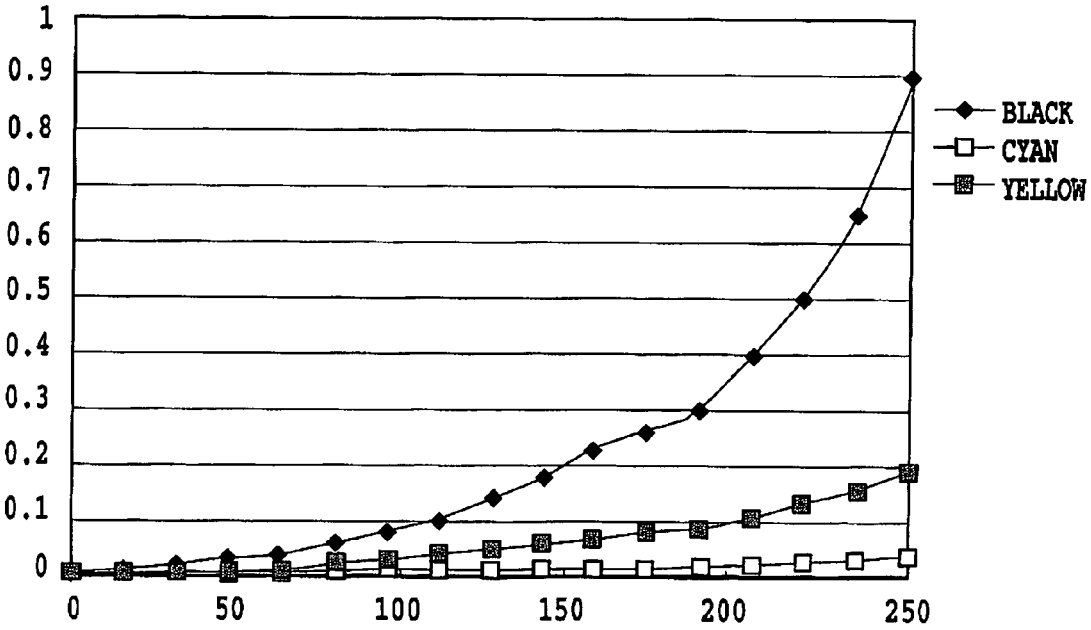
FIG. 22B is a view illustrating that in a monochrome print mode.

FIGS. 22A and 22B are views, each of which illustrates a relationship between gradations and an ink usage rate when reproducing a gray line (a line from white to black). Here, the relationships correspond to that in a normal color print mode and that in a monochrome print mode, respectively. FIGS. 22A and 22B shows an example to which 256 gradations are applied. A horizontal axis indicates gradations and a longitudinal axis indicates an ink usage rate (where a maximum value is "1").

As comparison between these figures in the halftone gradation region, it is shown that the amount of ink applied to the printing medium is obviously small in the monochrome print mode. Moreover, in the monochrome print mode, black ink is also positively used even in a range from low-level gradations to halftone gradations, and a black ink usage rate in the total amount of applied ink is extremely high.

Even in the case of black ink used as an achromatic ink, if the amount of using the black ink per unit area is increased, a printed portion with the black ink becomes to have some chroma saturation depending on types of printing media. As a result, color tone of a print is sometimes inappropriate for a monochrome photograph. Accordingly, in order to obtain an original achromatic color, very small amounts of cyan ink and yellow ink are added as toning components in this embodiment. However, the toning components are not limited to the above and it is needless to say that other color ink such as magenta ink may be used depending on the printing medium. In any case, importance should be placed on the fact that the aforementioned achromatic ink is used only as a toning component and is not used to generate gray and black used as a process color for smoothing a change in gradations.

In order to make it easier to create the color tone and gradation characteristics for representing the monochrome photograph, the amount of using each color of ink is designed to be monotonically increased from the highlight portion to the maximum density portion. This makes it possible to uniform the color tones of the respective portions ranging from the highlight portion to the halftone portion and further to the maximum density portion even if variations in the ink jet printing apparatuses are caused in mass production.

Figure 23B:
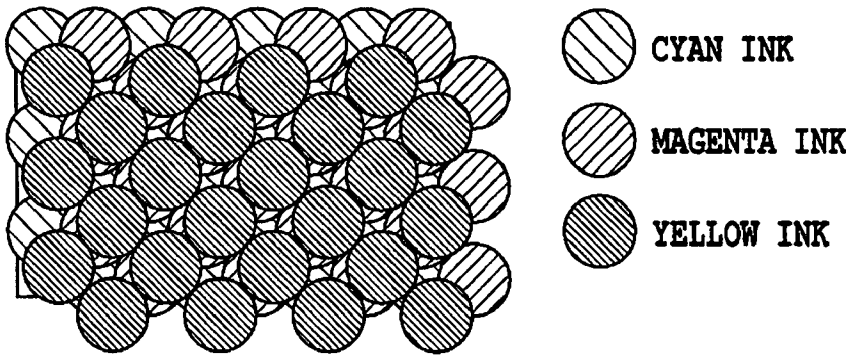
FIG. 23A is a schematic view showing a dot arrangement of black ink in a monochrome print mode, and 23B is a schematic view showing a dot arrangement of color ink in a normal color print mode.
Figure 23A:
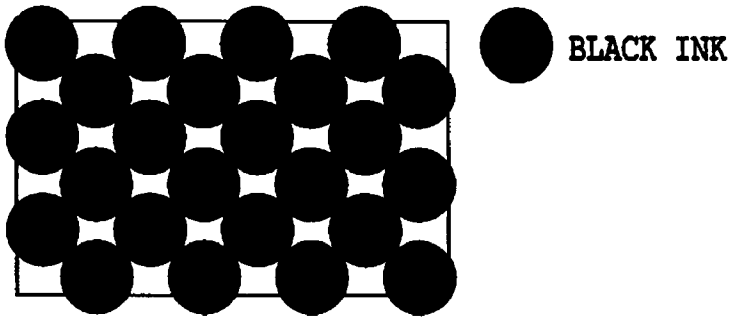

FIG. 23A is a schematic view explaining a dot arrangement of black ink in a monochrome print mode, and FIG. 23B is a schematic view explaining a dot arrangement of color ink in a normal color print mode. FIG. 23A shows the dot arrangement when an image with uniform density is printed by using only the black ink in the monochrome print mode. On the other hand, FIG. 23B shows the dot arrangement when an image with uniform density is printed by using ink of three colors, cyan, magenta and yellow, which are selected, as one example, from ink of all ten colors. FIGS. 23A and 23B show that dots are arranged without deviation of dot-landing positions. Namely, in both FIGS. 23A and 23B, dots are uniformly arranged and no granular impressions occur on the image.

Figure 24B:
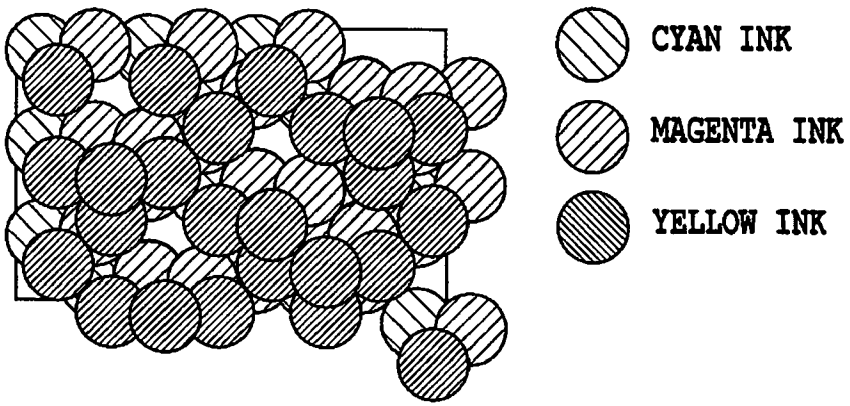
FIGS. 24A and 24B are explanatory diagrams each showing a dot arrangement upon occurrence of deviation of dot-landing positions when the same image as that shown in each of FIGS. 23A and 23B are formed.
Figure 24A:
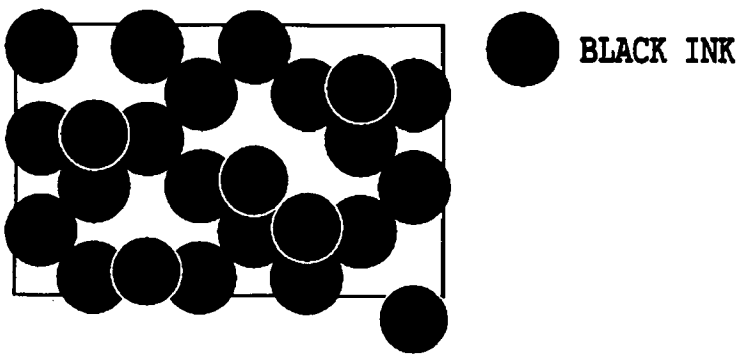

FIGS. 24A and 24B show dot arrangements upon occurrence of deviation of dot-landing positions when the same images as those shown in FIGS. 23A and 23B are formed, respectively. In the monochrome print mode shown in FIG. 24A, the number of dots for forming the image is small, namely, coverage is low. Therefore, the amount of ink to be applied to the printing medium is obviously smaller than that in the normal color print mode. This reveals that the deviation of dot-landing positions is noticeable as compared with the case of the deviation of dot-landing positions in the color print mode (FIG. 24B).

2.2 Printing on Font and Rear End Portions of Printing Medium

The printing apparatus of this embodiment provides an outputted print with the quality equivalent to that of silver-salt photos. This apparatus is structured as a printing apparatus capable of printing an image without margin, that is, "marginless print."

Figure 25:
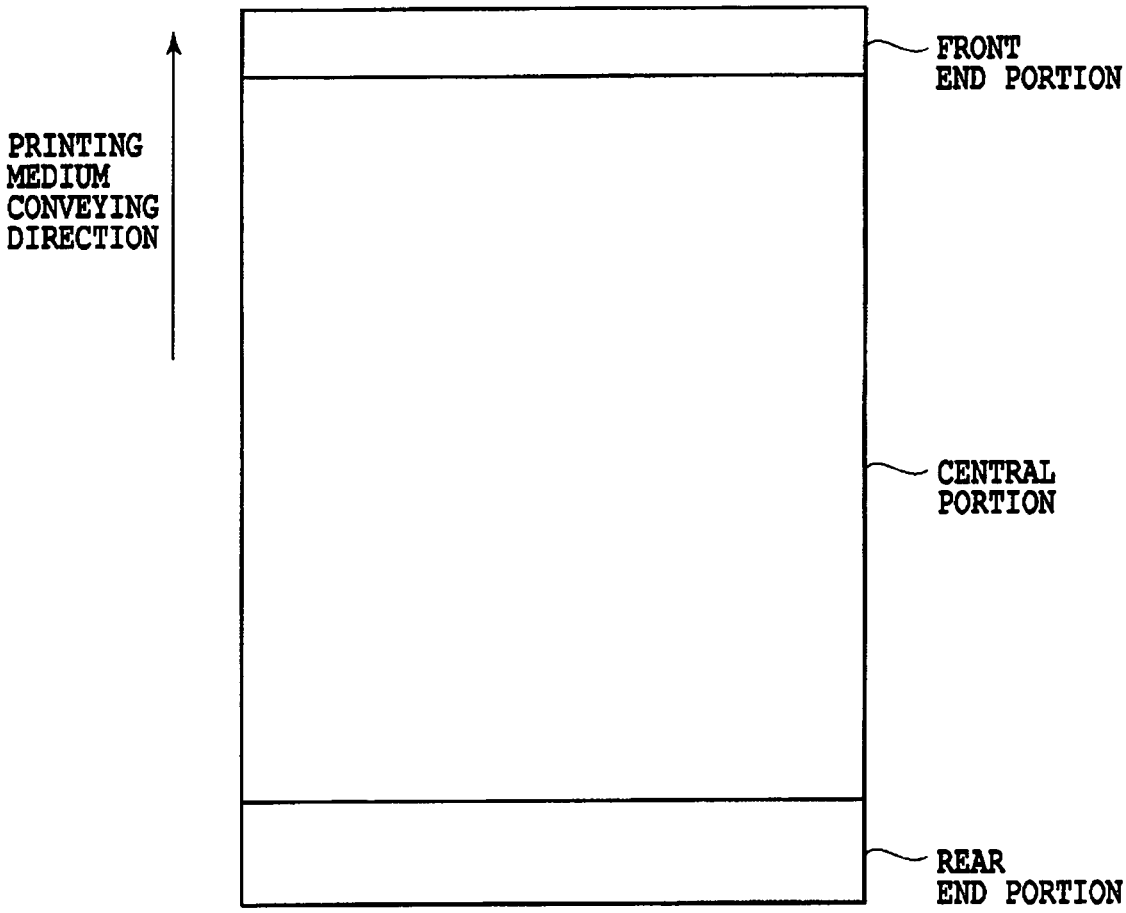
FIG. 25 is a conceptual diagram explaining regions of a front end portion, a central portion and a rear end portion in making the marginless print on a A4-size printing medium by the printing apparatus of this embodiment.
Figure 41:
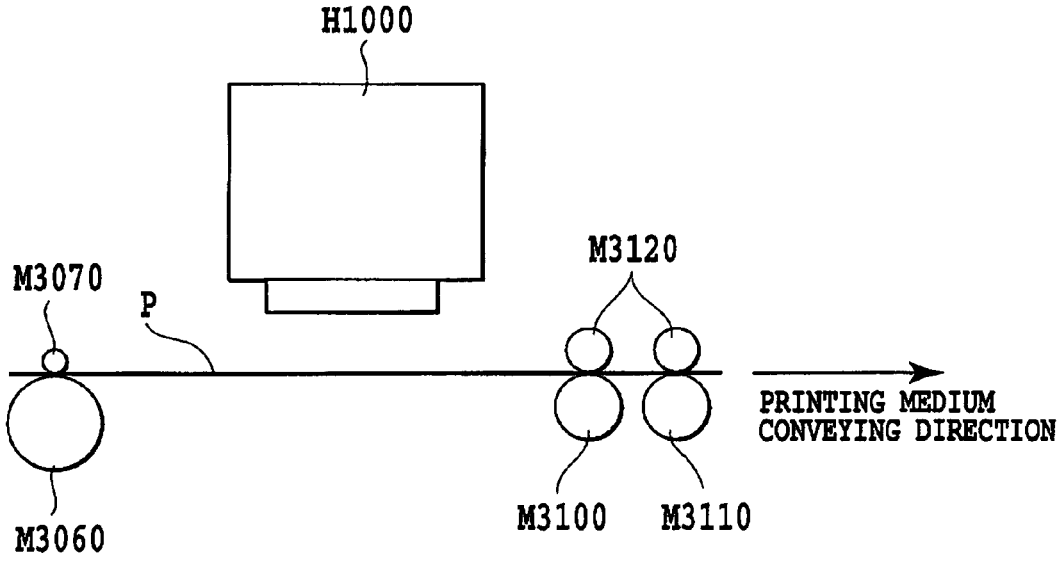
FIG. 41 is a schematic side view illustrating the printing head, the printing medium, and the conveyance mechanism which conveys the printing medium, in making the print on the central portion of the printing medium.
Figure 42:
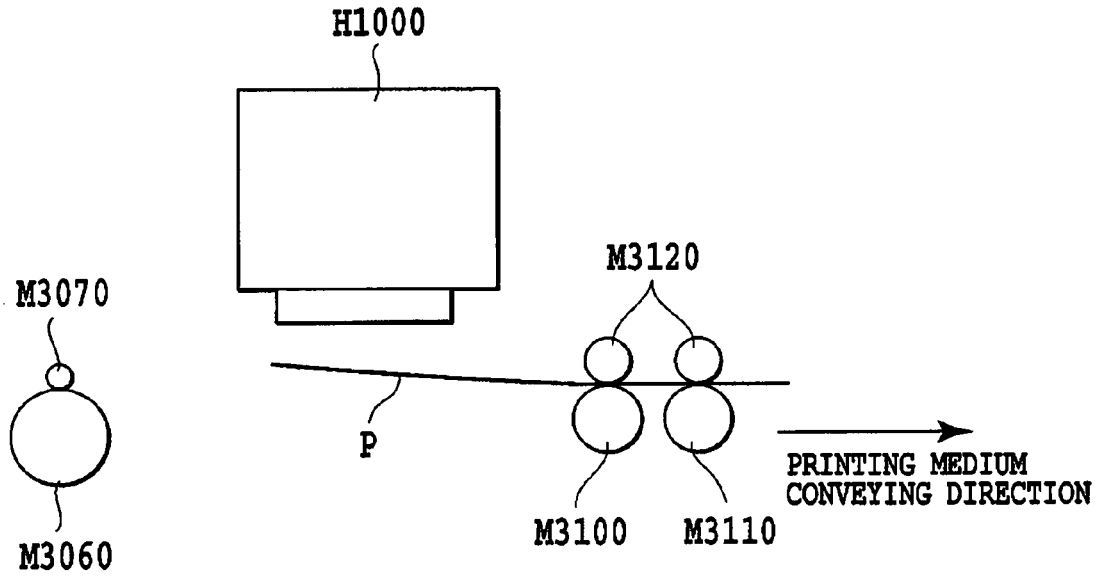
FIG. 42 is a schematic side view for explaining that an image distortion occurs on a portion in the vicinity of the rear end portion of the printing medium.
Figure 43:
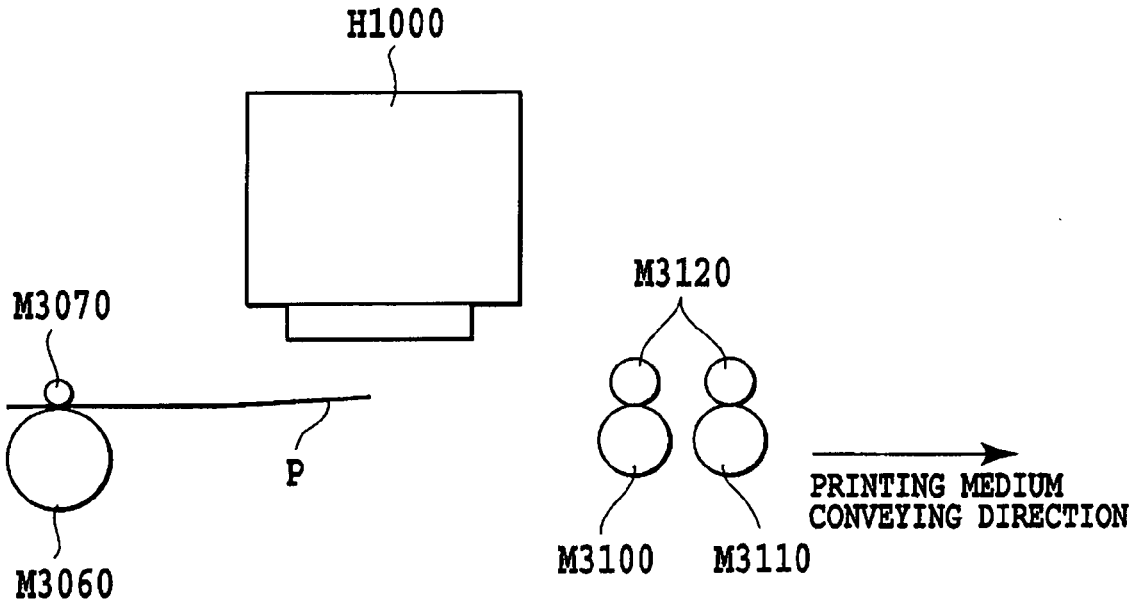
FIG. 43 is a schematic side view for explaining that an image distortion occurs on a portion in the vicinity of the front end portion of the printing medium.

FIG. 25 is a diagram showing each of the regions of the front end portion, the central portion and the rear end portion in performing the marginless print on an A4-size (294 mm×210 mm) printing medium by the printing apparatus of this embodiment. In other words, as explained by using FIGS. 41 to 43, the region where a print can be made on the printing medium held by both the conveying roller M3060 and the paper discharging roller M3100 is assumed as the central portion. Moreover, the region where the print is made before the front end of the printing medium is supported by the paper discharging roller is assumed as the front end portion. Moreover, the region where the print is made after the rear end of the printing medium moves from the conveying roller is assumed as the rear end portion.

In this embodiment, the print is made on the front and rear end portions by nozzles, which are included in a region located at the more downstream side (at the paper discharging roller side), among nozzle groups arranged in the vertical scan direction (the printing medium conveying direction). Accordingly, the region treated as the rear end portion is slightly wider than the region treated as the front end portion.

2.3 Structure of Printing Mode

Based on the aforementioned result of consideration, in this embodiment, descriptions will be provided of cases of implementing the marginless print in two print modes, the normal color print mode and the monochrome print mode. In the normal color print mode, the print is made by using mainly chromatic ink, and in the monochrome print mode, the print is made by using mainly achromatic ink.

Figure 26:
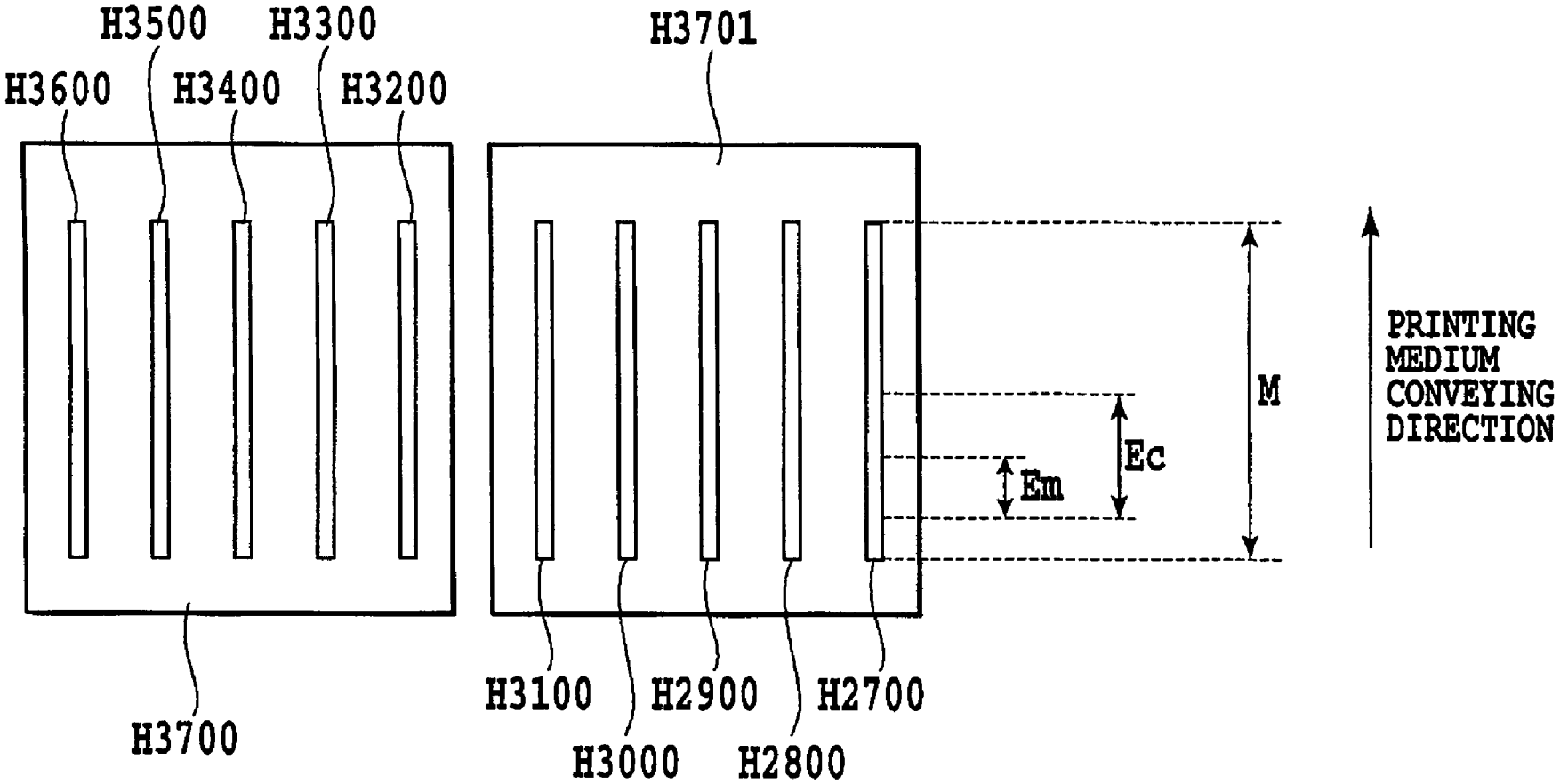
FIG. 26 is an end surface view schematically showing an ejection face on which ejecting openings are foremed of a printing head used in this embodiment.

FIG. 26 schematically shows the state of a printing head H1001 used in this embodiment when viewed from the ejection face or nozzle forming face side. The printing head H1001 of this example includes two printing element substrates H3700 and H3701 each having five nozzle columns of five colors out of the above-mentioned ten colors. Reference numerals H2700 to H3600 indicate nozzle columns corresponding to ink of ten different colors, respectively.

In the printing element substrate H3700, nozzle columns H3200, H3300, H3400, H3500 and H3600 are formed. To the nozzle columns H3200, H3300, H3400, H3500 and H3600, ink of gray, light cyan, black 1, black 2 and light magenta are supplied respectively, and therefrom ink of these colors are ejected. In the other printing element substrate H3701, nozzle columns H2700, H2800, H2900, H3000 and H3100 are formed. To the nozzle columns H2700, H2800, H2900, H3000 and H3100, ink of cyan, red, green, magenta and yellow are supplied respectively, and therefrom ink of these colors are ejected. Each nozzle column is composed of 768 nozzles arranged at an interval of 1200 dpi (dot/inch) in the printing medium conveying direction to eject ink droplets of approximately 2 picoliter. An opening area of each nozzle or ejection opening is set at approximately 100 $\mu m^2$.

When the print is made on the central portion of the printing medium shown in FIG. 25, the entire range M of each nozzle column, that is, 768 nozzles are set to be used in both normal color print mode and monochrome print mode. In contrast, when the print is made on the front and rear end portions in the normal color print mode, the range of each nozzle column to be used is reduced. To be more precise, a region Ec, including 256 nozzles is used, the region Ec being positioned on the upstream side (at the conveying roller side) of the center of the column in the printing medium conveying direction. Namely, the print swath for one scan is made small, thereby preventing deterioration in the image quality. Moreover, when the print is made on the front and rear end portions in the monochrome mode, among 128 nozzles are not used among the 256 nozzles in a region corresponding to the region Ec. The 128 nozzles not to be used are positioned in the region on the downstream side in the printing medium conveying direction. The remaining 128 nozzles included in the region Em are used. Namely, the print swath for one scan is further reduced, thereby preventing deterioration in the mage quality.

Figure 27:
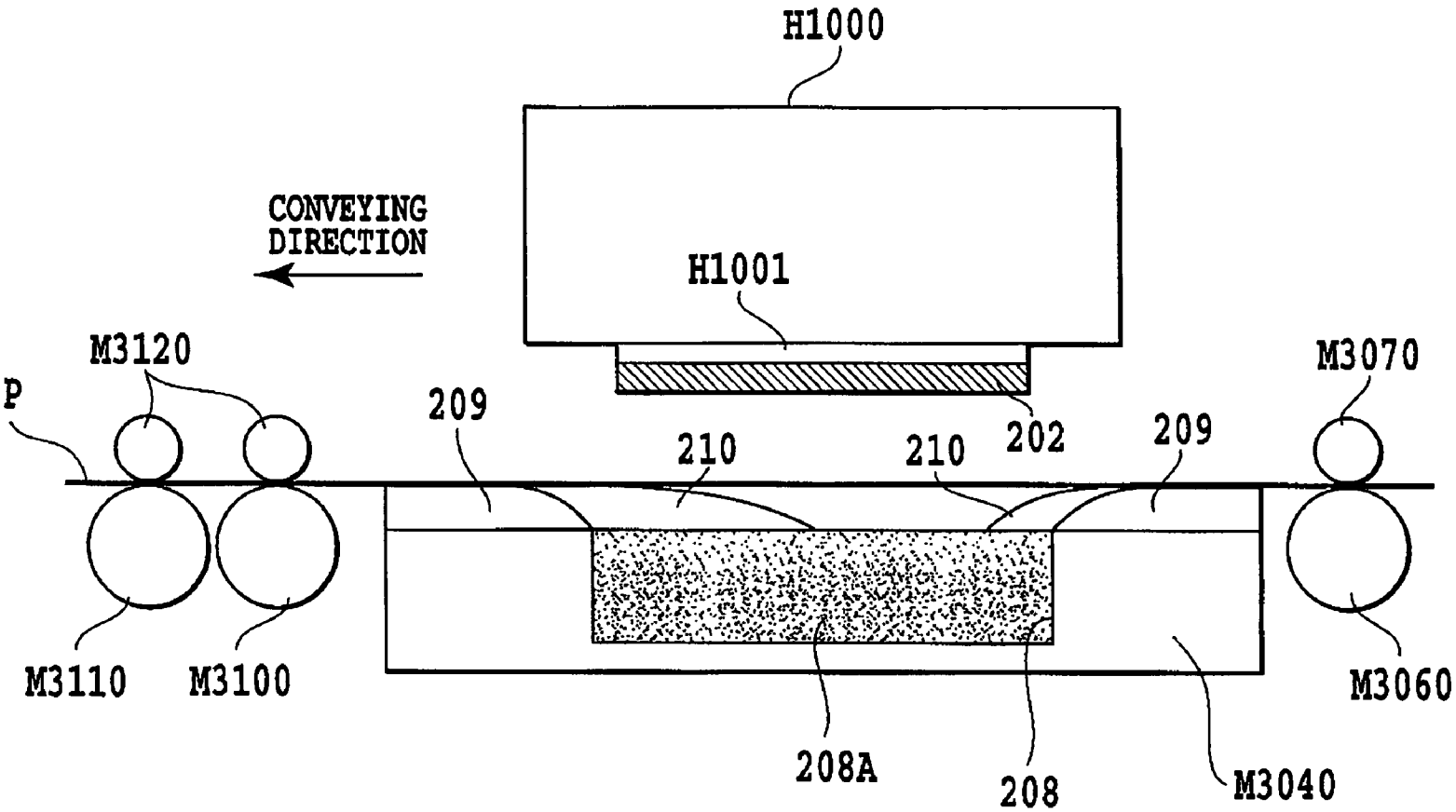
FIG. 27 is an explanatory diagram showing a print operation in making a print on the central portion of the printing medium in a first example of a characterizing structure to be applied to the printing apparatus of this embodiment.
Figure 28:
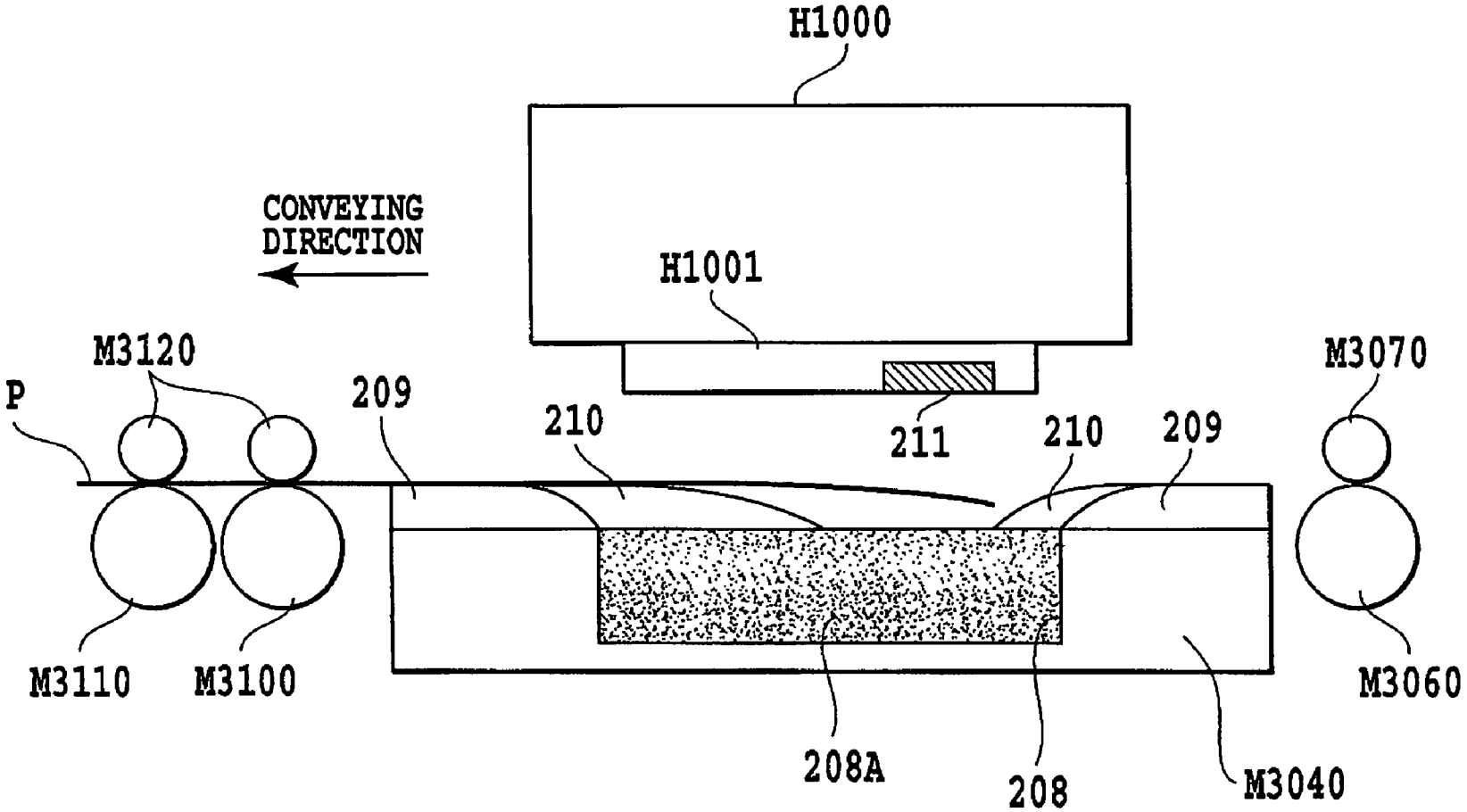
FIG. 28 is an explanatory diagram showing a print operation in making the print on the rear end portion in the normal color mode.
Figure 29:
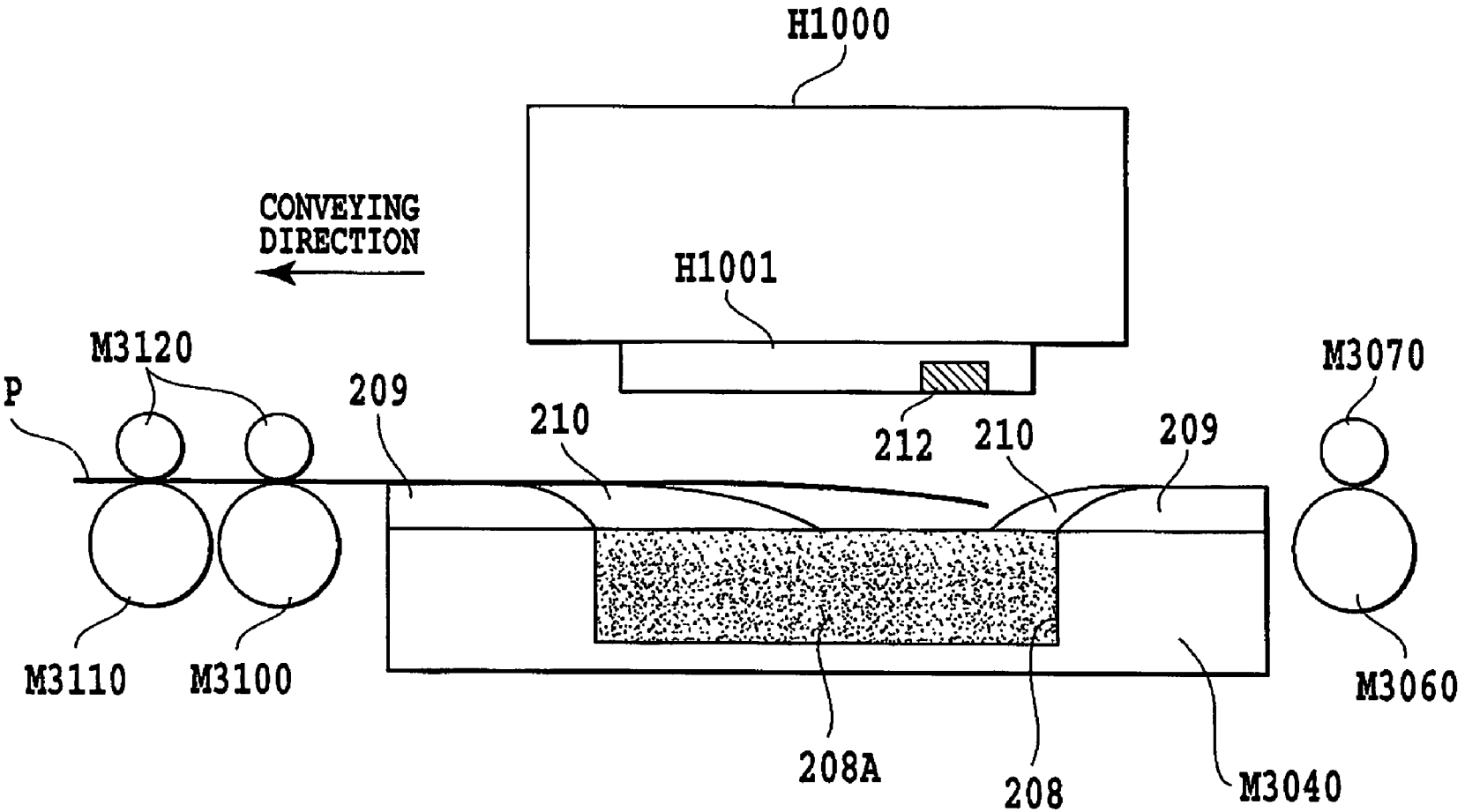
FIG. 29 is an explanatory diagram showing a print operation in making the print on the rear end portion in the monochrome mode.
Figure 30:
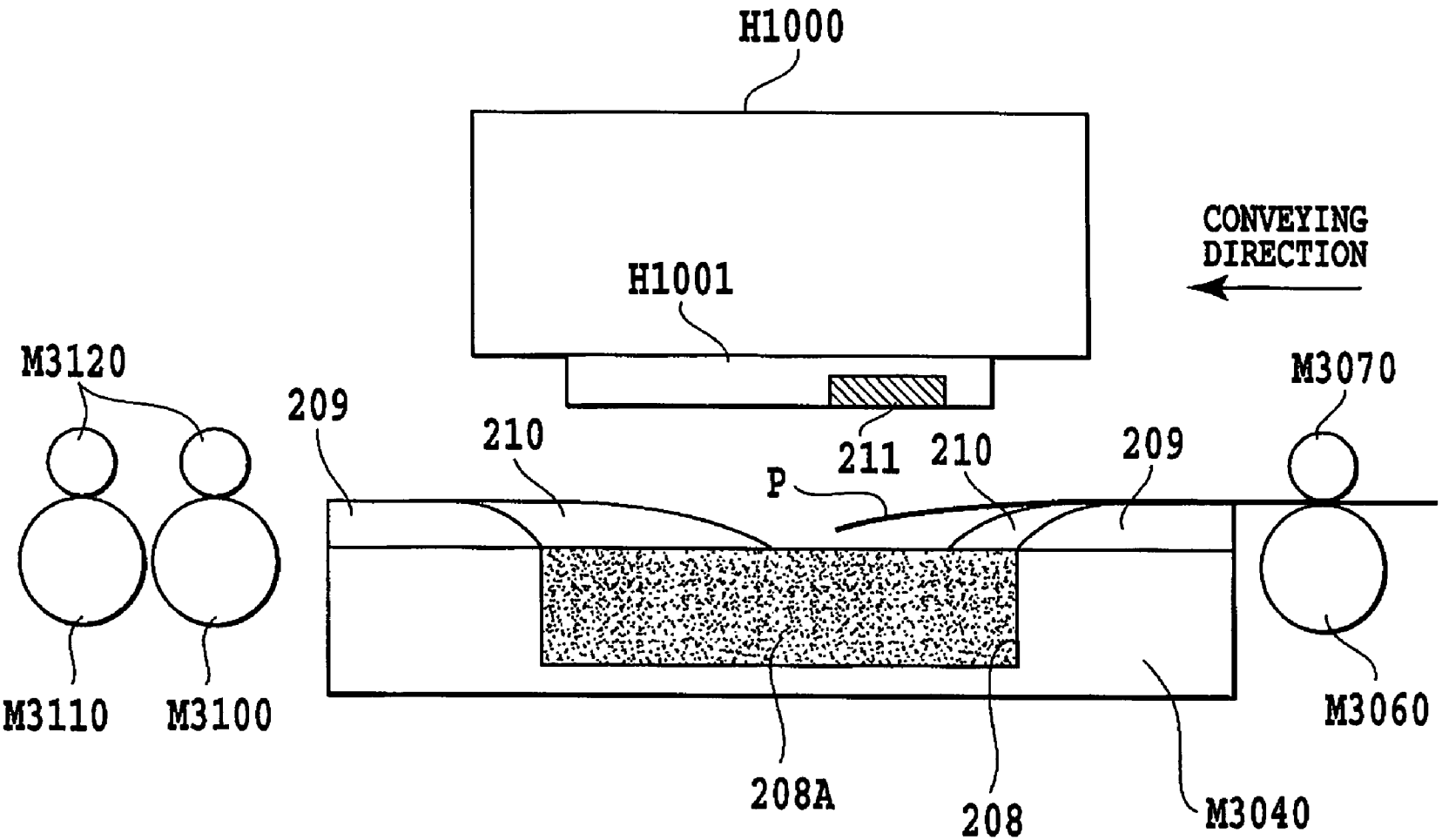
FIG. 30 is an explanatory diagram showing a print operation in making the print on the front end portion in the normal color print mode.
Figure 31:
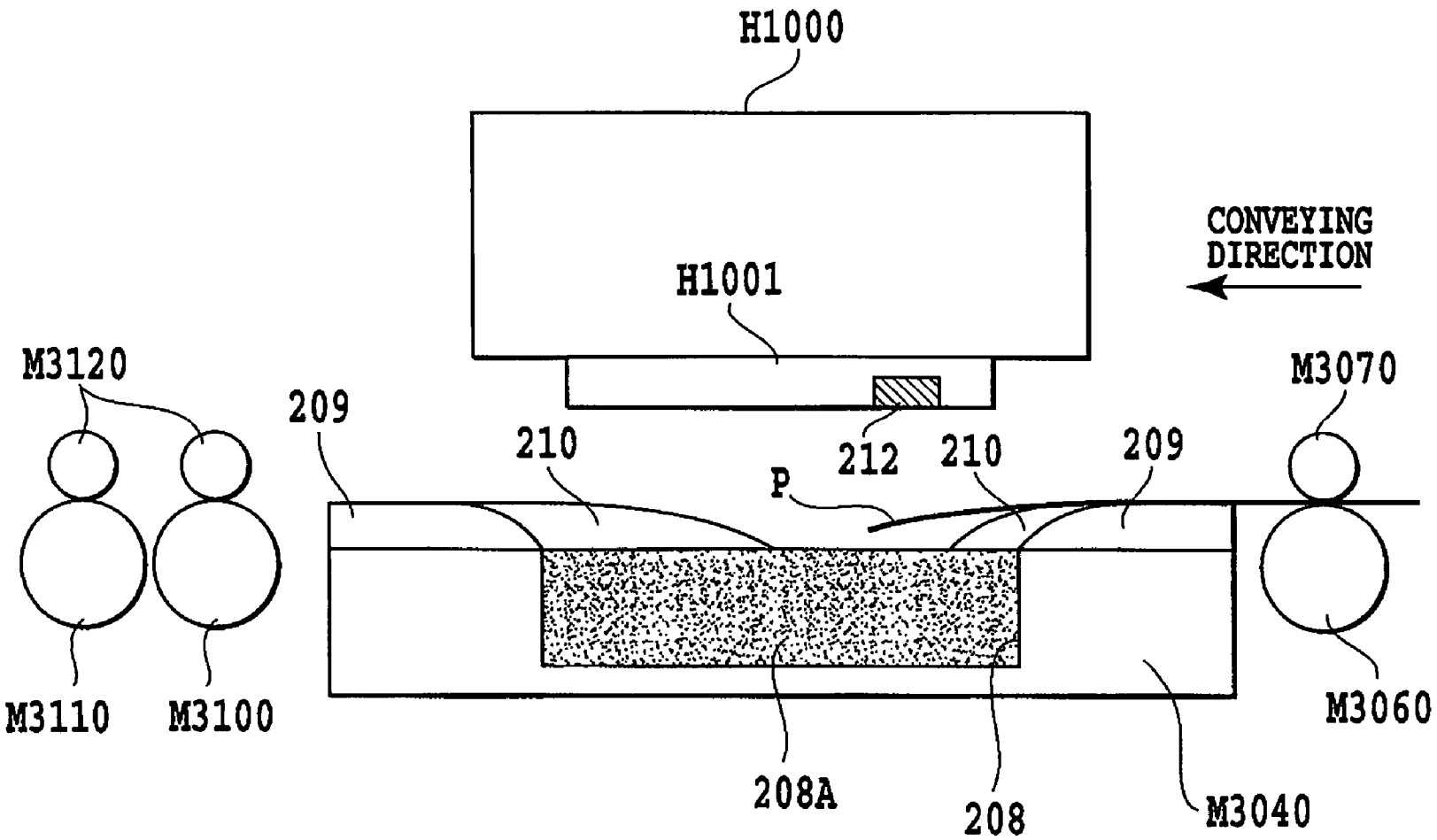
FIG. 31 is an explanatory diagram showing a print operation in making the print on the front end portion in the monochrome mode.

FIG. 27 is an explanatory diagram of a print operation when the print is made on the central portion of the printing medium. FIG. 28 is an explanatory diagram of a print operation when the print is made on the rear end portion in the normal color print mode, and FIG. 29 is an explanatory diagram of a print operation when the print is made on the rear end portion in the monochrome print mode. FIG. 30 is an explanatory diagram of a print operation when the print is made on the front end portion in the normal color print mode, and FIG. 31 is an explanatory diagram of a print operation when the print is made on the front end portion in the monochrome mode.

In these figures, reference numeral 202 indicates a nozzle region (the region M of FIG. 26), which includes 768 nozzles, of each of the nozzle columns formed in the printing head H1001, that is, the printing element substrates H3700 and H3701. Moreover, reference numeral 211 denotes a nozzle region (the region Ec of FIG. 26) corresponding to 256 nozzles to be used when the print is made on the front and rear end portions in the normal color print mode. Moreover, reference numeral 212 denotes a nozzle region (the region Em of FIG. 26) corresponding to 256 nozzles to be used when the print is made on the front and rear end portions in the monochrome print mode.

A platen M3040 supporting the printing medium passing through the print region has a groove 208 in which an ink absorbing member 208A is provided. The ink absorbing member 208A absorbs ink which is ejected outside the front and rear edges and side edges of the printing medium in performing the marginless print. Ink absorbed in the ink absorbing member 208A is thereafter moved to a waste ink absorbing member (not shown) formed in a lower portion of the main body of the printing apparatus.

Reference numerals 209 indicate some portions of ribs attached to the platen M3040. In performing the marginless print, ink is ejected outside the right and left side edges of the printing medium, even when the print is made on the central portion of the printing medium. Accordingly, a distance between the upstream rib portion 209, which is positioned on the right side of the figure, and the downstream rib portion 209, which is positioned on the left side, is formed to be larger than the width corresponding to the maximum number of nozzles (768 nozzles in this embodiment) to be used when the print is made on the central portion of the printing medium. This prevents the rib portions 209 from being smudged by ink ejected outside the right and left side edges when the print is made on the right and left end portions. Moreover, reference numerals 210 also indicate some portions of ribs attached to the platen. These rib portions 210 are involved to support the front and rear end portions of the printing medium. It is preferable that the rib portions 210 be arranged so as to prevent the rib portions 210 from being smudged by ink ejected outside the front and rear edges and the right and left side edges of the front and rear end portions when the print is made on the front and rear end portions. Accordingly, the rib portions 210 are arranged at positions appropriately apart from the portion where the right and left side edges of the printing medium are positioned. A distance between the upstream rib portion 210 and the downstream rib portion 210 is formed to be larger than the width corresponding to the maximum number of nozzles (256 nozzles in this embodiment) used when the print is made on the front and rear end portions of the printing medium.

FIG. 27 shows a state while a print is being made on the central portion of printing medium P illustrated in FIG. 25. As illustrated in this figure, all nozzles 768 are used while the print is being made on the central portion of the printing medium.

FIG. 28 shows a state while a print is being made on the rear end portions of printing medium P in the normal color print mode. In this case, the print is made by using the region 211 including the 256 nozzles positioned upstream in the printing medium conveying direction.

FIG. 29 shows a state while a print is being made on the rear end portion of printing medium P in the monochrome mode. In this case, the print is made by using the region 212 including the 128 nozzles positioned upstream in the printing medium conveying direction.

FIG. 30 shows a state while a print is being made on the front end portion of printing medium P in the normal color print mode. In this case, the print is made by using the region 211 including the 256 nozzles positioned upstream in the printing medium conveying direction.

FIG. 31 shows a state while a print is being made on the front end portion of printing medium P in the monochrome mode. In this case, the print is made by using the region 212 including the 128 nozzles positioned upstream in the printing medium conveying direction.

Before being held between the paper discharging roller M3100 and the spur M3120 or between the paper discharging roller M3110 and the spur M3120, the printing medium P is conveyed only by the conveying roller M3060. Accordingly, in general, the printing medium P is curved as illustrated in FIGS. 30 or 31. Moreover, after moving from the position where the printing medium P is held between the conveying roller M3060 and the pinch roller M3070, the printing medium P is conveyed only by the paper discharging roller M3100 or M3110 each having a smaller diameter and poorer conveyance accuracy of the printing medium as compared with those of the conveying roller M3060 in general. Then, as is the case with the front end portion, in general, the rear end portion is curved as illustrated in FIGS. 28 and 29. Furthermore, conversely, the front and rear end portions are sometimes curved upward.

Although the degree of curvature is influenced by an environment in printing, characteristics of the printing medium, and image print duties, curvature occurs more or less.

Thereby, the distance (the head-to-paper distance) between the nozzle forming surface of the printing head and the printing medium is sharply changed in the forefront end region and the rearmost end region. The thus sharp change in the head-to-paper distance affects the image quality. Particularly in the rear end portion, since the printing medium is conveyed only by the paper discharging rollers M3100 and M3110 having poor conveyance accuracy, an influence on the image quality is more profound.

The image quality at the time of printing on the front and rear end portions depends on the width (print swath) of the region, which is printed with one scan of the printing head H1101, in the printing medium conveying direction. In other words, the larger the print swath is, the more the image is distorted. Conversely, the smaller the print swath is, the less the image is distorted. As to one of the reasons for this, a variation range in the head-to-paper distance within the print swath is smaller, as the print swath is smaller. Accordingly, the print swath of one scan is reduced by reducing a range of the nozzles to be used for printing, thereby making it possible to reduce the amount of the deviation of the dot-landing positions caused by the variations in the head-to-paper distance, and thus to lessen the image distortion.

The reduction in the range of the nozzles to be used for printing means the reduction in the amount of conveying the printing medium after each scan. For example, in the case of completing the print on a region on the printing medium by the multi-pass print, the total conveyance amount required for performing the multi-pass print on the region is small. Therefore, as a result of the reduction in the conveyance amount, the accumulated amount of errors in the conveyance amount also becomes small.

Accordingly, in this embodiment, when the print is made on the forefront end and the rearmost end portions where the image distortion is more likely to occur, the print swath is made small, that is, the range of the nozzles to be used is reduced, and the amount of conveying the printing medium is reduced at the same time, thereby lessening the image distortion.

Then, in this embodiment, the size of the range of the nozzles to be used and the amount of conveying the printing medium are changed depending on the selected print mode.

In the normal color print mode, the print is made by using chromatic ink of multiple colors. Even if the deviation of dot-landing positions is caused by the deterioration in conveyance accuracy and the variation in head-to-paper distance, the image distortion is relatively less noticeable as mentioned above. However, in the monochrome print mode where the number of colors of ink to be used is small, and where, for example, the black ink of the achromatic ink is mainly used, the ink coverage on the printing medium is smaller than that in the normal color print mode. For this reason, the image distortion caused by the deviation of dot-landing positions is outstandingly noticeable. Namely, it is obvious that adverse effects such as generation of the white line, the black line or the granular impression are caused on the image. Accordingly, in this embodiment, when the print is made on the front and rear end portions in the normal color print mode, the print swath, which corresponds to the 256 nozzles, is set to be used (FIGS. 28 and 30), while, when the print is made on the front and rear end portions in the monochrome print mode, the print swath, which corresponds to the 128 nozzles, is set to be used (FIGS. 29 and 31).

Figure 32A:
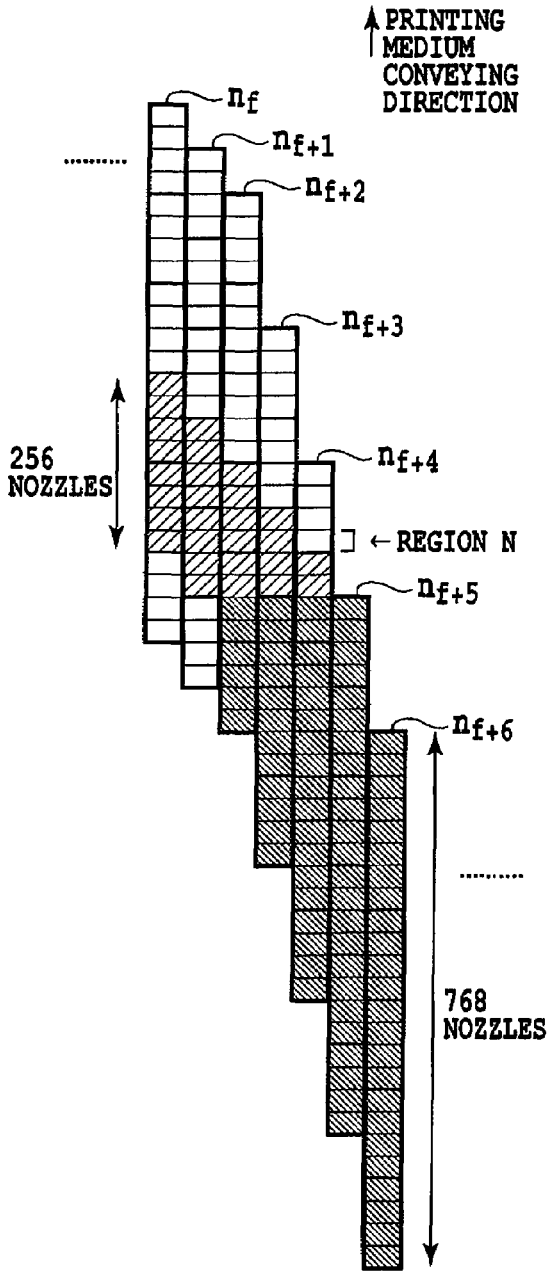
FIGS. 32A and 32B are conceptual diagrams each showing a way of scanning and using nozzles in the normal color print mode.
Figure 32B:
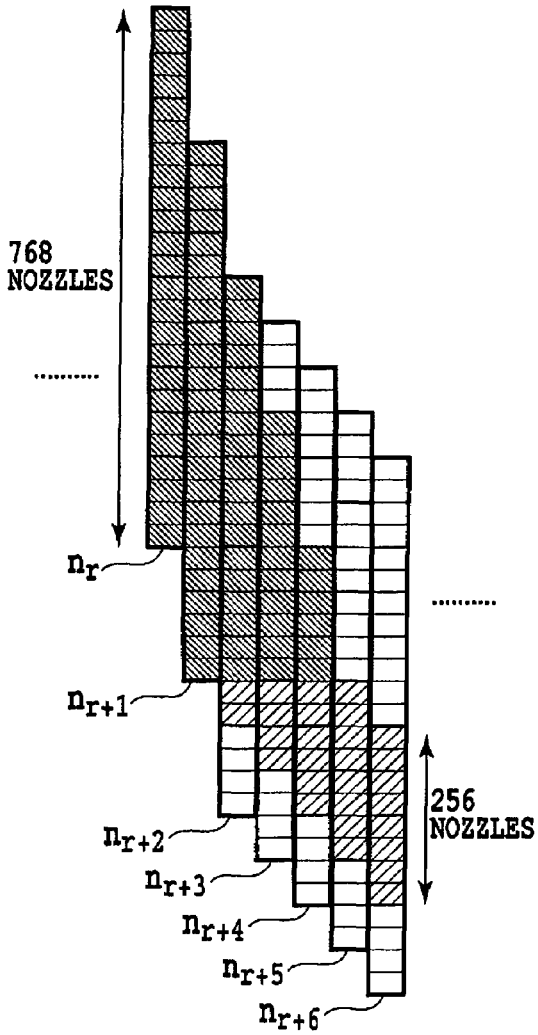

FIGS. 32A and 32B are diagrams each explaining a state of scanning and using the nozzles in the normal color print mode. Here, FIG. 32A shows the state while printing is moved from a portion in the vicinity of the front end of the printing medium P to the central portion thereof. FIG. 32B shows the state while printing is moved from the central portion of the printing medium P to a portion in the vicinity of the rear end thereof.

First, in FIG. 32A, reference numerals $n_f$ to $n_{f+6}$ are numbers of scans to be sequentially performed. Then, it is assumed that the forefront end of the printing medium is not supported by the paper discharging roller until scan $n_{f+1}$, and that the conveyance is carried out only by the conveying roller M3060.

Under this state, the scan is performed by using only the 256 nozzles in the region 211 shown in FIG. 30, while the printing medium P is conveyed by the amount corresponding to 64 nozzles for each scan to thereby form an image on the front end portion of printing medium P. Namely, an image corresponding to a predetermined region N on the printing medium in the figures is completely printed by scanning four times in total (multi-pass print). In this case, the mask similar to that shown in FIG. 5 can be applied to the 256 nozzles.

When the forefront end of the printing medium is completely supported by the paper discharging roller, the scan is performed by using all the 768 nozzles (the region 202 shown in FIG. 27). At the same time, the printing medium P is conveyed by the amount corresponding to the 192 nozzles for each scan to thereby form an image on the central portion of printing medium P (scan $n_{f+5}$ and the followings). Namely, an image in a region included in the central portion of the printing medium is completely printed by scanning four times in total (multi-pass print). In this case, the mask pattern in FIG. 5 can be applied.

In the transition process (scans $n_{f+2}$ to $n_{f+4}$) from the front end portion to the central portion, regarding the portion on which the print is previously made by the nozzles included in the region 211, data is appropriately set so as to perform the multi-pass print by the other nozzles included in the same region. At the same time, the range of the nozzles to be used is expanded to make the print on the central portion, while appropriate amount of the printing medium is conveyed.

Next, in FIG. 32B, reference numbers $n_r$ to $n_{r+6}$ are numbers of scans to be sequentially performed when printing is moved from the central portion of printing medium P to the portion in the vicinity of the rear end thereof. Likewise the above, the multi-pass print is carried out where the scan on the central portion is performed by using all the 768 nozzles, while the printing medium is conveyed by the amount corresponding to the 192 nozzles for each scan (until scan $n_{r+1}$). Moreover, as is the case with the front end portion, the scan is performed, by using the 256 nozzles of the region 211, on the rear end portion of the printing medium, which is not supported by the conveying roller. Thus, the print is made while the printing medium P is conveyed by the amount corresponding to 64 nozzles for each scan (scan $n_{r+5}$ and the followings). In the transition process (scans $n_{r+2}$ to $n_{r+4}$), the data is appropriately set and the appropriate amount of the printing medium P is conveyed, likewise the above, while the range of the nozzles to be used is reduced.

Figure 33A:
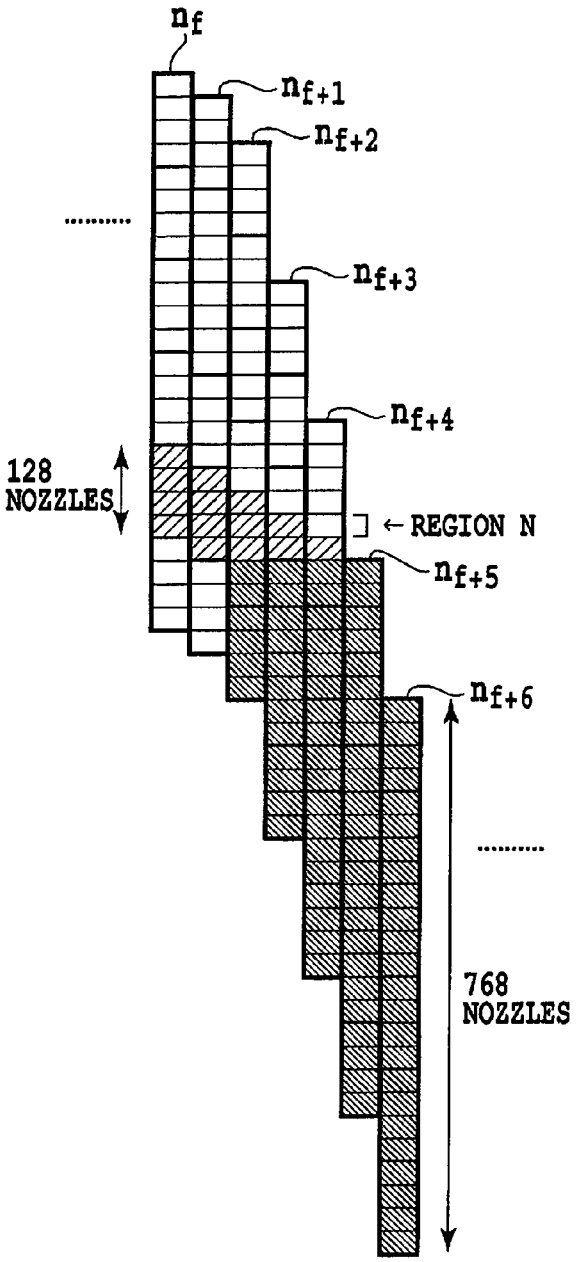
FIGS. 33A and 33B are conceptual diagrams each showing a way of scanning and using the nozzles in the monochrome print mode.
Figure 33B:
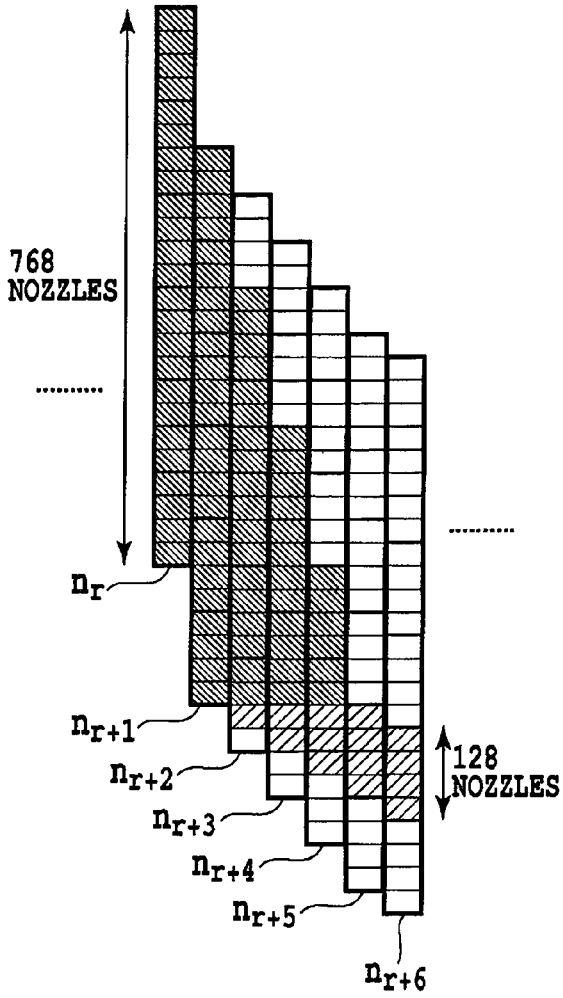

FIGS. 33A and 33B are diagrams each explaining a state of scanning and using nozzles in the monochrome print mode. Here, FIG. 33A shows the state in which printing is moved from a portion in the vicinity of the front end of printing medium P to the central portion thereof, and FIG. 33B shows the state in which printing is moved from the central portion of printing medium P to a portion in the vicinity of the rear end thereof.

First, in FIG. 33A, the forefront end of the printing medium is not supported by the paper discharging roller until scan $n_{f+1}$ and the printing medium is conveyed only by the conveying roller M3060. Under this state, the scan is performed by using only the 128 nozzles in the region 212 shown in FIG. 29, while the printing medium P is conveyed by the amount corresponding to 32 nozzles for each scan, thereby to form an image on the front end portion of printing medium P. Namely, an image corresponding to a predetermined region N on the printing medium in the figures is completely printed by scanning four times in total (multi-pass print). In this case, the mask pattern similar to that shown in FIG. 5 can be applied to the 128 nozzles.

When the forefront end of the printing medium is completely supported by the paper discharging roller, the scan is performed by using all the 768 nozzles (the region 202 shown in FIG. 27). Here, the printing medium is conveyed by the amount corresponding to the 192 nozzles for each scan, to thereby form an image on the central portion of printing medium P (scan $n_{f+5}$ and the followings). Namely, an image corresponding to a region included in the central portion of the printing medium is completely printed by scanning four times in total (multi-pass print). In this case, the mask in FIG. 5 can be applied.

In the transition process (scan $n_{f+2}$ to $n_{f+4}$) from the front end portion to the central portion, regarding the portion on which the print is previously made by the nozzles included in the region 212, data is appropriately set so as to perform the multi-pass print by the other nozzles included in the same region. At the same time, the range of the nozzles to be is expanded to make the print on the central portion, while the appropriate amount of the printing medium is conveyed.

Next, in FIG. 33B, likewise the above, the multi-pass print is carried out by using all the 768 nozzles on the central portion, while the printing medium is conveyed by the amount corresponding to the 192 nozzles for each scan (up to scan $n_{r+1}$). Moreover, as is the case with the front end portion, the scan is performed on the rear end portion of the printing medium, which is not supported by the conveying roller, by using the 128 nozzles of the region 212. Here, the print is made while the printing medium P is conveyed by the amount corresponding to 32 nozzles for each scan (scan $n_{r+5}$ and the followings). In the transition process (scans $n_{r+2}$ to $n_{r+4}$) likewise the above, data is appropriately set and the appropriate amount of the printing medium is conveyed, while the range of the nozzles to be used is reduced.

As mentioned above, in this embodiment, the monochrome print mode is prepared in addition to the normal color print mode. Thereby, the print is made on the front and the rear end portions in the appropriate print method, depending on the print mode. This makes it possible to make a print with little image distortion even on the front and rear end portions of the printing medium where deterioration in the image quality is likely to occur in the monochrome print mode.

In addition, the ASIC E1102 can make a determination, based on the detection done by the above-mentioned PE sensor and the like, as to whether the printing medium P is supported by the upstream conveying means (the conveying roller) and the downstream conveying means (the paper discharging roller) or by only either one of these. That is, after the front edge of the printing medium or the rear edge thereof is detected by the PE sensor E0007, the determination can be made, based on the distance to the paper discharging roller or the conveying roller and the printing medium conveying speed, as to on which of the front end portion, the central portion, the rear end portion or the transition region the print should be made.

2.3 Mode Setting and Control of Printing Apparatus

The user can select one of the aforementioned two modes according to preference in printing. This selection can be conducted when settings of the type of printing medium to be used for printing, the image quality and the like are made in the UI screen displayed on the monitor of the host apparatus J0012. The host apparatus J0012 performs image processing corresponding to the selection and supplies image data to a printing apparatus J0013.

In response to this, the following control can be performed in the printing apparatus.

Figure 34:
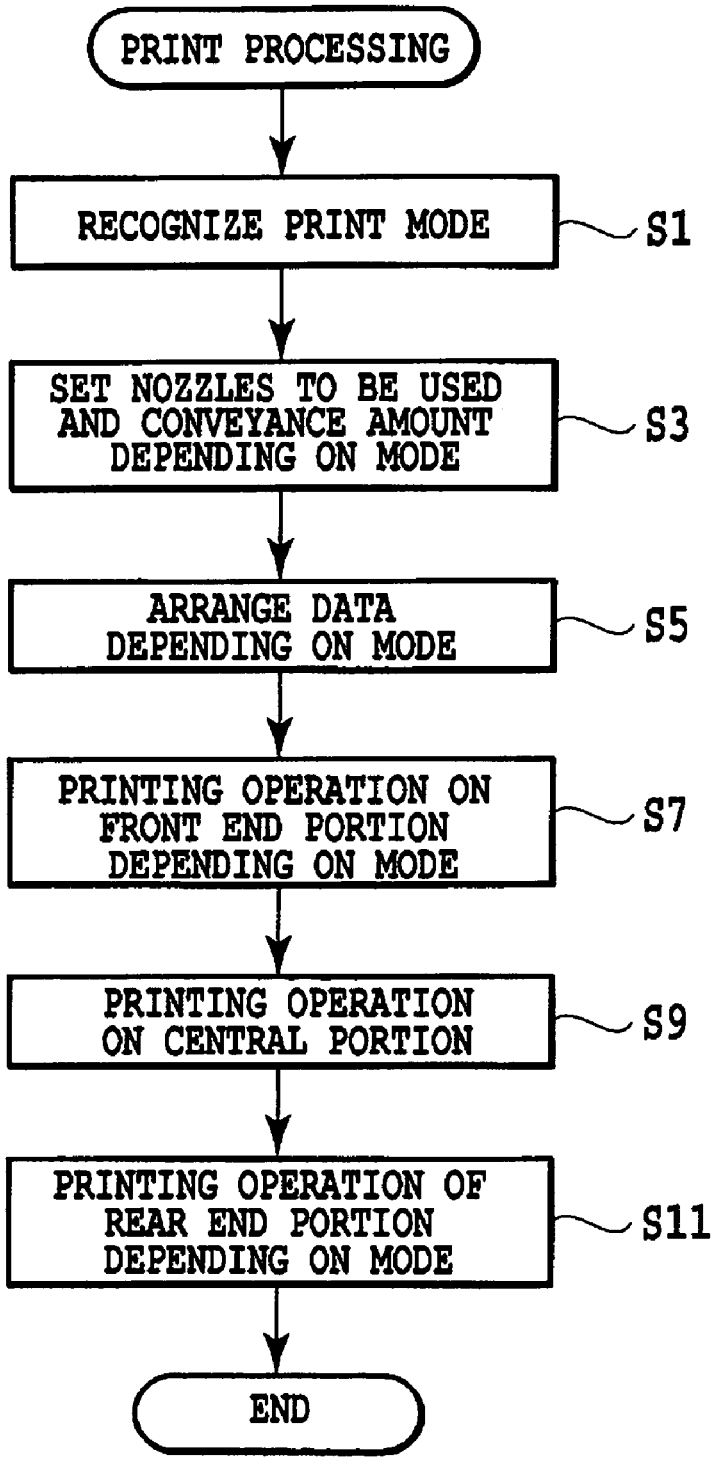
FIG. 34 is a flow chart illustrating an example of a print process procedure executed in the first example of the characterizing structure to be applied to the printing apparatus of this embodiment.

FIG. 34 is a flow chart illustrating one example of a print processing procedure executed by the printing apparatus J0013.

In this procedure, first, the printing apparatus recognizes whether the print mode is the monochrome print mode or the normal color print mode (step S1). This step can be executed by use of information on the print mode selected by the user, the information transmitted by the host apparatus J0012. Alternatively, the printing apparatus can recognize whether the print mode is the monochrome print mode or the normal color print mode, by judging a content of image data received from the host apparatus J0012, namely, by judging whether or not only the amount of data for black ink is extremely large.

Next, the printing apparatus makes a setting of a nozzle region to be used for printing on the front and rear end portions of the printing medium and a setting of the conveyance amount, according to the recognized mode (step S3) Namely, in the normal color print mode, the region 211 shown in FIGS. 28 and 30 is set to be used and the conveyance operation shown in FIG. 32 is set to be performed. Moreover, in the monochrome print mode, the region 212 shown in FIGS. 29 and 31 are set to be used and the conveyance operation shown in FIG. 33 is set to be performed.

Next, data is arranged according to the set region of using the nozzles and the conveyance amount (step S5). Thereafter, the printing operation as explained in FIG. 32A or FIG. 33A is executed on the front end portion of the printing medium and the transition region from the front end portion thereof to the central portion thereof (step S7). Then, after executing the printing operation on the central portion (step S9), the printing operation as explained in FIG. 32B or FIG. 33B is executed on the rear end portion of the printing medium and the transition region passed before the rear end portion (step S11).

According to the above-explained first example of the characterizing structure, in the structure capable of selecting the print mode from the print modes, such as the normal color print mode and the monochrome print mode, where the numbers of colors of ink usable are different, it is made possible to change the size of the range of the nozzles of the printing head to be used for printing on the front and rear ends of the printing medium, and to change the amount of conveying the printing medium for each print scan. This permits to realize the printings on front and rear end portions with the print speed and the image quality so as to be adapted to the print mode. As a result, it is possible to suppress both the reduction of image quality and the reduction of printing speed.

3. Second Example of Characterizing Structure

The following will explain a print control for printing depending on a type of printing medium to be used, as a second example of the print control for printing on the front and rear end portions of the printing medium depending on a condition selected to make a print.

3.1 Printing on Front and Rear End Portions of Printing Medium

In this example, the printing apparatus is also structured as a printing apparatus capable of implementing a print of an image without margin, that is, "marginless print."

Here, the definitions same as those explained in the first example with reference to FIG. 25 are also applied to the definitions of the regions respectively of the front end portion, the central portion and the rear end portion when performing the marginless print on various sizes of printing media. Moreover, the structure of the printing head and the using range of each of nozzle columns are assumed to be the same as those explained with reference to FIG. 26.

The degrees of variations in the head-to-paper distance at the front and rear end portions of the printing media and the conveyance accuracy thereof actually differ depending on the type of the printing medium. In the conventional control, however, the print swath and the amount of conveying the printing medium are uniformly set for making the print on the front and rear end portions of the printing media.

For this reason, in this example, the range of the nozzles to be used for making a print on the front and rear end portions of the printing medium as well as the amount of conveying the printing medium are reduced. In addition to this, in this example, the size of the range of the nozzles to be used and the conveyance amount can be changed depending on the type of printing medium. Here, as explained in connection with FIG. 2, information on the type of printing medium to be printed is described in printing medium information. Depending on the properties, each of the printing media have differences, from another printing medium, in thickness of the printing media, stiffness thereof, roughness thereof, presence or absence of an ink absorbing layer, the properties of the ink absorbing layer and the like. Accordingly, depending on the type of the printing medium, a coefficient of friction between the printing medium and the roller as well as the degrees of curvature caused in the front and rear ends of the printing medium are different from those of another printing medium. Therefore, prior to printing processing, information on the type of printing medium selected by the user is transmitted to the printing apparatus. Then, the printing apparatus appropriately reduces the range of the nozzles to be used for making a print on the front and rear end portions and the conveyance amount in accordance with the type of printing medium and the property, thereby improving both the image quality and the printing speed.

First, regardless of the type of printing medium, the entire range of each nozzle column, that is, the 768 nozzles, is used for making a print on the central portion of the printing medium shown in FIG. 25, as shown in FIG. 26. In contrast to this, for the purpose of making the print on the front and rear end portions, the range of the nozzles to be used in each of the nozzle columns and the print swath for each scan are reduced, thereby preventing the image quality from deteriorating. As the same time, the degrees of the reduction in both of them are changed depending on the type of printing medium. Namely, it is made possible to select either the region Ec or region Em. When the printing medium is supported only by any one of the conveying means positioned upstream in the conveying direction and the conveying means positioned downstream therein, the conveyance accuracy is generally improved in proportion to the reduction in the number of nozzles to be used. For example, if a conveyance deviation in the case of using the 256 nozzles is 11 μm, a conveyance deviation in the case of using the 128 nozzles is approximately 6 μm.

Moreover, in this example, the so-called multi-pass print is also used. In the multi-pass print, the print scan is performed multiple times on the same area of the printing medium to thereby form an image.

The inventors of the present invention conducted the following experiment to check the relationship between a duty (a printable rate) of the mask pattern applied to each print scan of the multi-pass print and the quality of the formed image.

Figure 35:
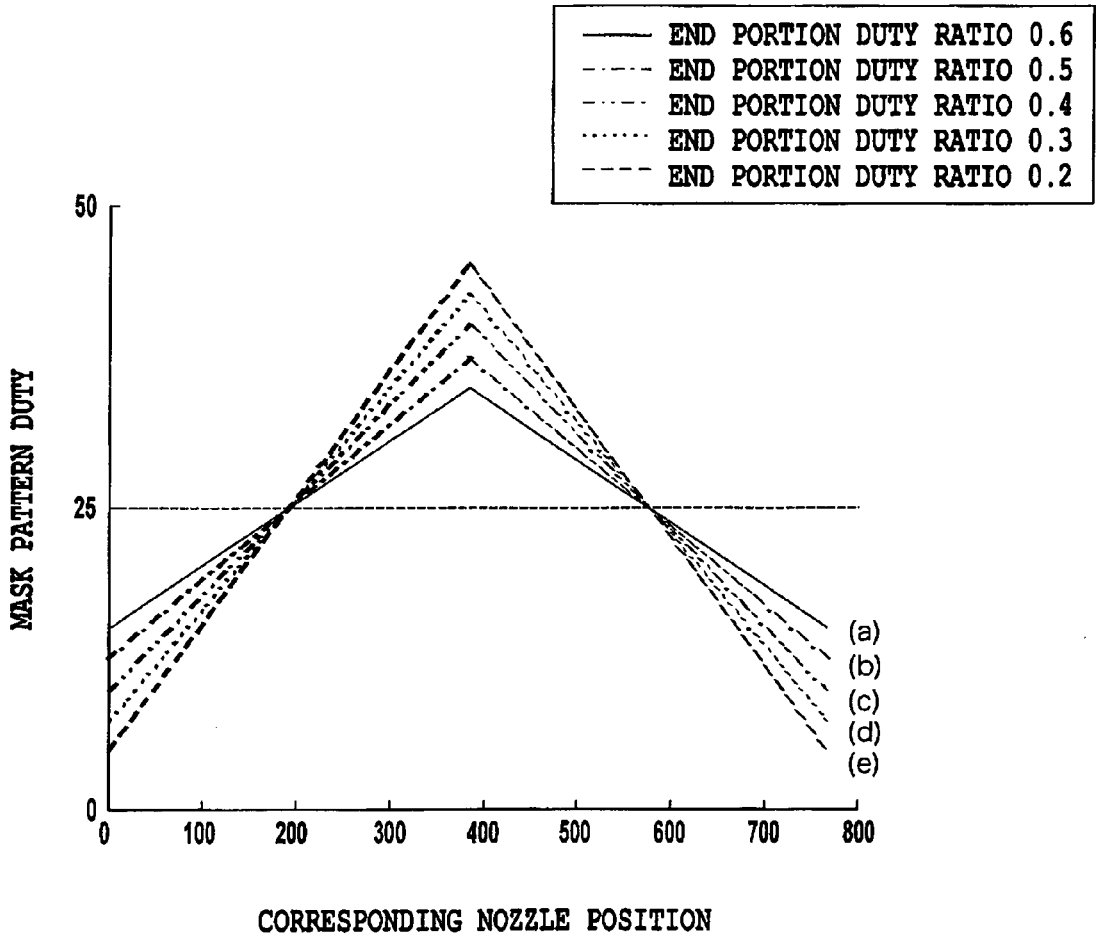
FIG. 35 is a schematic diagram illustrating settings of various duties of mask patterns used in an experiment before a second example of a characterizing structure is applied to the printing apparatus of this embodiment.

FIG. 35 is a schematic diagram illustrating setting of a duty of the mask pattern used in the experiment. In the figure, the horizontal axis indicates positions of the nozzles of the printing head to which data of the mask pattern corresponds. Namely, each point on the horizontal axis corresponds to the position of each of the 768 nozzles from one end to the other end in one of the nozzle columns. A longitudinal axis indicates a printable rate (duty) of each of the mask. When the duty is set not to be changed depending on the positions of the nozzles in order to complete a print of an image by performing the print scan four times (namely, performing four-pass printing), that is, when the pattern with an even duty is used, the duty results in 25%. In contrast to this, in the mask used in this experiment, the duty is changed not only depending on an interrelationship among the nozzle groups (first to fourth nozzle groups in FIG. 5) divided to perform four-pass printing, but also depending on the positions of the nozzles even in each of the nozzle groups.

In FIG. 35, a distribution (a) of the mask pattern used in the experiment has the following distribution characteristic. Namely, there is a tendency that a duty reaches a maximum at the position of the nozzle corresponding to the central portion of the nozzle column and that the duty decreases towards the end portions of the nozzle column. Here, the duty of the mask pattern of the nozzle placed at the position corresponding to the central of the nozzle column (hereinafter, referred to as a central portion duty) is 35%, and the duty of the mask pattern of the nozzle placed at the position corresponding to the end of the nozzle column (hereinafter, referred to as an end portion duty) is 15%. The value 15% of the end portion duty is 0.6 times of a uniform duty (25%) (hereinafter, referred to as an end portion duty ratio).

The distributions (b) to (e) of the mask patterns used in the experiment include the distribution characteristics having tendencies similar to that of the distribution (a). However, these distributions are different from one another respectively in the central portion duties, the end portion duties and the end portion duty ratios.

FIG. 36 is an explanatory diagram showing all together the central portion duties, the end portion duties and the end portion duty ratios of each of the mask pattern distributions (a) to (e). It should be noted that the entire range of each nozzle column, that is, the 768 nozzles, is used for making the print on the central portion of the printing medium in this embodiment. Moreover, for making the print on the front and rear end portions, the 256 nozzles or the 128 nozzles are used depending on the type of printing medium. In any of the cases, however, it is assumed that the mask pattern is selected and employed depending on the range of nozzles to be used. The selected and employed mask has the aforementioned distribution characteristic, and the central portion duty, the end portion duty and the end portion duty ratio thereof are appropriately defined.

Figure 37A:
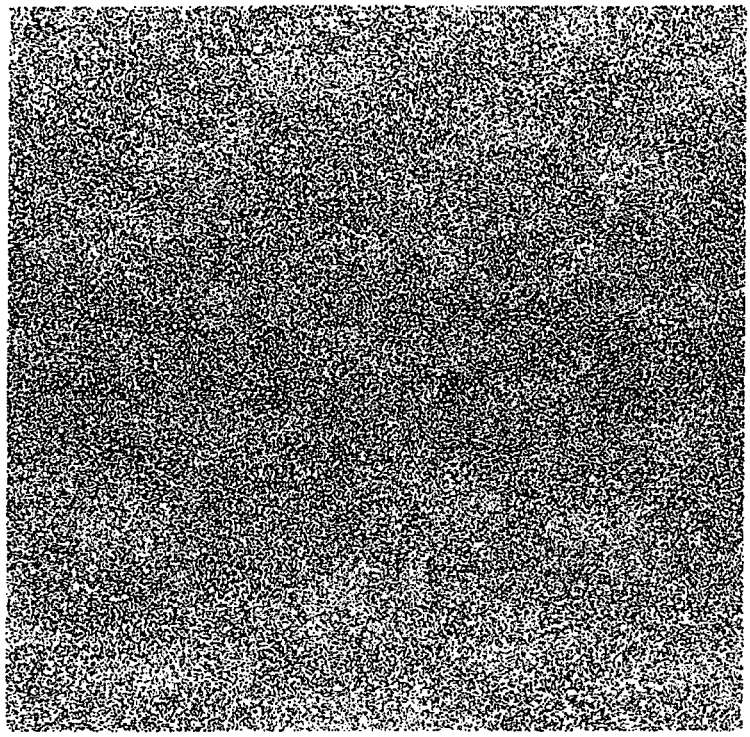
FIGS. 37A to 37C are views each illustrating one of the mask patterns of FIG. 35 to be applied to the different number of nozzles.
Figure 37B:
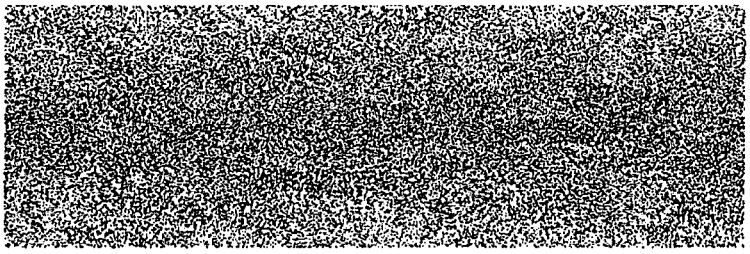
Figure 37C:
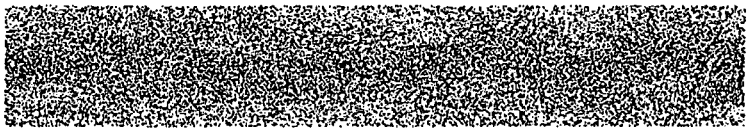
Figure 38A:
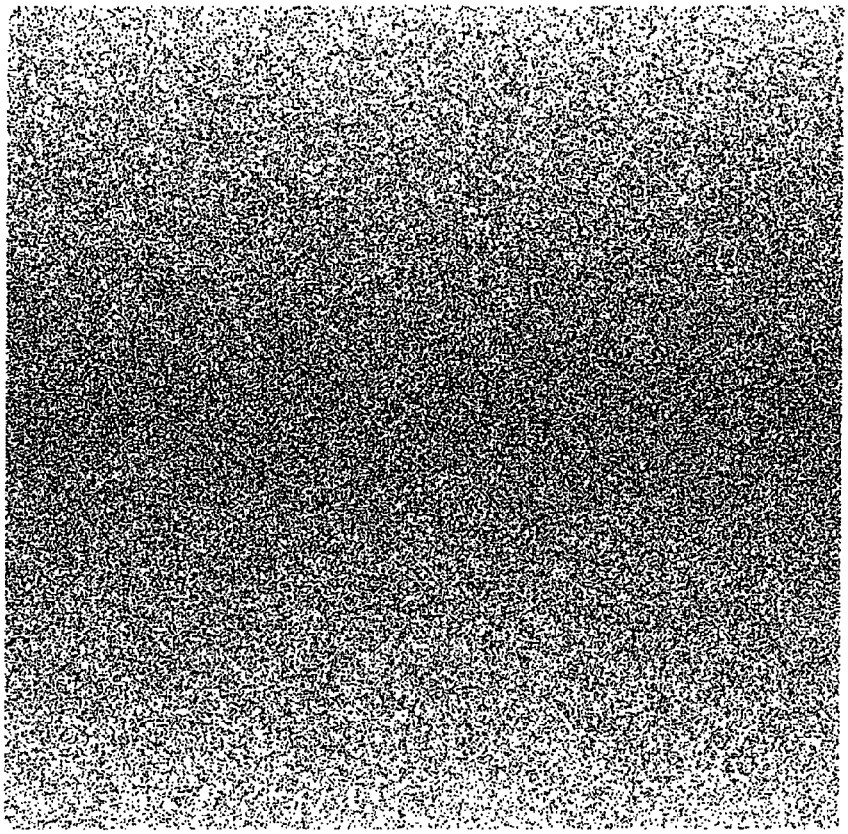
FIGS. 38A to 38B are views each illustrating another one of the mask patterns of FIG. 35 to be applied to the different number of nozzles.
Figure 38B:
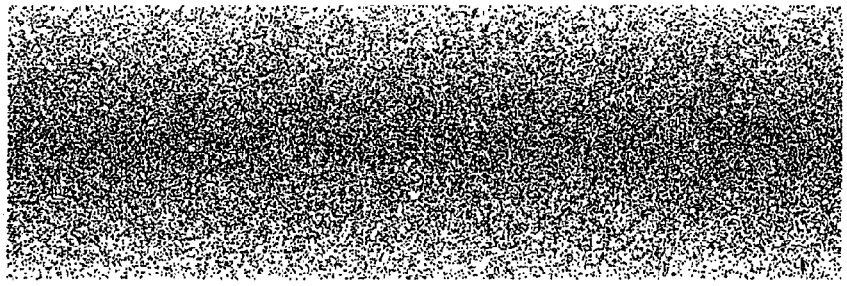

FIGS. 37A to 37C illustrate the mask pattern of the above distribution (a). FIG. 37A indicates the mask pattern for performing four-pass printing by using the 768 nozzles, FIG. 37B indicates the mask pattern for performing four-pass printing by using the 256 nozzles, and FIG. 37C indicates the mask pattern for performing four-pass printing using the 128 nozzles. In addition, FIGS. 38A and 38C illustrate the mask pattern of the distribution (d). FIG. 38A indicates the mask pattern for performing four-pass printing by using the 768 nozzles, and FIG. 38B indicates the mask pattern for performing four-pass printing by using the 256 nozzles.

The experiment was conducted in a state where the mask patterns, each having a different distribution, were applied to print a plurality of test patterns having high uniformity of gray and each hue. At the time of experiment, it was assumed that a nozzle group of adjacent 256 nozzles out of the 768 nozzles arranged at an interval of 1200 dpi were used and that multi-pass print is performed in a way that this nozzle group was divided into four to perform the print scan four times to complete the print of an image. Here, in the case where no deviation occurs, the amount of conveying the printing medium for each print pass (ideal conveyance amount) is given as follows:

$$25.4\ (\text{mm/inch})/1200\ (\text{dot/inch})\times 256\ (\text{dots})/4 \approx 1.3547\ (\text{mm}).$$

Then, the conveyance amount was shifted by 1 μm unit in a conveyance amount decreasing direction (− direction) and in a conveyance amount increasing direction (+ direction) both starting from the ideal conveyance amount. While the conveyance amount was shifted within a predetermined deviation range, the experiment on formation of the test patterns is conducted. Subsequently, examinations were made on occurrence of a line-shaped high-density portion in the case where the conveyance amount was smaller than the ideal conveyance amount and occurrence of a line-shaped low-density portion in the case where the conveyance amount was larger than the ideal conveyance amount. Thereafter, a conveyance deviation allowable range was checked about each of the mask patterns of the distributions (a) to (e). Here, the allowable range denotes a range where occurrence of factors for the image quality deterioration is not recognized.

Figure 39:
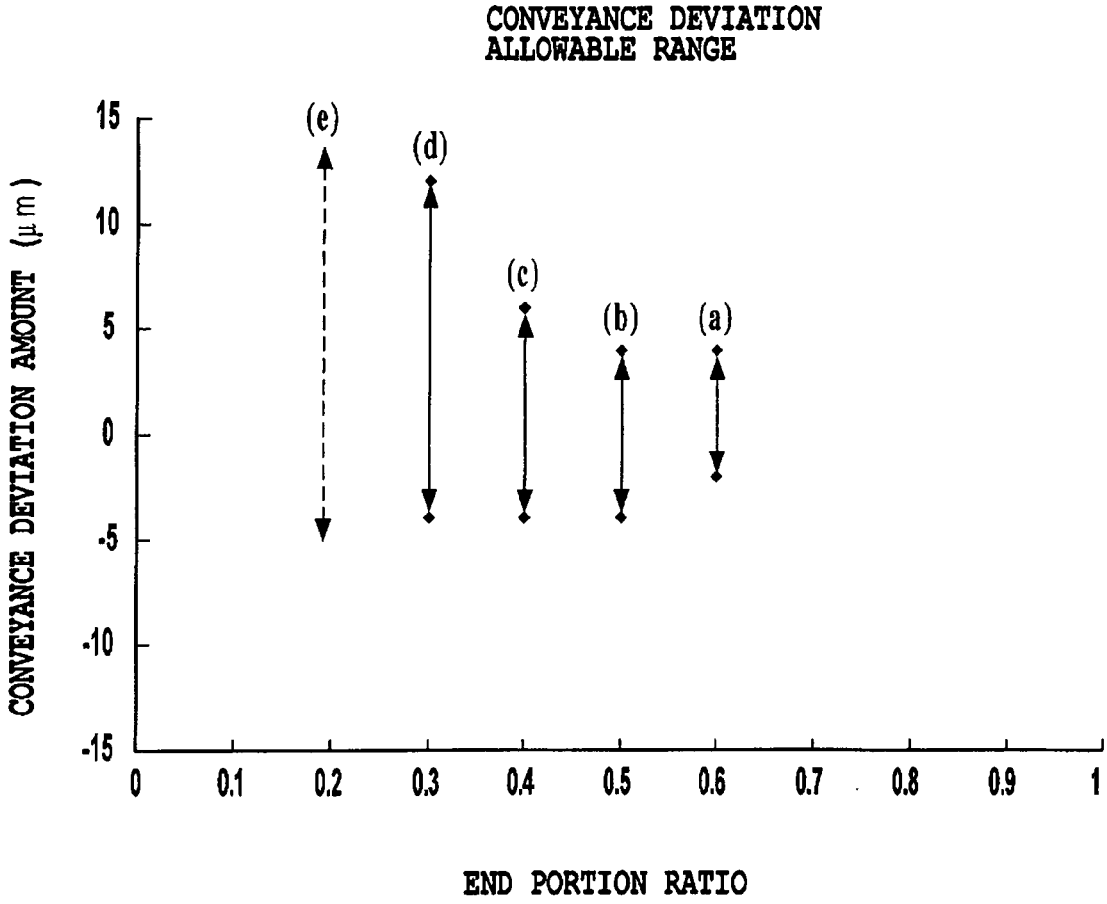
FIG. 39 is a schematic diagram illustrating a check result of a conveyance deviation allowable range, where no occurrence of a factor for image quality deterioration is recognized, of each of the pattern masks in FIG. 35.

FIG. 39 shows the check result. Herein, a horizontal axis indicates the end portion duty ratio. The end portion duty ratio decreases to the left on the horizontal axis. Moreover, a longitudinal axis indicates deviation from the ideal conveyance amount.

As is obvious from FIG. 39, the conveyance deviation allowable range where neither the line-shaped high-density portion nor the line-shaped low-density portion is recognized increases, as the end portion duty ratio decreases. Namely, in this experiment, when the distribution (e) was applied, the conveyance deviation allowable range was the largest and neither the line-shaped high-density portion nor the line-shaped low-density portion was recognized in any case of the amounts of conveyance deviation applied in the experiment.

On the other hand, as a result of the formation of the test patterns, it was observed that band-shaped unevenness, where the density was partially increased, appeared in the region on the printing medium where the print was made by the nozzles positioned at the central portion of the nozzle column in the cases of the distributions (b) to (e). In the case of the distribution (a), unevenness did not appear. In the case of the distribution (b), the presence of unevenness was slightly recognized. Comparing the distributions (c), (d) and (e) with one another, it was seen that unevenness tended to appear more, as the end portion duty ratio became smaller. This, of course, differs depending on the type of printing medium. In this experiment, glossy paper was used as the printing medium, and there are some of the printing media on which noticeable unevenness is generated when the end portion duty ratio is decreased. In order to make the print on such printing media, it is not preferable to decrease the end portion duty in view of ensuring satisfactory image quality. The above study resulted in the discovery that deterioration in the image quality caused by the insufficient conveyance accuracy was less likely to occur as the mask pattern with the smaller end portion ratio was used. However, it was also revealed that the band-shaped unevenness appeared in the region on the printing medium where the print was made by the nozzles positioned at the central portion of the nozzle column when the end portion duty ratio became small.

Moreover, when the print is made on the front or rear end portion of the printing medium, the tendency similar to that of the insufficient conveyance accuracy is found in variations in the head-to-paper distance occurring in a state that the printing medium is supported and conveyed only by the upstream conveying means (conveying roller) or by the downstream conveying means (paper discharging roller). Namely, the deterioration in the image quality tends to less occur as the end portion duty ratio becomes smaller.

The following point can be estimated as a mechanism of this phenomenon. First, in the case where the end portion duty or the end portion duty ratio become smaller, that is, where the duty of ejecting ink on the printing medium by using the nozzles of the end portions becomes lower in the actual print scan, the density of the image formed by one print scan becomes lower in the positions corresponding to the nozzles of the end portions. Presumably, this makes it difficult to visually identify a degraded portion of the image due to deviation of the conveyance amount even if the conveyance amount is deviated in the + direction or − direction from the ideal conveyance amount. Moreover, if the number of passes in the multi-pass print is even, on the region on the printing medium, where the print is made by the nozzles of the end portions of the nozzle column with at a time of one print scan, the print can be made by the nozzles of the central portion of the nozzle column at a time of a different print scan. At this time, on the region on the printing medium where the print is made by the nozzles positioned at the central portion of the nozzle column, slight band-shaped unevenness is assumed to occur due to the small end portion duty ratio. Presumably, even if the conveyance amount is deviated in the + direction from the ideal conveyance amount, band-shaped unevenness, which appears at the position corresponding to the nozzles of the central portion of the nozzle column, is overlapped with the low-density portion generated by the deviation, thereby making it difficult to visually identify the band-shaped unevenness.

3.2 Example of Print Control

Hereinafter, a description will be provided of an example of print control for making it possible to make an appropriate print control for the front and rear end portions depending on the type of printing medium to be used for printing or in response to the user's request.

The user sometimes desires to make a print as soon as possible to check, for example, a resulting image, and conversely desires to make a print with higher quality even if some amount of time for printing is required. Then, the type of printing medium is often selected, as the user requires. To that end, in this embodiment, a print with priority placed on the print speed or a print with priority placed on the image quality is executed depending on the type of printing medium selected by the user.

More specifically, in the case of making the print with the priority placed on the print speed, the print control (hereinafter referred to as a first print control) is made so as to cause the 256 nozzles of the region Ec in FIG. 26 to be used to perform the multi-pass (four-pass) print to which the mask pattern of distribution (d) in FIG. 35 is applied at the time, in order to make the print on the front and rear ends. In this case, since the number of nozzles to be used is relatively large, the conveyance amount is increased for each print scan and the print speed is also increased, while the deviation of the conveyance amount is relatively large. Accordingly, the use of the mask pattern of distribution (d) expands the conveyance deviation allowable range, thereby making it difficult to visually identify line-shaped high-density and low-density portions. In other words, it is possible to make the print in response to the user's request without sacrificing the image quality, even when the priority is placed on the print speed. This is also effective even in the case of a low-cost apparatus configuration in which accuracy of parts related to the conveyance of the printing medium, such as dimensional accuracy of a roller, is reduced. Furthermore, the first print control is suitable for use of the printing medium with a property in which variations in the head-to-paper distance and the amount of conveyance deviation are relatively less likely to occur.

On the other hand, in making the print with the priority placed on the image quality, the print control (hereinafter referred to as a second print control) is made so as to cause the 128 nozzles of the region Em in FIG. 26 to be used to perform the multi-pass (four-pass) print to which the mask pattern of the distribution (a) in FIG. 35 is applied in order to make the print on the front and rear ends. In this case, since the number of nozzles to be used is relatively small, the conveyance amount or conveyance error is decreased for the each print scan. Thereby, it is possible to make the print with high quality. Moreover, in this case, the use of the mask pattern of the distribution (a) makes it possible to suppress generation of band-shaped unevenness in the region on the printing medium corresponding to the central portion of the nozzle column. Namely, it is possible to further improve the image quality. Furthermore, the second print control is suitable for use of the printing medium having a property in which variations in the head-to-paper distance and the amount of conveyance deviation are relatively likely to occur.

It should be noted that, in either case, when the print is made on the central portion of the printing medium, it is possible to perform the multi-pass (four-pass) print to which the mask pattern of distribution (a) is applied by using all the (768) nozzles.

The printing operation when the print is made on the central portion of the printing medium is similar to that explained in the first example with reference to FIG. 27. The printing operations when the print is made on the rear end portion of the printing medium by the first and second print controls are similar to those explained in the first example with reference to FIGS. 28 and 29, respectively. The printing operations when the print is made on the front end portion of the printing medium by the first and second print controls are similar to those explained in the first example with reference to FIGS. 30 and 31, respectively.

In other words, when the print is made on the central portion of printing medium P shown in FIG. 25, all the (768) nozzles are used as illustrated in FIG. 27. In this case, the printing medium is supported and conveyed by both the upstream roller and the downstream roller, and thereby the conveyance accuracy is sufficiently ensured. Accordingly, even when the image portion with high uniformity is formed while the multi-pass (four-pass) print to which the mask pattern of distribution (a) is applied is performed, no deterioration in the image quality occurs.

In making the print on the rear end portion by the first print control, the print is made by using the region 211 including the 256 nozzles positioned upstream in the printing medium conveying direction as shown in FIG. 28.

In making the print on the rear end portion by the first print control, the print is made by using the region 212 including the 128 nozzles positioned upstream in the printing medium conveying direction as shown in FIG. 29.

In making the print on the front end portion by the first print control, the print is made by using the region 211 including the 256 nozzles positioned upstream in the printing medium conveying direction as shown in FIG. 30.

In making the print on the front end portion by the second print control, the print is made by using the region 212 including the 128 nozzles positioned upstream in the printing medium conveying direction as shown in FIG. 31.

As mentioned above, when the print medium is supported only by any one of the conveying means positioned upstream and downstream in the conveying direction, curvature occurs in the front end portion or the rear end portion.

Accordingly, in this example, when the print is made on the forefront and rearmost end portions where the image distortion is more likely to occur, the print swath is basically made small and the amount of conveying the printing medium is reduced at the same time, thereby suppressing the image distortion.

In addition, in this example, the size of the reducing range of the nozzles to be used or the reducing conveyance amount of the printing medium are changed, depending on the type of printing medium or in response to the user request, thereby meeting a request for high-speed printing and a request for high-quality printing. Namely, in this example, when the print is made on the front or rear end portions by the first print control suitable for high-speed printing, the print swath corresponding to the 256 nozzles is applied (FIGS. 28, 30). For example, the first print control is executed when the plain paper is selected. In contrast to this, when the print is made on the rear end or front end by the second print control suitable for high-quality printing, the print swath corresponding to the 128 nozzles is set (FIGS. 29, 31). For example, the second print control is executed when the glossy paper is selected.

The way of scanning and using the nozzles for making the print when the first print control is applied can be set in a manner similar to that explained in the first example with reference to FIGS. 32A and 32B. Namely, in the process where printing is moved from the portion in the vicinity of the front end portion of the printing medium P to the central portion, the scan and the conveyance of the printing medium are performed in the manner similar to those shown in FIG. 32A.

Then, until scan $n_{f+1}$ where the forefront end of the printing medium is not supported by the paper discharging roller and the printing medium is conveyed only by the conveying roller M3060, the four-pass print is performed by using only the 256 nozzles of the region 211 shown in FIG. 30. Here, the mask pattern of distribution (d) shown in FIG. 35 is applied to the 256 nozzles.

When the forefront end of the printing medium is completely supported by the paper discharging roller (scan $n_{f+5}$ and the followings), an image is formed on the central portion of the printing medium P by four-pass printing with all the 768 nozzles (region 202 shown in FIG. 27). Here, the mask pattern of distribution (a) shown in FIG. 35 is applied.

In the process (scans $n_{f+2}$ to $n_{f+4}$) where printing is moved from the front end portion to the central portion, regarding the portion on which the print is previously made by the nozzles included in the region 211, data is appropriately set so as to perform the multi-pass print by the other nozzles included in the same region. At the same time, the range of the nozzles to be used is expanded to make the print on the central portion, while the printing medium is conveyed by an appropriate amount.

Next, in the process where printing is moved from the central portion of the printing medium P to the proton in the vicinity of the rear end portion thereof, the scan and printing medium conveyance are performed in the manner similar to those shown in FIG. 32B. Namely, as is the case with the front end portion, the four-pass print is performed on the rear end portion of the printing medium, which is not supported by the conveying roller, by using the 256 nozzles of the region 211 (scan $n_{r+5}$ and the following). Here, the mask pattern of distribution (d) shown in FIG. 35 is applied to the 256 nozzles. Then, in the transition process (scan $n_{r+2}$ to $n_{r+4}$), data is set in the manner similar to that mentioned above and the printing medium is conveyed by an appropriate amount, while the range of the nozzles to be used is reduced.

The way of scanning and using the nozzles for making the print when the second print control is applied can be set in a manner similar to that explained in the first example with reference to FIGS. 33A and 33B. Namely, in the process where printing is moved from the portion in the vicinity of the front end portion of the printing medium P to the central portion thereof, the scan and the conveyance of the printing medium are performed in the manner similar to those shown in FIG. 33A.

Then, until scan $n_{f+1}$ where the forefront end of the printing medium is not supported by the paper discharging roller and the printing medium is conveyed only by the conveying roller M3060, the four-pass print is made by using only the 128 nozzles of the region 212 shown in FIG. 29. Here, the mask pattern of distribution (a) shown in FIG. 35 is applied.

When the forefront end of the printing medium is completely supported by the paper discharging roller (scan $n_{r+5}$ and the followings), an image is formed on the central portion of the printing medium P by four-pass printing by using all the 768 nozzles (the region 202 shown in FIG. 27).

In the process (scan $n_{f+2}$ to $n_{f+4}$) where printing is moved from the front end portion to the central portion, regarding the portion on which the print is previously made by the nozzles included in the region 212, data is appropriately set so as to perform the multi-pass print by the other nozzles included in the same region. At the same time, the range of the nozzles to be used is expanded to make the print on the central portion, while the printing medium is conveyed by an appropriate amount.

Next, in the process where printing is moved from the central portion of the printing medium P to the proton in the vicinity of the front end portion thereof, the scan and the conveyance of the printing medium are performed in the manner similar to those shown in FIG. 33B. Namely, as is the case with the front end portion, the four-pass print is performed on the rear end portion of the printing medium, which is not supported by the conveying roller, by using the 128 nozzles of the region 212 (scan $n_{r+5}$ and the followings). Here, the mask pattern of distribution (a) shown in FIG. 35 is applied. Then, in the transition process (scan $n_{r+2}$ to $n_{r+4}$), data is set in the manner similar to that mentioned above and the printing medium is conveyed by an appropriate amount, while the range of the nozzles to be used is reduced.

As mentioned above, in this embodiment, when the print is made on the front and rear end portions of the printing medium, the first and second print controls are made depending on the type of printing medium. The first and second print controls differ in the size of the range of the nozzles to be used, the conveyance amount, and the mask pattern applied for the multi-pass print. This makes it possible to fill the request for high-speed printing and the request for high-quality printing, depending on the type of printing medium or in response to the user request. Moreover, by applying the appropriate mask patterns respectively in the print controls, generation of factors for the image quality deterioration can be suppressed, and the print can be made without sacrificing the image quality as much as possible when the priority is placed on the print speed. On the other hand, this makes it possible to further improve the image quality when the priority is placed on the image quality.

It should be noted that determination as to whether the printing medium P is supported by both the upstream conveying means (conveying roller) and the downstream conveying means (paper discharging roller) or by only either one of these can be made in a way similar to that mentioned above.

In addition, in the aforementioned explanation, although the first or second print control is equally applied to the print on the front and rear end portions of the printing medium, different print controls may be applied thereto.

Taking the mask pattern as an example, only in making the print on the rear end portion, the end portion duty or the end portion duty ratio of the mask pattern to be used may be set to be smaller than that of the mask pattern to be used for making the print on the central portion of the printing medium. As mentioned above, this is because the deterioration in the image quality due to deviation of the conveyance amount is more likely to occur on the rear end portion, since the printing medium is conveyed only by the paper discharging roller having inferior conveyance accuracy in making the print on the rear end portions of the printing medium. Moreover, it is possible to use the mask patterns, which differs in the end portion duty or the end portion duty ratio from one another, in order to make the print on the front end, central and rear end portions of the printing medium, respectively. However, the use of the same mask pattern for making the print on the front and rear end portions has an advantage of simplifying control.

Furthermore, in the aforementioned example, the nozzle group of the region which is biased to the conveying roller M3060 is assumed to be used to make the print on both the front and rear end portions. However, the nozzle region to be used in the front and rear end portions may be appropriately set and the region to be used may be changed for making the print on each of the front and rear end portions. For example, as disclosed in Japanese Patent Application Laid-Open No.2004-98668, the nozzle group of the region which is biased to conveying means positioned upstream may be used for making the print on the front end portion, while the nozzle group of the region which is biased to conveying means positioned downstream may be used for making the print on the rear end portion. Moreover, in the second print control, the nozzle group to be used is assumed to be located in the region on the upstream side, in the conveying direction, of the region employed in the first print control. However, needless to say, the region to be used may be appropriately set.

3.3 Control of Printing Apparatus

The user can select the type of printing medium when making the print. For example, this selection can be made in the UI screen displayed on the monitor of the host apparatus J0012. In response to this, the printing apparatus can execute the following control.

Figure 40:
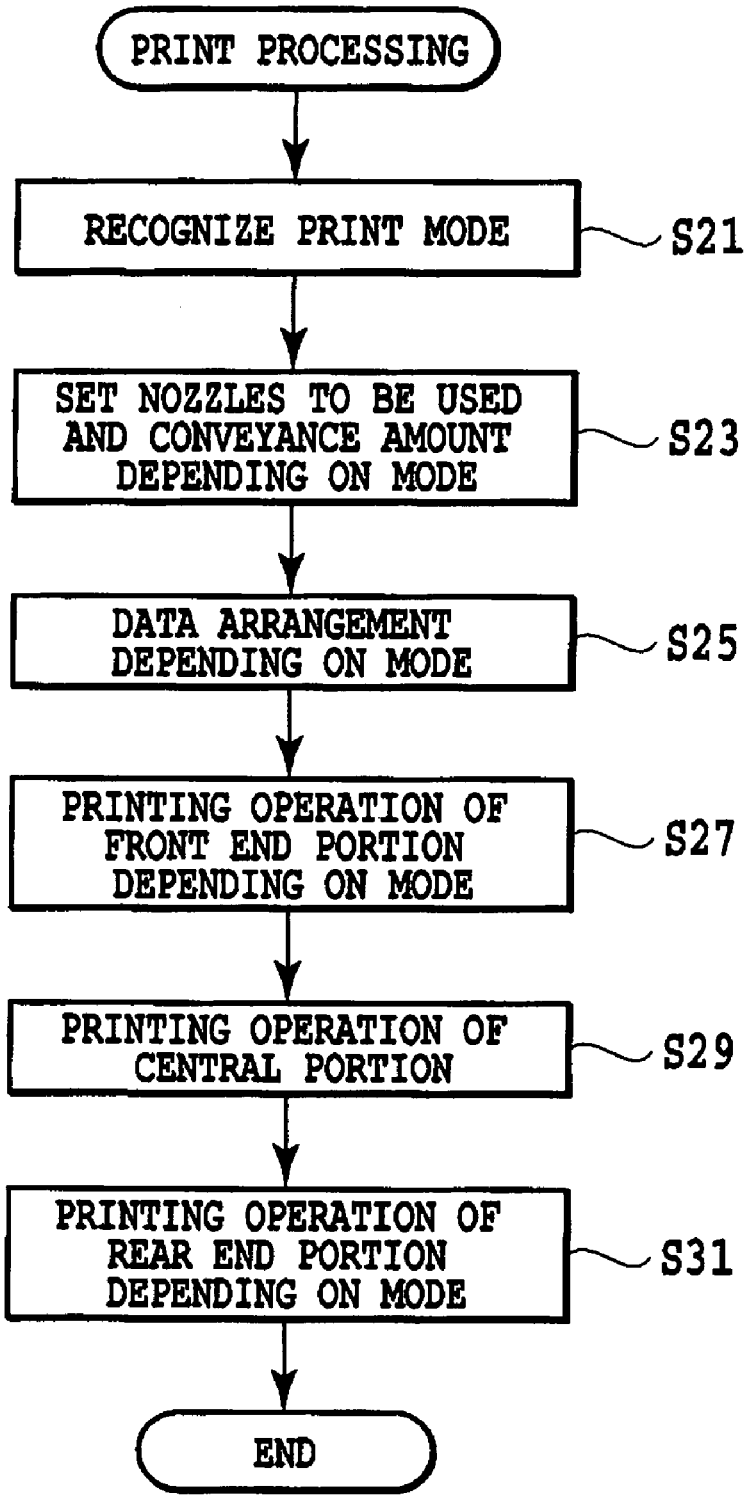
FIG. 40 is a flow chart illustrating an example of a print process procedure executed in the second example of the characterizing structure to be applied to the printing apparatus of this embodiment.

FIG. 40 shows an example of a print processing procedure executed by the printing apparatus J0013.

In this procedure, first, the type of printing medium is recognized (step S21). This step can be executed in a way that the host apparatus J0012 notifies printing medium information selected by the user. Alternatively, the type of printing medium may be recognized by an appropriate sensor provided in the printing apparatus.

Next, first or second print control is selected depending on the type of recognized printing medium, in order to be applied for making the print on the front and rear end portions. Namely, the region of the nozzles to be used, the conveyance amount and the mask pattern are selectively set (step S23).

Such settings can be made, for example, as follows. That is, in a ROM E1004, there are stored in advance the type of printing medium (for example, plain paper, glossy paper, mat paper, post card, cardboard, etc.) and a table indicating a determined relationship among the number of nozzles to be used, the conveyance amount, and the mask pattern for making the print on each of the end portions and central portion of the printing medium. Then, based on the information on the type of printing medium selected and designated by the user, the print control suitable for the printing medium can be decided. For example, it is preferable to select the first print control when the type of recognized printing medium is the plain paper, and to select the second print contorl when the type of recognized printing medium is the glossy paper or mat paper.

Next, data is arranged in response to the region of the nozzles to be used and the conveyance amount, which are set as mentioned above (step S25). Thereafter, the printing operation as explained in FIGS. 32A or 33A is executed on the front end portion of the printing medium and the transition region from the front end portion thereof to the central portion thereof (step S27). Then, after executing the printing operation on the central portion (step S29), the printing operation as explained in FIGS. 32B or 33B is executed on the rear end portion of the printing medium and the transition region from the central portion thereof to the rear end portion thereof (step S31).

In the second example of the above-explained characterizing structure, basically, reduced are the range of printing elements (nozzles) and the amount of conveying the printing medium, which are used for making the print on the front and rear end portions of the printing medium. At the same time, the size of the reducing range and the reducing conveyance amount are changed depending on the type of printing medium. This is desirable from the aspect that user's requests are assumed and that the assumed user's requests are reflected on the print control, thereby improving usability of the printing apparatus.

Namely, in the second example of the characterizing structure, it is made possible to make the print without deteriorating the image quality by changing the size of the range of the printing elements to be used and the amount of conveying the printing medium for each print scan, which are used for making the print on the front and rear end portions of the printing medium. Moreover, the print control can be made, in consonance with the user's request, for the printing medium selected in response to the user's request, for example, a request in the case of placing the priority on the image quality or the printing speed. Thereby, the printing apparatus with high usability can be provided.

Furthermore, while the multi-pass print is performed, it is possible to change the mask pattern, which is applied to the multi-pass print on at least one of the front and rear ends portions, depending on the type of printing medium. This makes it possible to aim at improving both the speed of the print and the image quality depending on the type of printing medium.

4. Others

Additionally, in the aforementioned embodiment, although the explanation has been given of the printing method of implementing the marginless print, the present invention is not limited to the marginless print. Moreover, the marginless print may be made on either one of the front and rear end portions of the printing medium. In essence, the present invention can be effectively applied to a structure, regardless of the presence or absence of the margin, if the structure is one in which at least one of the front and rear end portions of the printing medium is supported only by one roller, thereby causing the head-to-paper distance to be varied and causing the conveyance accuracy to be reduced.

In addition, the condition selected to make the print is not limited to the condition regarding the print mode as in the first example and to the condition regarding the type of printing medium as in the second example, but may be the one in which those are combined. In this case, the relationships determined such that the combined conditions of the print mode and the type of printing medium correspond to the first and second print controls. The follwing table indicates an example of the relationship. The first or second print control is selected according to the combination of the print mode and the type of printing medium, based on the table. For instance, based on this table, the second print control is selected according to the combination of the monochrome mode and the glossy paper, while the first print control is selected according to the combination of the color mode and the plain paper.

TABLE

| | Monochrome Mode | Color Mode |
|---|---|---|
| Plain Paper | First Print Control | First Print Control |
| Mat Paper | Second Print Control | First Print Control |
| Glossy Paper | Second Print Control | Second Print Control |

It is possible to apprppriately modify each of the above first and second examples of the characterizing structure. For example, in the first example of the characterizing structure, the normal color print mode and the monochrome print mode differ in the size of the reducing range of the nozzles to be used, and the reducing conveyance amount are changed, in making the print on the front and rear end portions of the printing medium. Here, the size of the reducing range and the reducing conveyance amount are more decreased in the latter mode. However, the mode is not limited to the aforementioned modes and the other mode may be used. In essence, the present invention can be effectively applied, if the structure is one in which one mode can be selected from a plurality of print modes using respectively the different numbers of colors of ink (printing agents) usable for forming an image, and in which deterioration in the image quality is noticeable depending on the selected mode when the print is made on the front and rear end portions. For example, in addition to the monochrome print mode using black as a basic tone, the present invention can be effectively applied to a structure, if the structure is one in which it is possible to select a mode whose coverage is small due to the small number of colors of ink to be used, thereby making deterioration in the image quality noticeable, when the print is made on the front and rear end portions.

Moreover, in the second example of the characterizing structure, there are two controls one of which is set depending on the type of printing medium. However, a combination of the type of printing medium and the print control may be increased. This makes it possible to make the print on the various types of printing media with appropriate balance between the image quality and the printing speed, while further improving usability.

Furthermore, regarding the number of color tones (color, density, etc.) of ink to be used, the kind of ink, the number of the nozzles (printing elements), the way of setting of the range of the nozzles to be used and the amount of conveying the printing medium, the number of passes for the multi-pass print, and the types of mask patterns to be applied, they are provided just as examples. Namely, it is needless to say that other appropriate examples can be adopted.

For instance, in the aforementioned examples, there is used the mask pattern having the distribution characteristic with a tendency in which a duty reaches a maximum at the nozzle of the position corresponding to the central portion of the nozzle column, and in which the duty continuously decreases towards the end portions. However, it is possible to use a mask pattern having the distribution characteristic where the duty is stepwisely changed.

Furthermore, in the above second examle of the characterizing sotructure, it is possible not to change the end portion duty ratio of mask pattern. The following structure can be considered depending on the printing apparatus. In this structure, conveying means (roller and the like) having high dimensional accuracy is used, thereby ensuring conveyance accuracy of the front and rear end portions. At this time, even if a relatively large number of nozzles (for example, 256) are used, it is possible to ensure the conveyance accuracy sufficient enough not to generate a line-shaped high-density or low-density portion depending on the printing medium. Accordingly, it is not necessary to set the mask pattern in which the end portion duty is low. This also makes it difficult to generate band-shaped unevenness in the region of the printing medium corresponding to the central portion of the nozzle column.

Moreover, in either case of the above first and second examples of the characterizing structure, it is possible to use a mask pattern in which a regular pattern is repeated periodically, for example, as illustrated in FIG. 4. In addition, it is also possible to use a mask pattern having a random arrangement as disclosed in Japanese Patent Application Laid-Open No. 6-330616 (1994). Still moreover, it is possible to use a pseudo-periodic mask pattern, in which a pixel arrangement having a predetermined dispersibility is defined, as disclosed in Japanese Patent Application Laid-Open No. 2002-144552. It is also possible to use mask patterns in which printable areas are arranged inchecker pattern.

In a direction opposite to these, the print may be made without performing the multi-pass print only by changing the number of nozzles and the amount of conveying the printing medium, as far as it is possible to make a print on various types of printing media with appropriate balance between image quality and printing speed, while further improving usability.

While the present invention has been described with reference to exemplary embodiments, it is to be understood that the invention is not limited to the disclosed exemplary embodiments. The scope of the followings claims is to be accorded the broadest interpretation so as to encompass all such modification and equivalent structures and functions.

This application claims the benefit of the Japanese Patent Application Nos. 2005-262367, filed Sep. 9, 2005, and 2005-362419, filed Dec. 15, 2005, which are hereby incorporated by reference herein in their entirety.

What is claimed is:

1. An ink jet printing apparatus for printing an image by performing a print scan which makes a print while causing a printing head, which includes an array of printing elements for ejecting ink, to scan on a printing medium in a direction different from a direction of the array, and by conveying the printing medium in a direction intersecting with the direction of the print scan, the apparatus comprising:

controller which reduces a range in the array of the printing elements to be used for printing on at least one of front and rear end portions of the printing medium so that the range can be smaller than a range in the array of the printing elements to be used for printing on a central portion of the printing medium, and thus, which performs the print scan, wherein the controller changes the size of the reducing range depending on at least one of a print mode selected from a plurality of print modes, each having the different number of colors of ink usable for printing the image, and a type of selected printing medium.

2. An ink jet printing apparatus for printing an image by performing a print scan which makes a print while causing a printing head, which includes an array of printing elements for ejecting ink, to scan on a printing medium in a direction different from a direction of the array, and by conveying the printing medium in a direction intersecting with the direction of the print scan, the apparatus comprising:

controller which reduces a range in the array of the printing elements to be used for printing on at least one of front and rear end portions of the printing medium so that the range can be smaller than a range in the array of the printing elements to be used for printing on a central portion of the printing medium, and thus, which performs the print scan, wherein the controller changes the size of the reducing range depending on a print mode selected from a plurality of print modes, each having the different number of colors of ink usable for printing the image.

3. An ink jet printing apparatus as claimed in claim 2, wherein the controller more decreases the size of the reducing range in a print mode in which the number of colors of ink usable for printing the image is a first number relative to a print mode in which the number of colors of ink usable for printing the image is a second number greater than the first number.

4. An ink jet printing apparatus as claimed in claim 2, wherein:

the printing head has an array of the printing elements ejecting achromatic ink and an array of the printing elements ejecting chromatic ink;

the plurality of print modes includes a first print mode in which a print is made by using mainly the achromatic ink and a second print mode in which a print is made by using mainly the chromatic ink; and wherein the controller more decreases the size of the reducing range in the first print mode relative to the second print mode.

5. An ink jet printing apparatus as claimed in claim 4, wherein the achromatic ink is used more than the chromatic ink in the first print mode.

6. An ink jet printing apparatus as claimed in claim 2, further comprising:

first conveying unit which conveys the printing medium, positioned upstream of the printing head in the conveying direction; and second conveying unit which conveys the printing medium, positioned downstream of the printing head in the conveying direction, wherein the controller performs the print scan after determining that print is to be made on the front end portion when the printing medium is supported by only the first conveying unit, determining that the print is to be made on the central portion when the printing medium is supported by both the first and second conveying units, and determining that the print is to be made on the rear end portion when the printing medium is supported by only the second conveying unit.

7. An ink jet printing apparatus as claimed in claim 2, wherein a marginless image is printed on at least one of the front and rear end portions of the printing medium.

8. An ink jet printing apparatus as claimed in claim 2, wherein the printing medium is conveyed by the amount less than a width of the range to be used in the print scan, and thereby, the print is made by plural times of print scans, in accordance with a mask pattern which defines a pixel arrangement having a complementary relationship in the same image region on the printing medium.

9. An ink jet printing apparatus as claimed in claim 8, wherein mask patterns are changed for making the print on at least one of the front and the rear end portions, depending on the type of the printing medium, the mask pattern being applied to the plural time of print scans.

10. An ink jet printing apparatus as claimed in claim 9, wherein:

the pixel arrangement of the mask pattern has a distributive characteristic in which a printable rate is a maximum at the printing element of the position corresponding to a center of the array of the printing elements to be used for making a print, and in which the printable rate tends to decrease toward the printing elements of end portions of the array; and the mask patterns each having different printable rates of the central portion and the end portions are used depending on the type of the printing medium.

11. An ink jet printing apparatus for printing an image by performing a print scan which makes a print while causing a printing head, which includes an array of printing elements for ejecting ink, to scan on a printing medium in a direction different from a direction of the array, and by conveying the printing medium in a direction intersecting with the direction of the print scan, the apparatus comprising:

controller which reduces a range in the array of the printing elements to be used for printing on at least one of front and rear end portions of the printing medium so that the range can be smaller than a range in the array of the printing elements to be used for printing on a central portion of the printing medium, and thus, which performs the print scan, wherein the controller changes the size of the reducing range depending on a type of selected printing medium.

12. An ink jet printing apparatus for printing an image by performing a print scan which makes a print while causing a printing head, which includes an array of printing elements for ejecting ink, to scan on a printing medium in a direction different from a direction of the array, and by conveying the printing medium in a direction intersecting with the direction of the print scan, the apparatus comprising:

conveyance controller which reduces the amount of conveying the printing medium in making the print on at least one of front and rear end portions of the printing medium as compared with the amount of conveying the printing medium in making the print on a central portion of the printing medium, wherein the controller changes the reducing conveyance amount depending on at least one of a print mode selected from a plurality of print modes, each having the different number of colors of ink usable for printing the image, and a type of selected printing medium.

13. An ink jet printing method of printing an image by performing a print scan which makes a print while causing a printing head, which includes an array of printing elements for ejecting ink, to scan on a printing medium in a direction different from a direction of the array, and by conveying the printing medium in a direction intersecting with the direction of the print scan, the method comprising the step of:

reducing a range in the array of the printing elements to be used for printing on at least one of front and rear end portions of the printing medium so that the range can be smaller than a range in the array of the printing elements to be used for printing on a central portion of the printing medium, and performing the print scan using the printing elements of the reduced range, wherein in the reducing step, the size of the reducing range is changed depending on at least one of a print mode selected from a plurality of print modes, each having the different number of colors of ink usable for printing the image, and a type of selected printing medium.

14. An ink jet printing method of printing an image by performing a print scan which makes a print while causing a printing head, which includes an array of printing elements for ejecting ink, to scan on a printing medium in a direction different from a direction of the array, and by conveying the printing medium in a direction intersecting with the direction of the print scan, the method comprising the step of:

reducing the amount of conveying the printing medium in making the print on at least one of front and rear end portions of the printing medium as compared with the amount of conveying the printing medium in making the print on a central portion of the printing medium, wherein in the reducing step, the reducing conveyance amount is changed depending on at least one of a print mode selected from a plurality of print modes, each having the different number of colors of ink usable for printing an image, and a type of selected printing medium.

* * * * *

UNITED STATES PATENT AND TRADEMARK OFFICE

CERTIFICATE OF CORRECTION

PATENT NO. : 7,393,078 B2
APPLICATION NO. : 11/515755
DATED : July 1, 2008
INVENTOR(S) : Takeshi Yazawa et al.

It is certified that error appears in the above-identified patent and that said Letters Patent is hereby corrected as shown below:

ON COVER PAGE [56] REFERENCES CITED:

U.S. Patent Documents, (insert) --6,601,939 B2 8/2003 Fujita et al.--; and --6,871,934 B2 3/2005 Masuyama et al.--; and --6,930,969 B2 8/2005 Otsuki--.

COLUMN 1:

Line 43, “portions” should read --portions on--.

COLUMN 3:

Line 15, “(state in” should read --state (in--.

COLUMN 4:

Line 16, “type digital” should read --type--; and
Line 17, “cameras” should be deleted.

COLUMN 5:

Line 47, “on printing” should read --on--.

COLUMN 9:

Line 24, “foremed” should read --formed--; and
Line 42, “mode;” should read --mode.--.

COLUMN 12:

Line 14, “mat” should read --matte--; and
Line 40, “Taken” should read --Taking--.

UNITED STATES PATENT AND TRADEMARK OFFICE

CERTIFICATE OF CORRECTION

PATENT NO. : 7,393,078 B2
APPLICATION NO. : 11/515755
DATED : July 1, 2008
INVENTOR(S) : Takeshi Yazawa et al.

It is certified that error appears in the above-identified patent and that said Letters Patent is hereby corrected as shown below:

COLUMN 17:

Line 43, “3060” should read --M3060--.

COLUMN 18:

Line 30, “3120” should read --M3120--.

COLUMN 22:

Line 47, “clutch” should read --clutch.--.

COLUMN 25:

Line 18, “remains” should read --remains.--; and
Line 23, “M5020C,” should read --M5020C.--.

COLUMN 26:

Line 18, “E00014” should read --E0014--.

COLUMN 27:

Line 17, “4002,” should read --E4002,--; and
Line 64, “receives” should read --received--.

COLUMN 29:

Line 3, “a nd” should read --and--.

COLUMN 31:

Line 27, “mage” should read --image--.

UNITED STATES PATENT AND TRADEMARK OFFICE

CERTIFICATE OF CORRECTION

PATENT NO. : 7,393,078 B2
APPLICATION NO. : 11/515755
DATED : July 1, 2008
INVENTOR(S) : Takeshi Yazawa et al.

It is certified that error appears in the above-identified patent and that said Letters Patent is hereby corrected as shown below:

COLUMN 36:

Line 29, “(step S3)” should read --(step S3).--.

COLUMN 37:

Line 56, “As” should read --At--.

COLUMN 43:

Line 5, “proton” should read --portion--; and
Line 48, “proton” should read --portion--.

COLUMN 45:

Line 10, “mat” should read --matte--;
Line 21, “contorl” should read --control--; and
Line 22, “mat” should read --matte--.

COLUMN 46:

Line 21, “follwing” should read --following--;
Table, Line 5, “mat” should read --matte--; and
Line 39, “apprppriately” should read --appropriately--.

COLUMN 47:

Line 22, “examle” should read --example--;
Line 23, “sotructure,” should read --structure,--; and
Line 49, “inchecker” should read --in a checked--.

UNITED STATES PATENT AND TRADEMARK OFFICE

CERTIFICATE OF CORRECTION

PATENT NO. : 7,393,078 B2
APPLICATION NO. : 11/515755
DATED : July 1, 2008
INVENTOR(S) : Takeshi Yazawa et al.

It is certified that error appears in the above-identified patent and that said Letters Patent is hereby corrected as shown below:

COLUMN 50:

Line 23, "step" should read --steps--.

Signed and Sealed this

Sixteenth Day of December, 2008

JON W. DUDAS
*Director of the United States Patent and Trademark Office*